US007799496B2

(12) United States Patent
Uesugi et al.

(10) Patent No.: US 7,799,496 B2
(45) **Date of Patent: *Sep. 21, 2010**

(54) ELECTROPHOTOGRAPHIC PHOTOSENSITIVE MEMBER, METHOD OF MANUFACTURING ELECTROPHOTOGRAPHIC PHOTOSENSITIVE MEMBER, PROCESS CARTRIDGE, AND ELECTROPHOTOGRAPHIC APPARATUS

(75) Inventors: Hirotoshi Uesugi, Numazu (JP); Yukihiro Abe, Mishima (JP); Daisuke Miura, Numazu (JP); Nobumichi Miki, Suntou-gun (JP); Harunobu Ogaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/103,175

(22) Filed: Apr. 15, 2008

(65) Prior Publication Data

US 2008/0199794 A1 Aug. 21, 2008

Related U.S. Application Data

(63) Continuation of application No. PCT/JP2007/071166, filed on Oct. 24, 2007.

(30) Foreign Application Priority Data

| | | |
|---|---|---|
| Oct. 31, 2006 | (JP) | 2006-295882 |
| Oct. 31, 2006 | (JP) | 2006-295885 |
| Oct. 31, 2006 | (JP) | 2006-295886 |
| Oct. 31, 2006 | (JP) | 2006-295889 |
| Oct. 31, 2006 | (JP) | 2006-295890 |
| Oct. 1, 2007 | (JP) | 2007-257077 |

(51) Int. Cl.
*G03G 5/04* (2006.01)

(52) U.S. Cl. ..... 430/66; 430/56; 430/59.6; 430/132; 399/159

(58) Field of Classification Search ..... 430/66, 430/56, 59.6, 132, 127; 399/159
See application file for complete search history.

(56) References Cited

U.S. PATENT DOCUMENTS

| | | | | |
|---|---|---|---|---|
| 4,792,507 | A * | 12/1988 | Yoshihara et al. | 430/59.6 |
| 7,553,594 | B2 * | 6/2009 | Ogaki et al. | 430/66 |
| 2004/0265007 | A1 * | 12/2004 | Hara | 399/176 |

FOREIGN PATENT DOCUMENTS

| | | | |
|---|---|---|---|
| JP | 52-82250 | * | 7/1977 |
| JP | 58-164656 | | 9/1983 |

(Continued)

OTHER PUBLICATIONS

English translation of JP 2000-275889 published Oct. 2000.*

(Continued)

*Primary Examiner*—Mark F Huff
*Assistant Examiner*—Peter L Vajda
(74) *Attorney, Agent, or Firm*—Fitzpatrick, Cella, Harper & Scinto

(57) ABSTRACT

An electrophotographic photosensitive member having excellent electrophotographic properties while being prevented from the generation of blade turn-up, a method of manufacturing the electrophotographic photosensitive member, and a process cartridge and an electrophotographic apparatus each having the electrophotographic photosensitive member are provided. The surface layer of the electrophotographic photosensitive member contains a polymer having a specific repeating structural unit.

11 Claims, 2 Drawing Sheets

FOREIGN PATENT DOCUMENTS

| | | |
|---|---|---|
| JP | 61-095358 | 5/1986 |
| JP | 61-270768 | 12/1986 |
| JP | 62-014657 | 1/1987 |
| JP | 62-055663 | 3/1987 |
| JP | 63-221355 | 9/1988 |
| JP | 64-014292 | 1/1989 |
| JP | 04-311754 | 11/1992 |
| JP | 04-326356 | 11/1992 |
| JP | 05-027630 | 2/1993 |
| JP | 06-075386 | 3/1994 |
| JP | 06-332219 | 12/1994 |
| JP | 2000-275889 | * 10/2000 |
| JP | 2000-290287 | 10/2000 |
| JP | 2003-012588 | 1/2003 |
| JP | 2003-241415 | 8/2003 |
| JP | 2005-054020 | 3/2005 |
| JP | 2005-314332 | 11/2005 |

OTHER PUBLICATIONS

English translation of abstract of JP 52-82250 published Jul. 1977.*
Translation of Japanese Office Action in JP 2008-303739 issued Apr. 27, 2009.

* cited by examiner

ELECTROPHOTOGRAPHIC PHOTOSENSITIVE MEMBER, METHOD OF MANUFACTURING ELECTROPHOTOGRAPHIC PHOTOSENSITIVE MEMBER, PROCESS CARTRIDGE, AND ELECTROPHOTOGRAPHIC APPARATUS

This application is a continuation of International Application No. PCT/JP2007/071166, filed Oct. 24, 2007, which claims the benefit of Japanese Patent Application Nos. 2006-295889, filed Oct. 31, 2006, 2006-295885, filed Oct. 31, 2006, 2006-295890, filed Oct. 31, 2006, 2006-295882, filed Oct. 31, 2006, 2006-295886, filed Oct. 31, 2006 and 2007-257077, filed Oct. 1, 2007.

BACKGROUND OF THE INVENTION

1. Field of the Invention

The present invention relates to an electrophotographic photosensitive member, a method of manufacturing the electrophotographic photosensitive member, and a process cartridge and an electrophotographic apparatus each having the electrophotographic photosensitive member.

2. Related Background Art

Electrophotographic photosensitive members using organic photoconductive substances (organic electrophotographic photosensitive members) have been intensively studied and developed in recent years.

The electrophotographic photosensitive member is basically composed of a support and a photosensitive layer formed on the substrate. In the case of the organic electrophotographic photosensitive member, a photosensitive layer is formed using a charge-generating substance and a charge-transporting substance as photoconductive substances and a resin for binding these substances (binder resin).

There are two types of layer structure of the photosensitive layer: a multilayer type and a monolayer type. In the multilayer type one, the function of charge generation and the function of charge transfer are separated (functionally separated) into a charge-generating layer and a charge-transporting layer, respectively. In the monolayer type one, a single layer is provided with both the function of charge generation and the function of charge transfer.

Most of electrophotographic photosensitive members employ a multilayer type photosensitive layer. In many cases, the charge-transporting layer is provided as the surface layer of the electrophotographic photosensitive members.

The image formation using an electrophotographic apparatus is generally carried out as described below.

First, an electrophotographic photosensitive member is electrostatically charged and the charged electrophotographic photosensitive member is then irradiated with exposure light, thereby forming an electrostatic latent image on the electrophotographic photosensitive member. Subsequently, the electrostatic latent image is developed with a toner-containing developer and a toner image thus formed is then transferred from the electrophotographic photosensitive member to a transfer material (such as paper). The transfer material with the transferred toner image is subjected to a process of an image fixation and then discharged from the apparatus to the outside. On the other hand, the electrophotographic photosensitive member after the transfer process is subjected to a cleaning process so that the transfer residual toner is removed from the member, and the member is then subjected to the removal of electricity if required, followed by subjecting the electrophotographic photosensitive member to a subsequent cycle of image formation.

Further, reflecting the needs of high image qualities in recent years, the number of electrophotographic apparatuses each employing spherical toner produced by a suspension polymerization method or an emulsion polymerization method has increased. For example, in a process of wiping out the transfer residual toner, a cleaning member (such as a cleaning blade), which is brought into contact with the electrophotographic photosensitive member, may hardly prevent the toner from slipping therethrough because of the surface smoothness of such spherical toner.

For alleviating the slip of toner, the cleaning member should be optimized on the basis of the specifications of an electrophotographic apparatus. In other words, there is a need of increasing the contact pressure of the cleaning member to be applied on the electrophotographic photosensitive member, the flexibility of the mounting angle of the cleaning member, or the flexibility of designing the configuration of the cleaning member.

Under the operation of an electrophotographic apparatus, a cleaning blade may abnormally slide on an electrophotographic photosensitive member and sometimes cause the so-called "blade turn-up" where the blade turns up.

The blade turn-up may tend to occur at an early stage after the setting of the electrophotographic apparatus before the accumulation of the transfer residual toner (it functions as a powder to impart slidability between the cleaning blade and the electrophotographic photosensitive member) on the contact boundary surface between the cleaning blade and the electrophotographic photosensitive member. When the material of the cleaning blade is an elastic rubber material, a high-temperature, high-humidity environment may tend to increase the frequency at which the turn-up of the blade occurs.

Therefore, for avoiding the generation of such blade turn-up, the addition of an additive to the surface layer of an electrophotographic photosensitive member may intensively improve the flexibility of blade design. For instance, the improvement may be attained by a method involving adding a compound as disclosed in Japanese Patent Application Laid-Open No. S62-014657.

However, the function of the additive is to improve the slidability of a cleaning blade to prevent it from turning up, so the additive has been also desired to be inactive to the electrophotographic properties of the electrophotographic photosensitive member (i.e., not prevent electric charge from moving through the photosensitive layer).

By the way, Japanese Patent Application Laid-Open No. S58-164656 discloses a fluorine graft polymer with a linear fluoroalkyl group.

Further, Japanese Patent Application Laid-Open No. 2003-012588 discloses a fluorine-containing polymer with a trifluoromethyl group on any one of its side chains and an ether structure.

SUMMARY OF THE INVENTION

The present invention aims to provide an electrophotographic photosensitive member having good electrophotographic properties while being prevented from the generation of blade turn-up, a method of manufacturing the electrophotographic photosensitive member, and a process cartridge and an electrophotographic apparatus each having the electrophotographic photosensitive member.

The inventors of the present invention have found out the following facts as a result of investigation.

That is, out of the additives for taking measures against blade turn-up, a fluorine graft polymer as described in Japanese Patent Application Laid-Open No. S58-164656 may be incorporated in the surface layer of an electrophotographic photosensitive member to obtain a good blade turn-up preventing effect.

Further, in addition to the blade turn-up preventing effect, improvements in electrophotographic properties can be also attained by improving the fluorine graft polymer described in Japanese Patent Application Laid-Open No. S58-164656, specifically modifying the linear chain structure on the fluoroalkyl group of the compound to a specific structure.

That is, according to one aspect of the present invention, an electrophotographic photosensitive member has a support and a photosensitive layer formed on the substrate and is characterized in that the surface layer of the photosensitive member contains a polymer having repeating structural units each represented by the following formula (1):

(1)

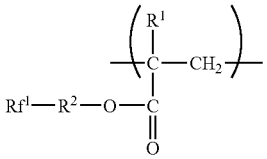

(where $R^1$ represents a hydrogen atom or a methyl group, $R^2$ represents a single bond or a divalent group, and $Rf^1$ represents a monovalent group having at least one of a fluoroalkyl group and a fluoroalkylene group), and that 70 to 100% by number of the repeating structural units each represented by the above formula (1) in the polymer are each any of repeating structural units represented by the following formulae (1-1) to (1-6):

(1-1)

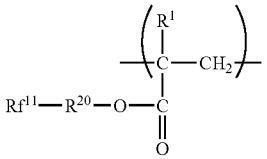

(1-2)

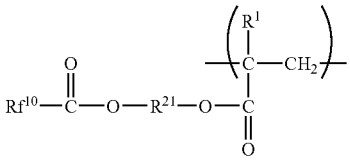

(1-3)

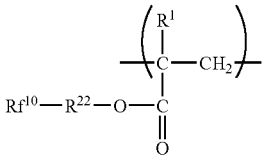

(1-4)

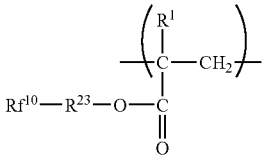

-continued (1-5)

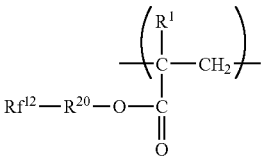

(1-6)

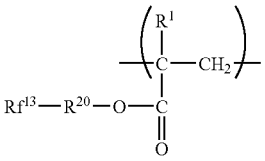

(where $R^1$ represents a hydrogen atom or a methyl group, $R^{20}$ represents a single bond or an alkyl group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group, or a —O—Ar—R— group (Ar represents an arylene group and R represents an alkylene group), $Rf^{10}$ represents a monovalent group having at least a fluoroalkyl group, $Rf^{11}$ represents a fluoroalkyl group having a branched structure with a carbon-carbon bond, $Rf^{12}$ represents a fluoroalkyl group interrupted with oxygen, and $Rf^{13}$ represents a perfluoroalkyl group having 4 to 6 carbon atoms).

According to another aspect of the present invention, a method of manufacturing the above electrophotographic photosensitive member is characterized by forming the surface layer of the electrophotographic photosensitive member using a surface-layer coating solution containing a polymer having repeating structural units each represented by the above formula (1).

According to another aspect of the present invention, a process cartridge is characterized by including: the above electrophotographic photosensitive member; and at least one unit selected from the group consisting of a charging unit, a developing unit, and a cleaning unit, wherein the member and the at least one unit are integrally supported and detachably attached to the main body of an electrophotographic apparatus.

According to another aspect of the present invention, an electrophotographic apparatus is characterized by including: the electrophotographic photosensitive member; a charging unit; an exposing unit; a developing unit; and a transfer unit.

According to the present invention, there may be provided an electrophotographic photosensitive member which is prevented from the generation of blade turn-up while having good electrophotographic properties, a method of manufacturing the electrophotographic photosensitive member, and a process cartridge and an electrophotographic apparatus each having the electrophotographic photosensitive member.

Further features of the present invention will become apparent from the following description of exemplary embodiments with reference to the attached drawings.

DETAILED DESCRIPTION OF THE INVENTION

Figure 1A:
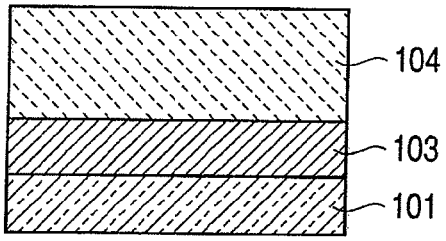
FIGS. 1A, 1B, 1C, 1D, and 1E are diagrams that illustrate examples of the layer structure of an electrophotographic photosensitive member of the present invention.
Figure 1D:
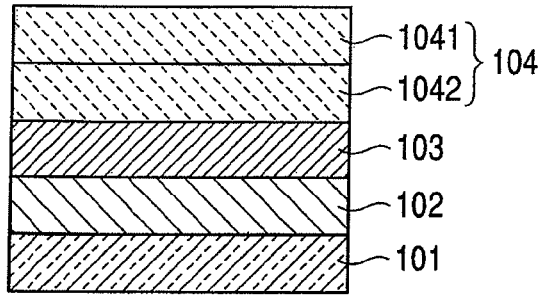
Figure 1B:
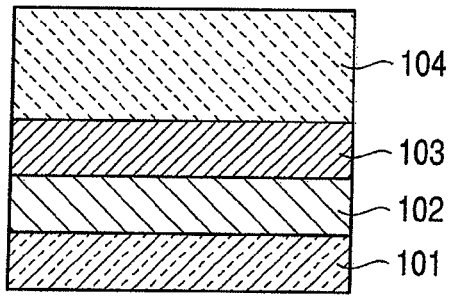

Hereinafter, the present invention will be described in more detail.

An electrophotographic photosensitive member of the present invention is prevented from the generation of blade turn-up at an early stage and keeps electrophotographic properties in a favorable condition. Here, the term "at an early stage" is a time period before the sufficient accumulation of transfer residual toner (it functions as a powder to impart slidability between the cleaning blade and the electrophotographic photosensitive member) on the contact boundary surface between the cleaning blade and the electrophotographic photosensitive member. The present invention can attain the above object by allowing the surface layer of the electrophotographic photosensitive member to contain the above polymer with a specific repeating structural unit.

The above polymer having a specific repeating structural unit is a polymer having repeating structural units each represented by the following formula (1):

(1)

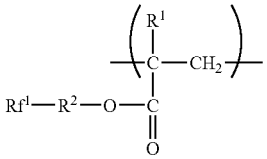

(where $R^1$ represents a hydrogen atom or a methyl group, $R^2$ represents a single bond or a divalent group, and $Rf^1$ represents a monovalent group having at least one of a fluoroalkyl group and a fluoroalkylene group), in which 70 to 100% by number of the repeating structural units each represented by the above formula (1) in the polymer are each any of repeating structural units represented by compounds represented by the following formulae (1-1) to (1-6):

(1-1)

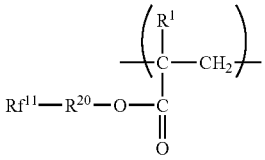

(1-2)

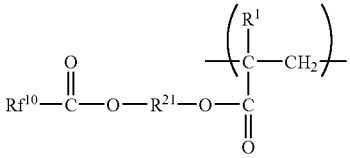

(1-3)

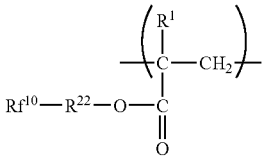

-continued (1-4)

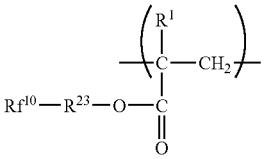

(1-5)

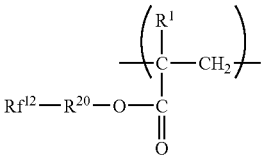

(1-6)

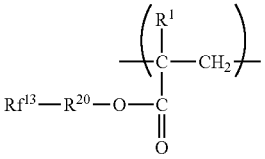

(where $R^1$ represents a hydrogen atom or a methyl group, $R^{20}$ represents a single bond or an alkyl group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group, or a —O—Ar—R— group (Ar represents an arylene group and R represents an alkylene group), $Rf^{10}$ represents a monovalent group having at least a fluoroalkyl group, $Rf^{11}$ represents a fluoroalkyl group having a branched structure with a carbon-carbon bond, $Rf^{12}$ represents a fluoroalkyl group interrupted with oxygen, and $Rf^{13}$ represents a perfluoroalkyl group having 4 to 6 carbon atoms).

Re: Formula (1)

$R^1$ in the above formula (1) represents a hydrogen atom or a methyl group.

$R^2$ in the above formula (1) represents a single bond or a divalent group. The divalent group may be preferably one having at least an alkylene group or an arylene group in its structure. Examples of the alkylene group include: linear alkylene groups such as a methylene group, an ethylene group, a propylene group, a butylene group, a pentylene group, and a hexylene group; and branched alkylene groups such as an isopropylene group and an isobutylene group. Of those, the methylene group, the ethylene group, the propylene group, and the butylene group are preferable. Examples of the arylene group include a phenylene group, a naphthylene group, and a biphenylene group. Of those, the phenylene group is preferable.

In the above formula (1), $Rf^1$ represents a monovalent group having at least one of a fluoroalkyl group and a fluoroalkylene group. Examples of the fluoroalkyl groups include the following:

(CF-1)

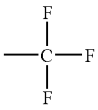

-continued (CF-2)

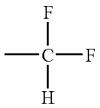

(CF-3)

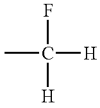

Examples of the fluoroalkylene group include the following:

(CF-4)

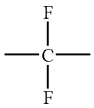

(CF-5)

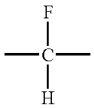

Re: Formula (1-1)

$R^1$ in the above formula (1-1) represents a hydrogen atom or a methyl group.

$R^{20}$ in the above formula (1-1) represents a single bond or an alkylene group. Examples of the alkylene group include linear alkylene group such as a methylene group, an ethylene group, a propylene group, a butylene group, a pentylene group, and a hexylene group. Of those, the methylene group, the ethylene group, the propylene group, and the butylene group are preferable.

$Rf^{11}$ in the above formula (1-1) represents a fluoroalkyl group having a branched structure with a carbon-carbon bond. Here, the branched structure with a carbon-carbon bond represents a structure in which the longest bonding chain and side chains thereof are bonded with each other by carbon-carbon bonds. In addition, part or the whole of the longest bonding chain and/or the side chains thereof may be substituted with fluorine.

Specific examples of $Rf^{11}$ in the above formula (1-1) will be represented below.

(Rf11-1)

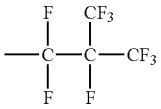

(Rf11-2)

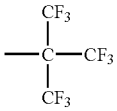

(Rf11-3)

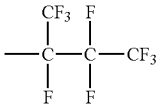

-continued (Rf11-4)

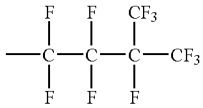

(Rf11-5)

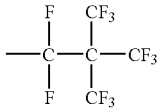

(Rf11-6)

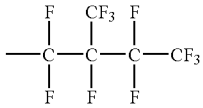

(Rf11-7)

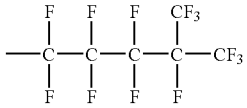

(Rf11-8)

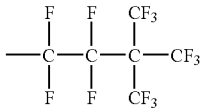

(Rf11-9)

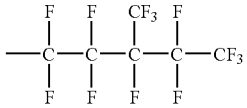

(Rf11-10)

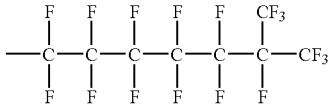

(Rf11-11)

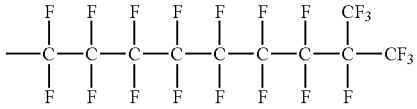

(Rf11-12)

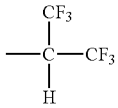

(Rf11-13)

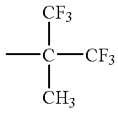

(Rf11-14)

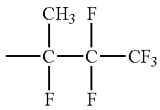

(Rf11-15)

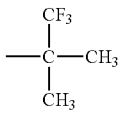

(Rf11-16)

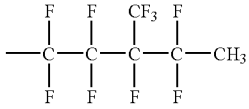

-continued (Rf11-17)

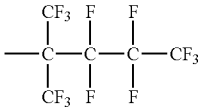

(Rf11-18)

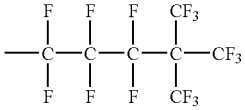

Of those, the fluoroalkyl groups represented by the above formulae (Rf11-1), (Rf11-7), (Rf11-17), and (Rf11-18) are preferable.

Specific examples of the repeating structural unit represented by the above formula (1-1) include the following:

(1-1-1)

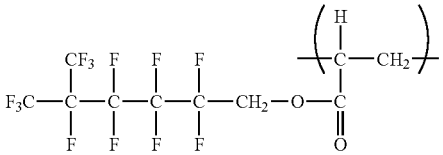

(1-1-2)

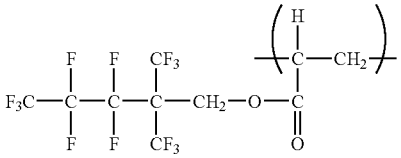

(1-1-3)

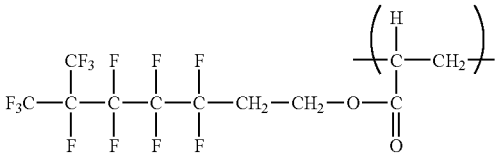

(1-1-4)

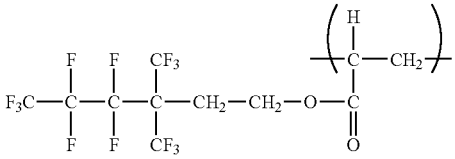

(1-1-5)

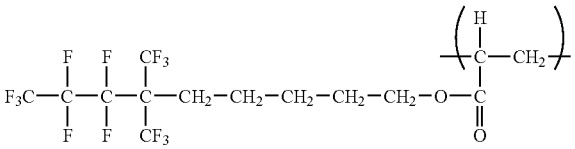

(1-1-6)

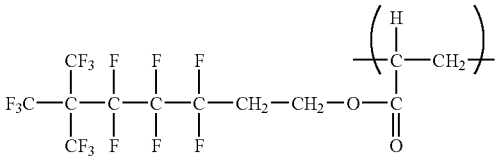

-continued (1-1-7)

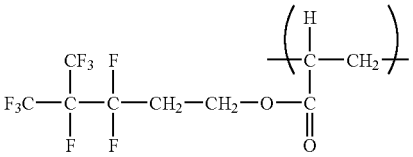

(1-1-8)

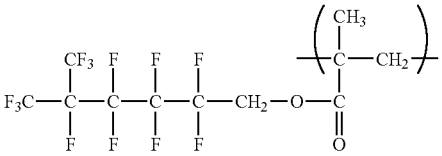

(1-1-9)

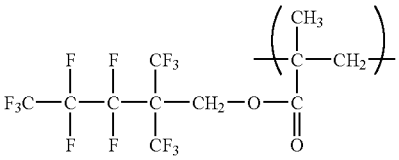

(1-1-10)

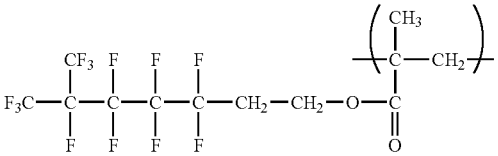

(1-1-11)

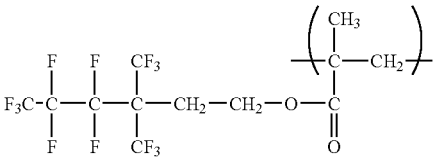

(1-1-12)

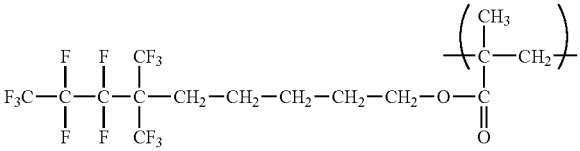

(1-1-13)

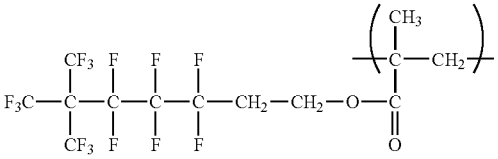

(1-1-14)

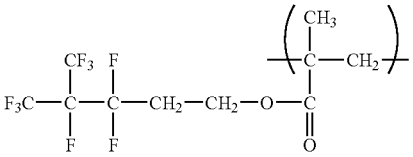

Of those, the repeating structural units represented by the above formulae (1-1-3), (1-1-4), (1-1-6), (1-1-7), (1-1-10), (1-1-11), (1-1-13), and (1-1-14) are preferable.

For obtaining an effect of preventing the blade turn-up, it is important that a polymer having the repeating structural unit represented by the above formula (1) for the present invention be a polymer having at least one of the fluoroalkyl group and the fluoroalkylene group in the repeating structural unit. Further, the polymer having the repeating structural unit represented by the above formula (1) for the present invention contains repeating structural units represented by any one of the above formulae (1-1) to (1-6) in an amount of 70 to 100% by number.

In the case of the repeating structural unit as represented by the above formula (1-1), the inventors of the present invention consider that the effects of the present invention can result from the lowering of the energy on the surface of an electrophotographic photosensitive member due to a fluoroalkyl group having a branched structure with a carbon-carbon bond in the repeating structural unit represented by the above formula (1-1).

Further, the polymer having the repeating structural unit represented by the above formula (1) for the present invention contains the repeating structural unit represented by the above formula (1-1) preferably in an amount of 70 to 100% by number, more preferably in an amount of 90 to 100% by number.

Re: Formula (1-2)

$R^1$ in the above formula (1-2) represents a hydrogen atom or a methyl group.

$R^{21}$ in the above formula (1-2) represents an alkylene group having a branched structure with a carbon-carbon bond. The branched structure with a carbon-carbon bond represents a structure in which the longest bonding chain and the side chains thereof are bonded by carbon-carbon bonds. The longest bonding chain is preferably formed of 2 to 6 carbon atoms. In addition, any substituent on the side chain portion may be an alkyl group, a fluoroalkyl group, or the like. The alkyl group may be a methyl group, an ethyl group, a propyl group, or a butyl group. Of those, the methyl group and the ethyl group are preferable. The fluoroalkyl group may be, for example, any of the groups represented by the above formulae (CF-1) to (CF-3). Of those, the group represented by the above formula (CF-1) is preferable.

$Rf^{10}$ in the above formula (1-2) represents a monovalent group with at least a fluoroalkyl group. Examples of the fluoroalkyl group include the groups represented by the above formulae (CF-1) to (CF-3). In addition, $Rf^{10}$ is not limited to a linear structure but may be of a branched structure. Alternatively, $Rf^{10}$ may be a fluoroalkyl group interrupted with an oxygen atom.

Specific examples of $Rf^{10}$ in the above formula (1-2) will be represented below.

(Rf10-1)

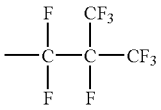

(Rf10-2)

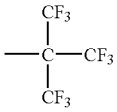

(Rf10-3)

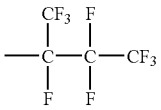

(Rf10-4)

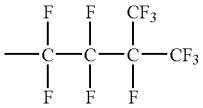

-continued (Rf10-5)

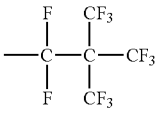

(Rf10-6)

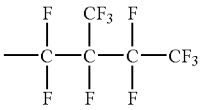

(Rf10-7)

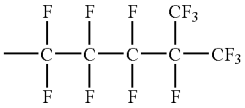

(Rf10-8)

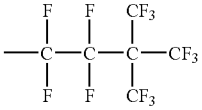

(Rf10-9)

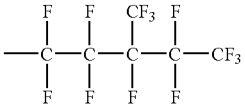

(Rf10-10)

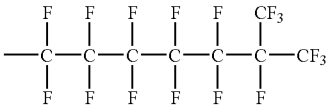

(Rf10-11)

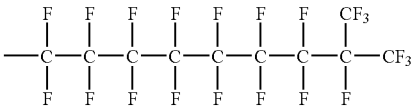

(Rf10-12)

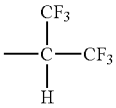

(Rf10-13)

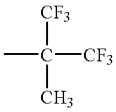

(Rf10-14)

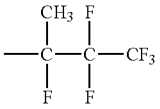

(Rf10-15)

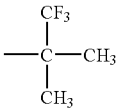

(Rf10-16)

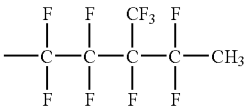

(Rf10-17)

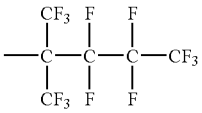

-continued
(Rf10-18)
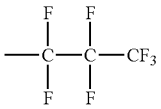
(Rf10-19)
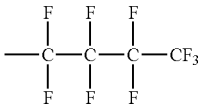
(Rf10-20)
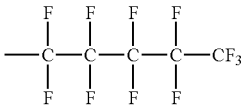
(Rf10-21)
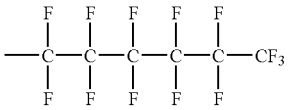
(Rf10-22)
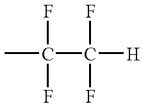
(Rf10-23)
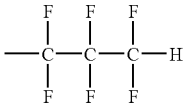
(Rf10-24)
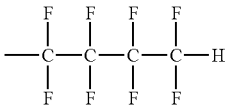
(Rf10-25)
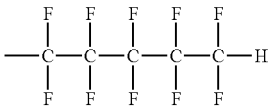
(Rf10-26)
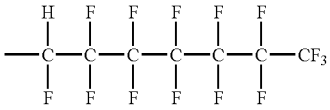
(Rf10-27)
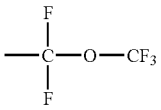
(Rf10-28)
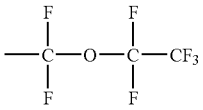
(Rf10-29)
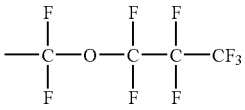
(Rf10-30)
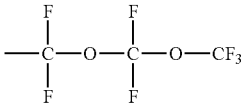
-continued
(Rf10-31)
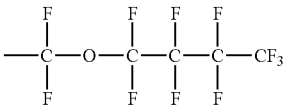
(Rf10-32)
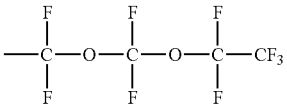
(Rf10-33)
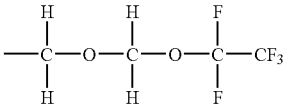
(Rf10-34)
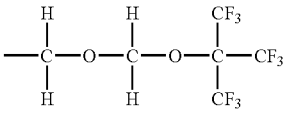
(Rf10-35)
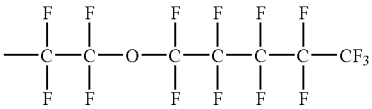
(Rf10-36)
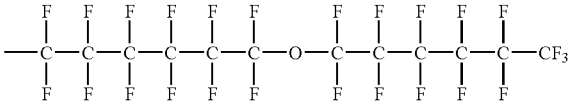
Of those, a monovalent group having a fluoroalkyl group represented by the above formula (Rf10-19) or (Rf10-24) is preferable.
Specific examples of the repeating structural unit represented by the above formula (1-2) include the following:
(1-2-1)
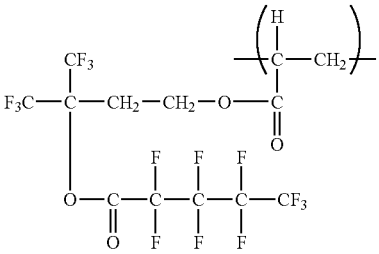
(1-2-2)
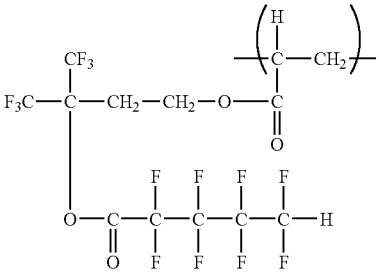

-continued (1-2-3)

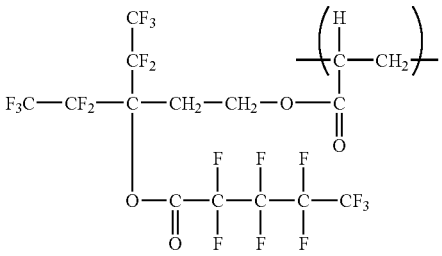

(1-2-4)

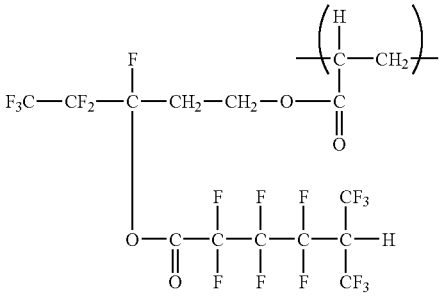

(1-2-5)

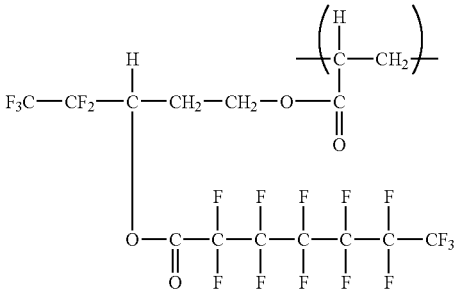

(1-2-6)

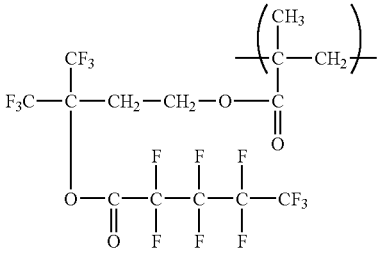

(1-2-7)

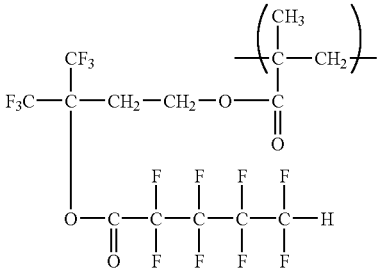

Of those, a repeating structural unit represented by the above formula (1-2-1) or (1-2-2) is preferable.

As described above, for obtaining an effect of preventing the blade turn-up, it is important that a polymer having the repeating structural unit represented by the above formula (1) for the present invention be a polymer having at least one of the fluoroalkyl group and the fluoroalkylene group in the repeating structural unit. Further, the polymer having the repeating structural unit represented by the above formula (1) for the present invention contains repeating structural units represented by any one of the above formulae (1-1) to (1-6) in an amount of 70 to 100% by number.

In the case of the repeating structural unit represented by the above formula (1-2), the inventors of the present invention have an opinion that the effects of the present invention can result from lowering of the energy on the surface of the electrophotographic photosensitive member due to the fluoroalkyl group or fluoroalkylene group in the repeating structural unit represented by the above formula (1-2). In addition, the effect of the alkylene group having a branched structure with a carbon-carbon bond may lead to an increase in compatibility between the binder resin and the polymer having the repeating structural unit represented by the above formula (1) for the present invention. As a result, the energy on the surface of the electrophotographic photosensitive member may be lowered by the increased compatibility.

Further, the polymer having the repeating structural unit represented by the above formula (1) for the present invention contains the repeating structural unit represented by the above formula (1-2) preferably in an amount of 70 to 100% by number, more preferably in an amount of 90 to 100% by number.

Re: Formula (1-3)

$R^1$ in the above formula (1-3) represents a hydrogen atom or a methyl group.

$R^{22}$ in the above formula (1-3) represents a —$R^{21}$— group or a —O—$R^{21}$— group. To be specific, the —$R^{21}$— group represents an alkylene group having a branched structure with a carbon-carbon bond. The branched structure with a carbon-carbon bond represents a structure in which the longest bonding chain and the side chains thereof are bonded by carbon-carbon bonds. The longest bonding chain is preferably formed of 2 to 6 carbon atoms. In addition, the side chain portion may be an alkyl group, a fluoroalkyl group, or the like. The alkyl group may be a methyl group, an ethyl group, a propyl group, or a butyl group. Of those, the methyl group and the ethyl group are preferable. The fluoroalkyl group may be, for example, any of the groups represented by the above formulae (CF-1) to (CF-3).

Of those, the group represented by the above formula (CF-1) is preferable. Further, the —O—$R^{21}$— group represents a structure in which the alkylene group having a branched structure with a carbon-carbon structure as described above is bonded to $Rf^{10}$ through an oxygen atom.

$Rf^{10}$ in the above formula (13) represents a monovalent group with at least a fluoroalkyl group. Examples of the fluoroalkyl group include the groups represented by the above formulae (CF-1) to (CF-3). In addition, $Rf^{10}$ is not limited to a linear structure but may be of a branched structure. Alternatively, $Rf^{10}$ may be a fluoroalkyl group interrupted with an oxygen atom.

Specific examples of $Rf^{10}$ in the above formula (1-3) include those represented by the above formulae (Rf10-1) to (Rf10-36). Of those, monovalent groups with fluoroalkyl groups represented by the above formulae (Rf10-10) and (Rf10-19) are preferable.

Specific examples of the repeating structural unit represented by the above formula (1-3) include the following:

(1-3-1)
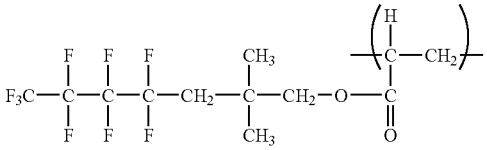
(1-3-2)
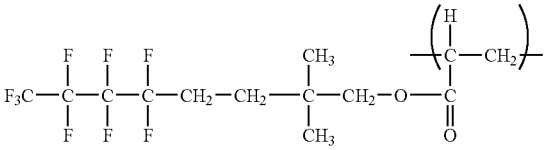
(1-3-3)
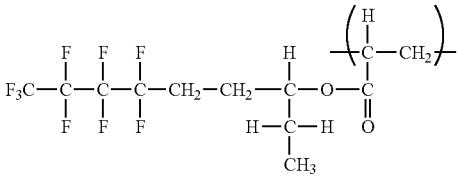
(1-3-4)
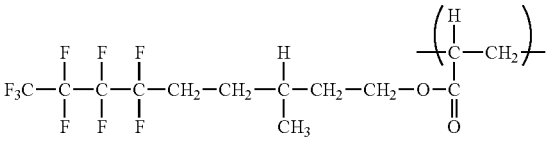
(1-3-5)
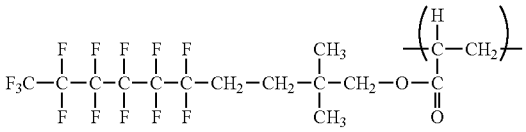
(1-3-6)
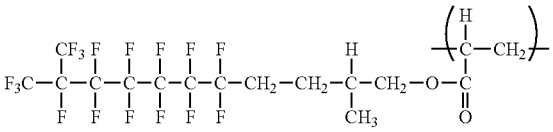
(1-3-7)
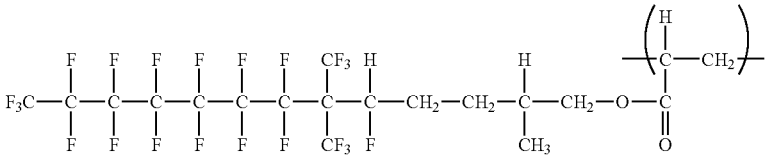
(1-3-8)
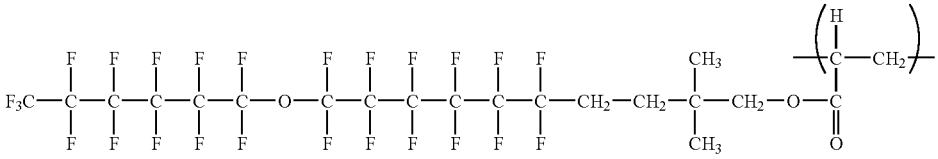
(1-3-9)
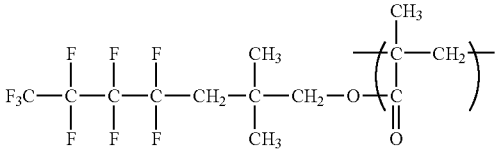
(1-3-10)
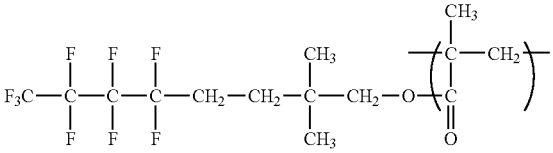
(1-3-11)
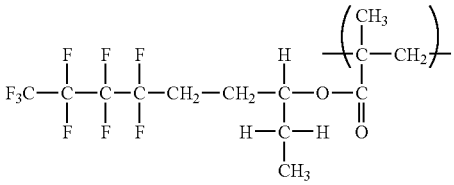
(1-3-12)
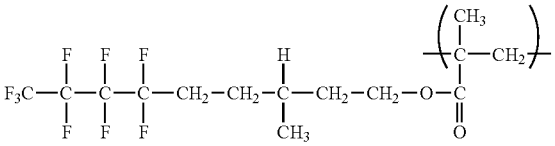
(1-3-13)
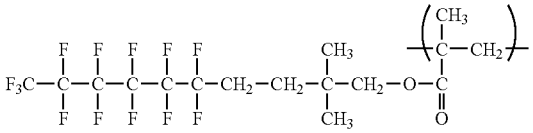
(1-3-14)
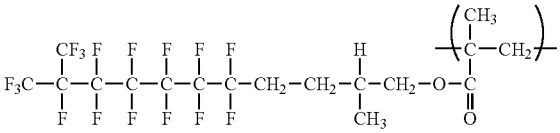

-continued (1-3-15)

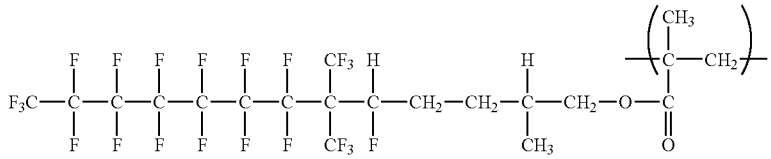

(1-3-16)

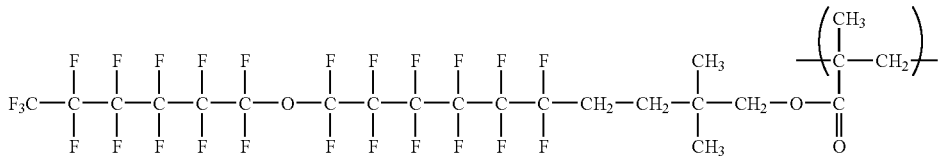

Of those, the repeating structural units represented by the above formulae (1-3-1), (1-3-2), (1-3-3), (1-3-4), (1-3-6), (1-3-9), (1-3-10), (1-3-11), (1-3-12), and (1-3-14) are preferable.

As described above, for obtaining an effect of preventing the blade turn-up, it is important that a polymer having the repeating structural unit represented by the above formula (1) for the present invention be a polymer having at least one of the fluoroalkyl group and the fluoroalkylene group in the repeating structural unit. Further, the polymer having the repeating structural unit represented by the above formula (1) for the present invention contains repeating structural units represented by any one of the above formulae (1-1) to (1-6) in an amount of 70 to 100% by number.

In the case of the repeating structural unit represented by the above formula (1-3), the inventors of the present invention have an opinion that the effects of the present invention can result from lowering of the energy on the surface of the electrophotographic photosensitive member due to the fluoroalkyl group included in the repeating structural unit represented by the above formula (1-3). In addition, the alkylene group having a branched structure with a carbon-carbon bond may lead to an increase in compatibility between the binder resin and the polymer having repeating structural unit represented by the above formula (1) for the present invention. As a result, the energy on the surface of the electrophotographic photosensitive member may be lowered by the increased compatibility.

Further, the polymer having the repeating structural unit represented by the above formula (1) for the present invention contains the repeating structural unit represented by the above formula (1-3) preferably in an amount of 70 to 100% by number, more preferably in an amount of 90 to 100% by number.

Re: Formula (1-4)

$R^1$ in the above formula (1-4) represents a hydrogen atom or a methyl group.

$R^{23}$ in the above formula (1-4) represent a —Ar— group, a —O—Ar— group, or a —O—Ar—R— group (Ar represents an arylene group and R represents an alkylene group). Examples of the arylene group of Ar include a phenylene group, a naphthylene group, and a biphenylene group. Of those, the phenylene group is preferable. Examples of the alkylene group of R include: linear alkylene groups such as a methylene group, an ethylene group, a propylene group, a butylene group, a pentylene group, and a hexylene group; and branched alkylene group, such as an isopropylene group and an isobutylene group. Of those, the methylene group, the ethylene group, the propylene group, and the butylene group are preferable. The —O—Ar— group or the —O—Ar—R— group represents a structure to be bonded to $Rf^{10}$ through an oxygen atom.

$Rf^{10}$ in the above formula (1-4) represents a monovalent group with at least a fluoroalkyl group. The fluoroalkyl group may be, for example, a group represented by any of the above formulae (CF-1) to (CF-3). Further, $Rf^{10}$ is not limited to a linear structure but may be of a branched structure. Alternatively, $Rf^{10}$ may be a fluoroalkyl group interrupted with an oxygen atom.

Specific examples of $Rf^{10}$ in the above formula (1-4) include those represented by the above formulae (Rf10-1) to (Rf10-36). Of those, monovalent groups with fluoroalkyl groups represented by the above formulae (Rf10-21) and (Rf10-36) are preferable.

Specific examples of the repeating structural unit represented by the above formula (1-4) include the following:

(1-4-1)

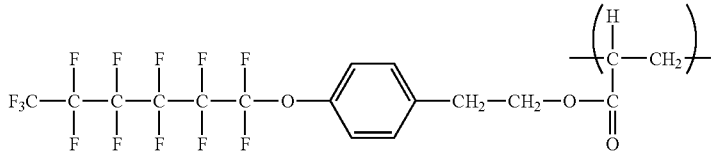

(1-4-2)

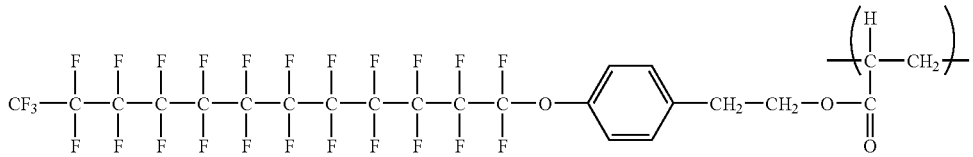

-continued
(1-4-3)
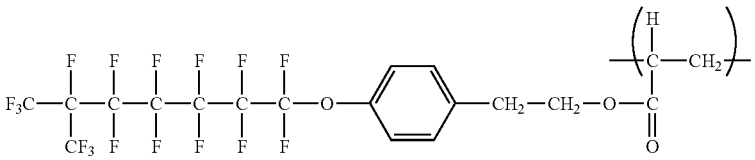
(1-4-4)
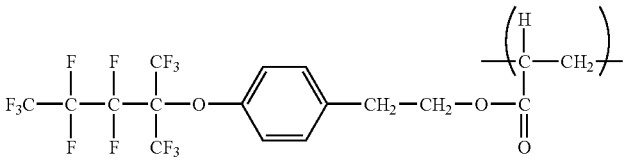
(1-4-5)
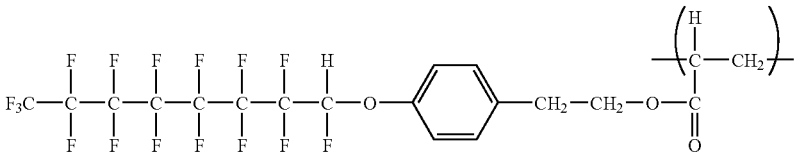
(1-4-6)
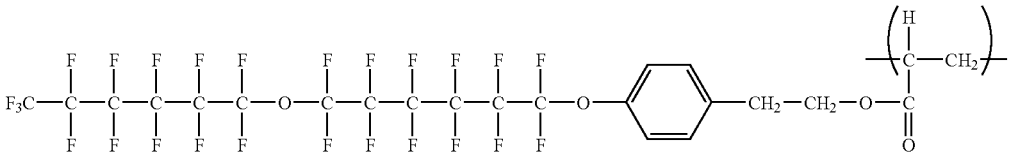
(1-4-7)
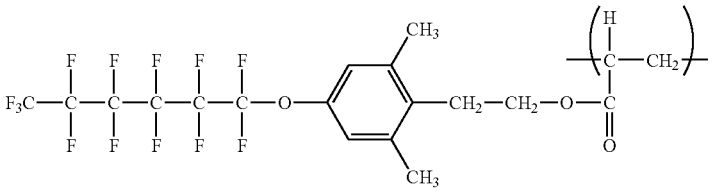
(1-4-8)
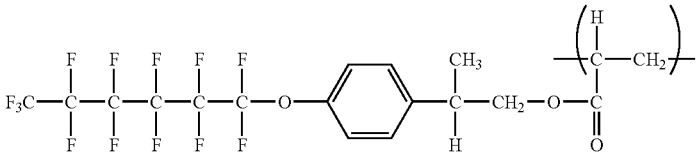
(1-4-9)
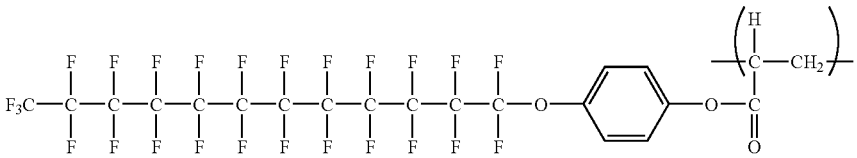
(1-4-10)
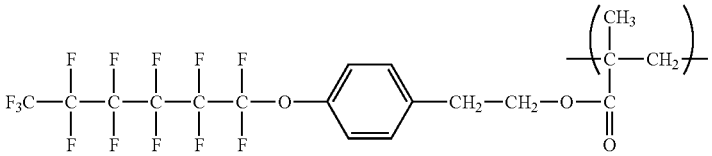
(1-4-11)
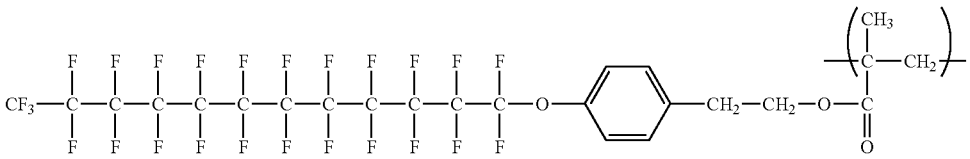

-continued (1-4-12)

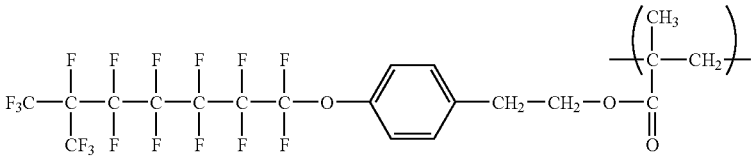

(1-4-13)

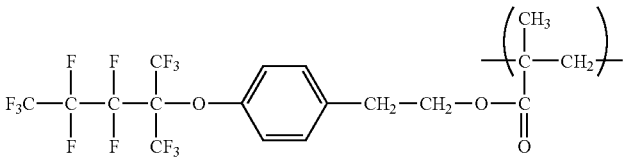

(1-4-14)

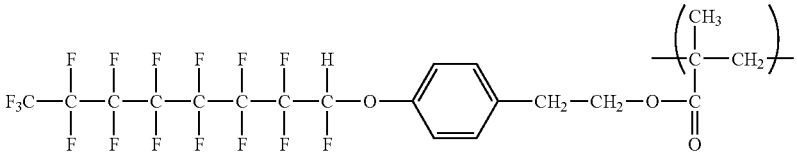

(1-4-15)

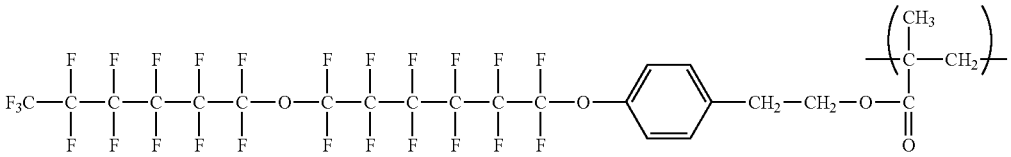

(1-4-16)

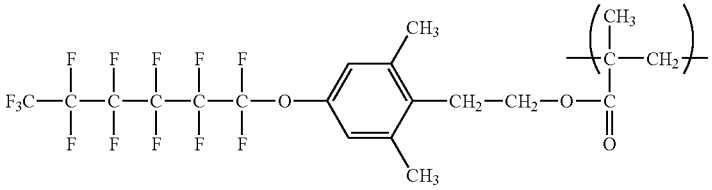

(1-4-17)

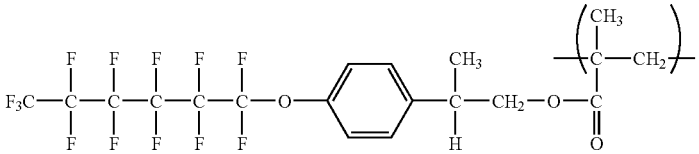

(1-4-18)

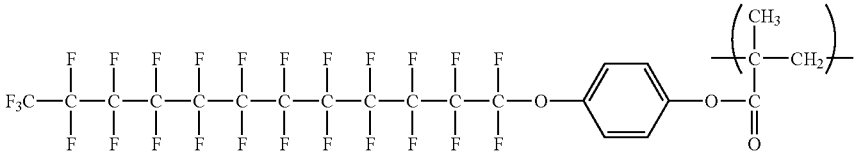

Of those, the repeating structural units represented by the above formulae (1-4-1), (1-4-6), (1-4-7), (1-4-8), (1-4-10), (1-4-15), (1-4-16), and (1-4-17) are preferable.

As described above, for obtaining an effect of preventing the blade turn-up, it is important that a polymer having the repeating structural unit represented by the above formula (1) for the present invention be a polymer having at least one of the fluoroalkyl group and the fluoroalkylene group in the repeating structural unit. Further, the polymer having the repeating structural unit represented by the present formula (1) for the above invention contains repeating structural units represented by any one of the above formulae (1-1) to (1-6) in an amount of 70 to 100% by number.

In the case of the repeating structural unit represented by the above formula (1-4), the inventors of the present invention have an opinion that the effects of the present invention can result from lowering of the energy on the surface of the electrophotographic photosensitive member due to the fluoroalkyl group included in the repeating structural unit represented by the above formula (1-4). In addition, the effect of the arylene group may lead to an increase in compatibility between the binder resin and the repeating structural unit represented by the above formula (1) for the present invention. As a result, the energy on the surface of the electrophotographic photosensitive member may be lowered by the increased compatibility.

Further, the polymer having the repeating structural unit represented by the above formula (1) for the present invention contains the repeating structural unit represented by the above formula (1-4) preferably in an amount of 70 to 100% by number, more preferably in an amount of 90 to 100% by number.

Re: Formula (1-5)

$R^1$ in the above formula (1-5) represents a hydrogen atom or a methyl group.

$R^{20}$ in the above formula (1-5) represents a single bond or an alkylene group. Examples of the alkylene group include linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{12}$ in the above formula (1-5) represents a fluoroalkyl group interrupted with oxygen. The fluoroalkyl group interrupted with oxygen represents that at least one oxygen atom is included in the longest bonding chain. Alternatively, a fluoroalkyl group or a fluoroalkylene group may be present on both sides or one side of the oxygen atom.

Specific examples of $Rf^{12}$ in the above formula (1-5) will be represented below.

(Rf12-1)

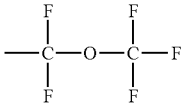

(Rf12-2)

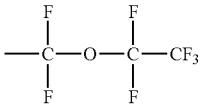

(Rf12-3)

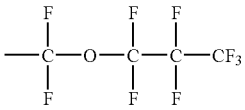

(Rf12-4)

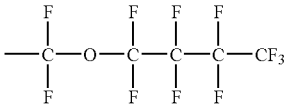

(Rf12-5)

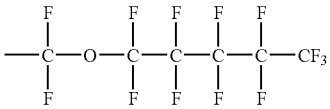

(Rf12-6)

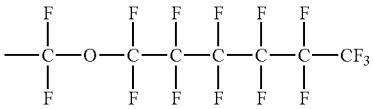

(Rf12-7)

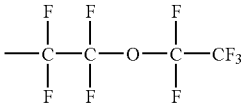

-continued (Rf12-8)

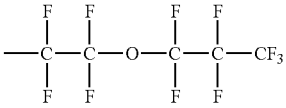

(Rf12-9)

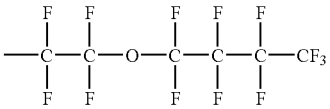

(Rf12-10)

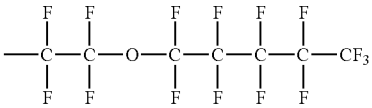

(Rf12-11)

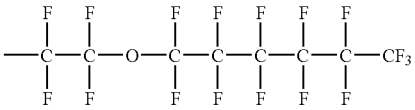

(Rf12-12)

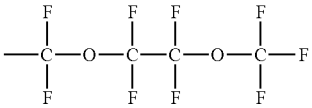

(Rf12-13)

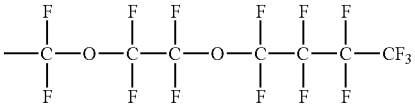

(Rf12-14)

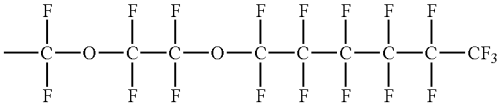

(Rf12-15)

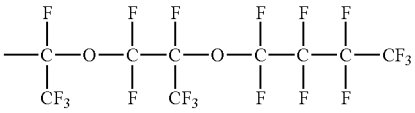

(Rf12-16)

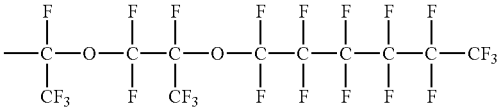

(Rf12-17)

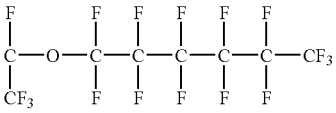

Of those, the groups represented by the above formulae (Rf12-13), (Rf12-14), (Rf12-16), and (Rf12-17) are preferable.

Specific examples of the repeating structural unit represented by the above formula (1-5) include the following:

(1-5-1)

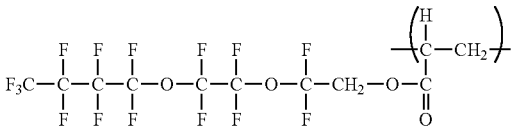

(1-5-2)

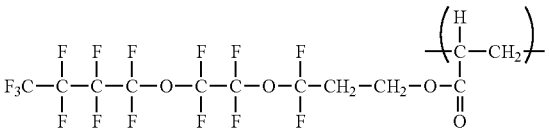

-continued
(1-5-3)
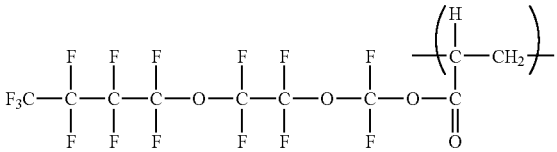
(1-5-4)
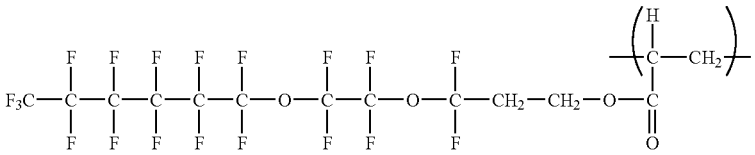
(1-5-5)
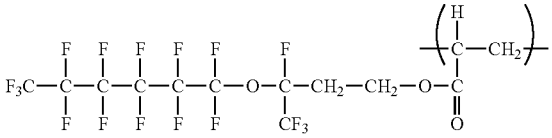
(1-5-6)
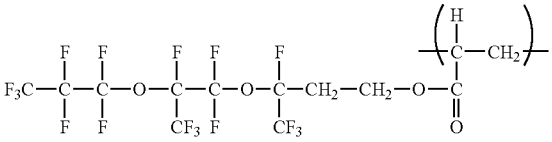
(1-5-7)
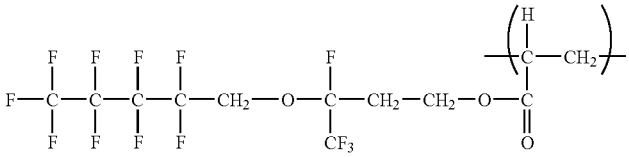
(1-5-8)
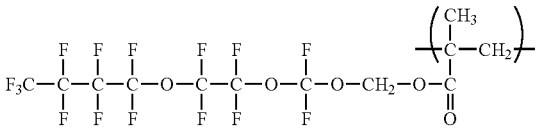
(1-5-9)
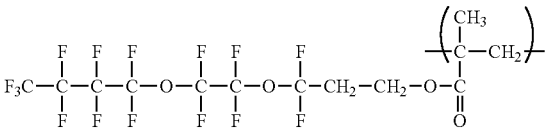
(1-5-10)
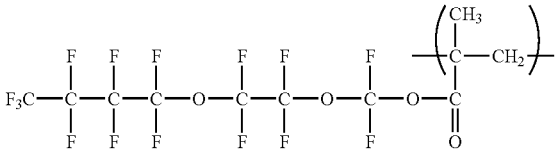
(1-5-11)
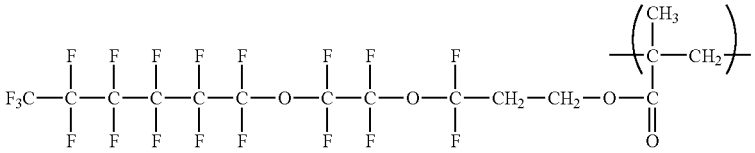
(1-5-12)
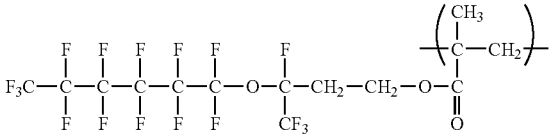
(1-5-13)
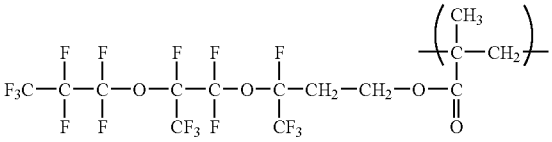
(1-5-14)
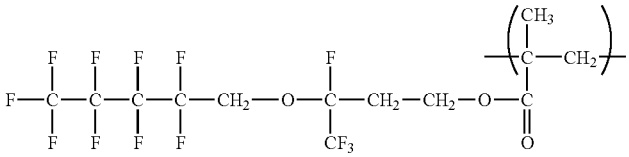

Of those, the repeating structural units represented by the above formulae (1-5-2), (1-5-4), (1-5-5), (1-5-6), (1-5-8), (1-5-11), (1-5-12), and (1-5-13) are preferable.

As described above, for obtaining an effect of preventing the blade turn-up, it is important that a polymer having the repeating structural unit represented by the above formula (1) for the present invention be a polymer having at least one of the fluoroalkyl group and the fluoroalkylene group in the repeating structural unit. Further, the polymer having the repeating structural unit represented by the above formula (1) for the present invention contains repeating structural units represented by any one of the above formulae (1-1) to (1-6) in an amount of 70 to 100% by number.

In the case of the repeating structural unit represented by the above formula (1-5), the inventors of the present invention have an opinion that the effects of the present invention can result from lowering of the energy on the surface of the electrophotographic photosensitive member due to the fluoroalkyl group included in the repeating structural unit represented by the above formula (1-5). In addition, the fluoroalkyl group is interrupted with oxygen, so the energy on the surface of the electrophotographic photosensitive member may be lowered also by an improvement in compatibility between the binder resin and the polymer having the repeating structural unit represented by the above formula (1) for the present invention.

Further, the polymer having the repeating structural unit represented by the above formula (1) for the present invention contains the repeating structural unit represented by the above formula (1-1) preferably in an amount of 70 to 100% by number, more preferably in an amount of 90 to 100% by number.

Re: Formula (1-6)

$R^1$ in the above formula (1-6) represents a hydrogen atom or a methyl group.

$R^{20}$ in the above formula (1-6) represents a single bond or an alkylene group. Examples of the alkylene group include linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{13}$ in the above formula (1-6) represents a perfluoroalkyl group with 4 to 6 carbon atoms.

Specific examples of $Rf^{13}$ in the above formula (1-6) will be represented below.

(Rf13-1)

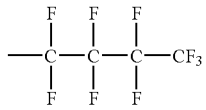

(Rf13-2)

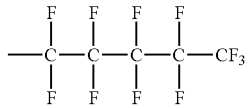

(Rf13-3)

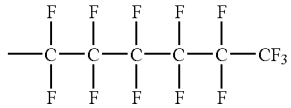

Of those, groups represented by the above formulae (Rf13-1) and (Rf13-3) are preferable.

Specific examples of the repeating structural unit represented by the above formula (1-6) include the following:

(1-6-1)

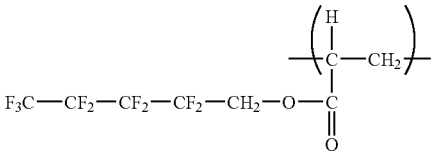

(1-6-2)

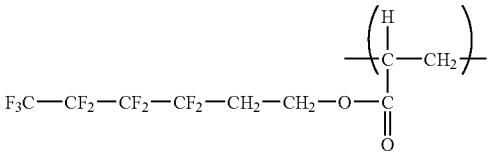

(1-6-3)

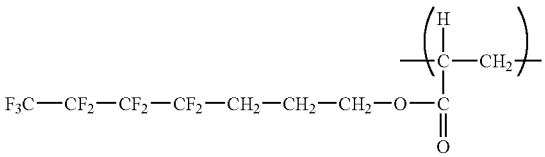

(1-6-4)

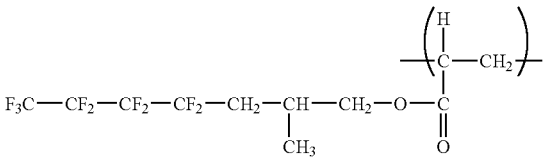

(1-6-5)

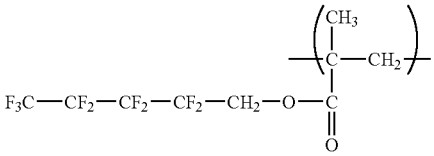

(1-6-6)

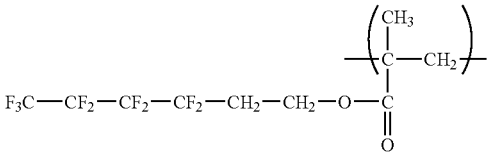

(1-6-7)

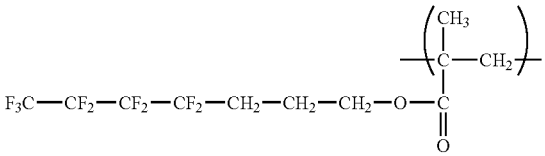

(1-6-8)

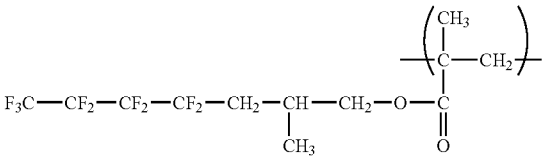

-continued (1-6-9)

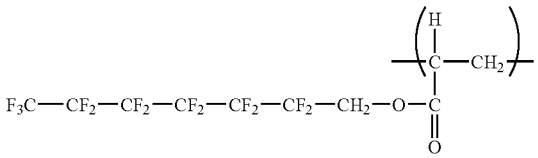

(1-6-10)

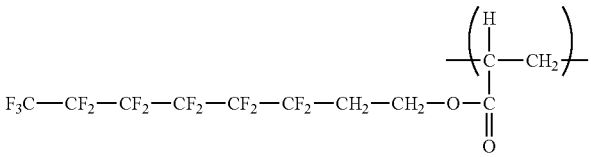

(1-6-11)

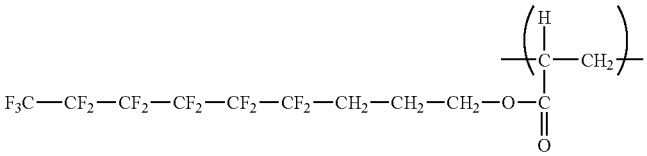

(1-6-12)

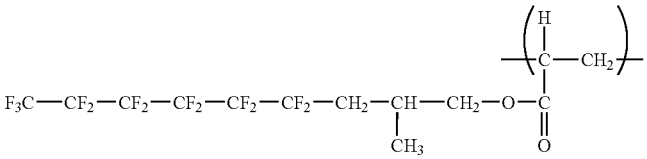

(1-6-13)

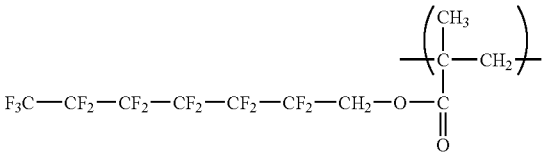

(1-6-14)

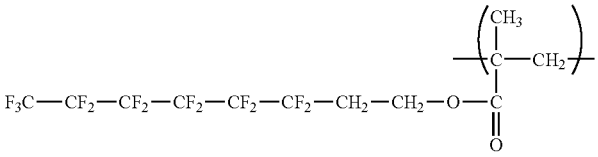

(1-6-15)

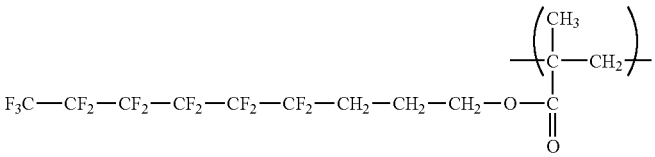

(1-6-16)

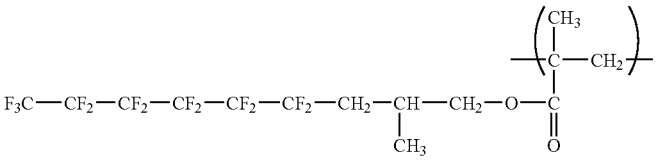

Of those, the repeating structural units represented by the above formulae (1-6-1), (1-6-2), (1-6-6), (1-6-7), (1-6-10) (1-6-14), and (1-6-15) are preferable.

As described above, for obtaining an effect of preventing the blade turn-up, it is important that a polymer having the repeating structural unit represented by the above formula (1) for the present invention be a polymer having at least one of the fluoroalkyl group and the fluoroalkylene group in the repeating structural unit. Further, the polymer having the repeating structural unit represented by the above formula (1) for the present invention contains repeating structural units represented by any one of the above formulae (1-1) to (1-6) in an amount of 70 to 100% by number.

In the case of the repeating structural unit represented by the above formula (1-6), the inventors of the present invention have an opinion that the effects of the present invention can result from lowering of the energy on the surface of the electrophotographic photosensitive member with the fluoroalkyl group and the fluorine-atom-containing resin particles included in the repeating structural unit represented by the above formula (1-6). Further, the energy on the surface of the electrophotographic photosensitive member may be lowered by an improvement in compatibility between the binder resin and the polymer having the repeating structural unit represented by the above formula (1) for the present invention as the fluoroalkyl group is a perfluoroalkyl group having 4 to 6 carbon atoms.

Further, the polymer having the repeating structural unit represented by the above formula (1) for the present invention is preferably formed only of the repeating structural unit represented by the above formula (1-6).

Further, for obtaining an effect of preventing the blade turn-up, any structure with an affinity for the binder resin of the surface layer in addition to the repeating structural unit represented by the above formula (1) may be included in the structure of the polymer having the repeating structural unit represented by the formula (1) for the present invention.

Examples of the structure with a compatibility with the binder resin of the surface layer include polymer units made of repeating structural units of an alkyl acrylate structure, an alkyl methacrylate structure, and a styrene structure. For further enhancing the effects of the present invention, the polymer having the repeating structural unit represented by the above formula (1) for the present invention is preferably a polymer having the repeating structural unit represented by the above formula (1) and a repeating structural unit represented by the following formula (a):

(a)

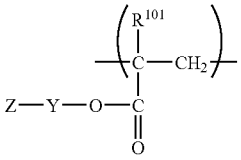

$R^{101}$ in the above formula (a) represents a hydrogen atom or a methyl group.

Y in the above formula (a), which is a divalent organic group and arbitrary as far as it is a divalent organic group is preferably one represented by the following formula (c):

(c)

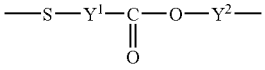

$Y^1$ and $Y^2$ in the above formula (c) each independently represent an alkylene group. Examples of the alkylene group include a methylene group, an ethylene group, a propylene group, a butylene group, a pentylene group, and a hexylene group. Of those, the methylene group, the ethylene group, and the propylene group are preferable. The substituents which those alkylene groups may have include alkyl groups, alkoxyl groups, hydroxyl groups, and aryl groups. The alkyl groups include a methyl group, an ethyl group, a propyl group, and a butyl group. Of those, the methyl group and the ethyl group are preferable. The alkoxyl groups include a methoxy group, an ethoxy group, and a propoxyl group. Of those, the methoxy group is preferable. The aryl groups include a phenyl group and a naphthyl group. Of those, the phenyl group is preferable. Further, of those, the methyl group and the hydroxyl group are more preferable.

Z in the above formula (a) is a polymer unit and its structure is not limited as far as Z is a polymer unit; Z is preferably a polymer unit having a repeating structural unit represented by the following formula (b-1) or the following formula (b-2):

(b-1)

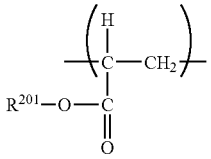

(b-2)

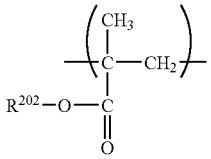

$R^{201}$ in the above formula (b-1) represents an alkyl group. Examples of the alkyl group include a methyl group, an ethyl group, a propyl group, a butyl group, a pentyl group, a hexyl group, a heptyl group, an octyl group, and a nonyl group. Of those, the methyl group, the ethyl group, the propyl group, the butyl group, the pentyl group, and the hexyl group are preferable.

$R^{202}$ in the above formula (b-2) represents an alkyl group. Examples of the alkyl group include a methyl group, an ethyl group, a propyl group, a butyl group, a pentyl group, a hexyl group, a heptyl group, an octyl group, and a nonyl group. Of those, the methyl group, the ethyl group, the propyl group, the butyl group, the pentyl group, and the hexyl group are preferable.

The terminal end of the polymer unit represented by Z in the above formula (a) may use a terminal-end terminating agent or may have a hydrogen atom.

The polymer having the repeating structural unit represented by the above formula (1) for the present invention is preferably of a structure in which both a portion imparting a slidability derived from the fluoroalkyl group or the fluoroalkylene group and a portion having an affinity with the binder resin of the surface layer are included in the compound.

Any configuration of a copolymer of the repeating structural unit represented by the above formula (1) and the repeating structural unit represented by the above formula (a) may be employed. However, for allowing the fluoroalkyl portion or fluoroalkylene portion imparting the slidability to exert their functions more effectively, a comb-type graft structure having a repeating structural unit represented by the above formula (a) on any one of its side chains is more preferable.

In addition, a copolymerization ratio between the repeating structural unit represented by the above formula (1) and the repeating structural unit represented by the above formula (a) is preferably 99:1 to 20:80, more preferably 95:5 to 30:70 in molar ratio for obtaining the effects of the present invention. The copolymerization ratio can be controlled by a molar ratio at the time of polymerizing a compound represented by the above formula (3) corresponding to the repeating structural unit represented by the above formula (1) and a compound represented by the above formula (d) corresponding to the repeating structural unit represented by the above formula (a).

The molecular weight of the polymer having the repeating structural unit represented by the above formula (1) for the present invention is preferably 1,000 to 100,000, more preferably in 5,000 to 50,000 in weight average molecular weight.

The polymer for the present invention, having the repeating structural units each represented by the formula (1) can be synthesized by polymerization of compounds each represented by the following formula (3):

(3)

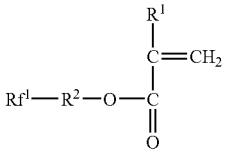

(where $R^1$ represents a hydrogen atom or a methyl group, $R^2$ represents a single bond or a divalent group, and $Rf^1$ represents a monovalent group having at least one of a fluoroalkyl group and a fluoroalkylene group.) Note that 70 to 100% by number of the compounds each represented by the above formula (3) should include compounds each represented by any one of the following formulae (3-1) to (3-6):

(3-1)

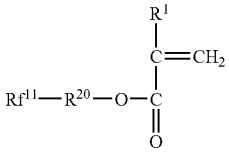

(3-2)

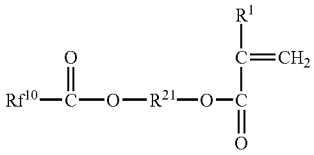

(3-3)

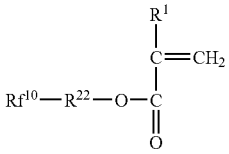

(3-4)

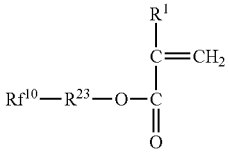

(3-5)

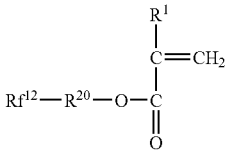

-continued (3-6)

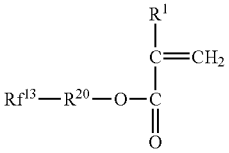

(where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group, or a —O—Ar—R— group (where Ar represents an arylene group and R represents an alkylene group.), $Rf^{10}$ represents a monovalent group having at least a fluoroalkyl group, $Rf^{11}$ represents a fluoroalkyl group having a branched structure with a carbon-carbon bond, $Rf^{12}$ represents a fluoroalkyl group interrupted with oxygen, and $Rf^{13}$ represents a perfluoroalkyl group having 4 to 6 carbon atoms.)

Re: Formula (3)

$R^1$ in the above formula (3) represents a hydrogen atom or a methyl group.

$R^2$ in the above formula (3) represents a single bond or a divalent group. The divalent group may be preferably one having at least an alkylene group or an arylene group in its structure. Examples of the alkylene group include: linear alkylene groups such as a methylene group, an ethylene group, a propylene group, a butylene group, a pentylene group, and a hexylene group; and branched alkylene groups such as an isopropylene group and an isobutylene group. Of those, the methylene group, the ethylene group, the propylene group, and the butylene group are preferable. Examples of the arylene group include a phenylene group, a naphthylene group, and a biphenylene group. Of those, the phenylene group is preferable.

In the above formula (3), $Rf^1$ represents a monovalent group having at least one of a fluoroalkyl group and a fluoroalkylene group. Examples of the fluoroalkyl group include the following:

(CF-1)

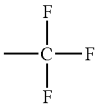

(CF-2)

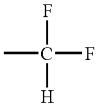

(CF-3)

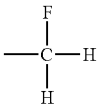

Examples of the fluoroalkylene group include the following:

(CF-4)

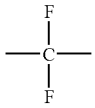

(CF-5)

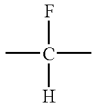

Re: Formula (3-1)

$R^1$ in the above formula (3-1) represents a hydrogen atom or a methyl group.

$R^{20}$ in the above formula (3-1) represents a single bond or an alkylene group. Examples of the alkylene group include linear alkylene groups such as a methylene group, an ethylene group, a propylene group, a butylene group, a pentylene group, and a hexylene group.

Of those, the methylene group, the ethylene group, the propylene group, and the butylene group are preferable.

$Rf^{11}$ in the above formula (3-1) represents a fluoroalkyl group having a branched structure with a carbon-carbon bond. The branched structure with a carbon-carbon bond represents a structure in which the longest bonding chain and side chains thereof are bonded with each other by carbon-carbon bonds. In addition, part or the whole of the longest bonding chain and/or the side chains may be substituted with fluorine.

Specific examples of $Rf^{11}$ in the above formula (3-1) include groups represented by the above formulae (Rf11-1) to (Rf11-18).

Specific examples of the compound represented by the above formula (3-1) are shown below.

(3-1-1)

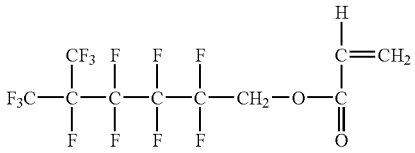

(3-1-2)

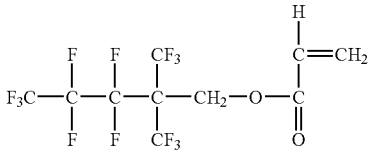

(3-1-3)

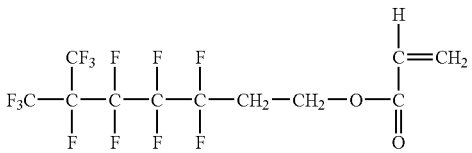

-continued (3-1-4)

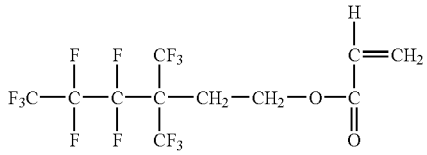

(3-1-5)

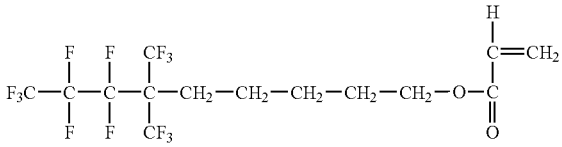

(3-1-6)

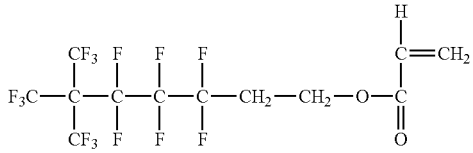

(3-1-7)

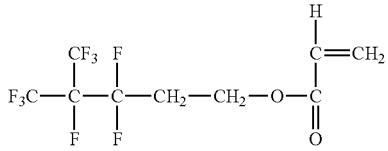

(3-1-8)

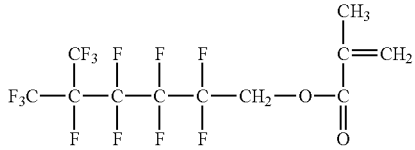

(3-1-9)

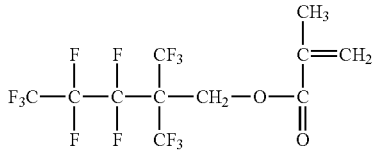

(3-1-10)

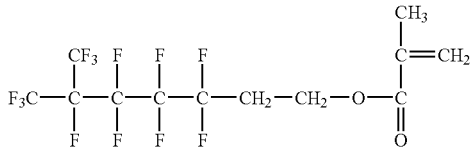

(3-1-11)

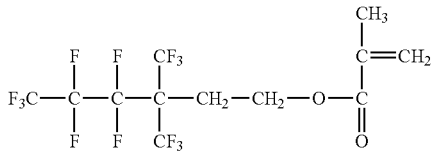

(3-1-12)

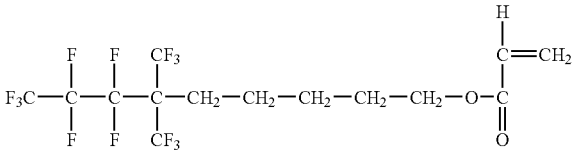

-continued (3-1-13)

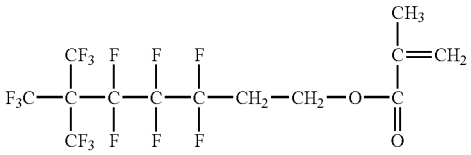

(3-1-14)

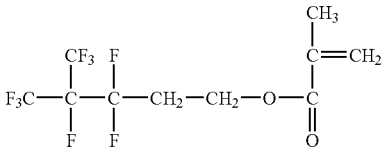

Of those, compounds represented by the above formulae (3-1-3), (3-1-4), (3-1-6), (3-1-7), (3-1-10), (3-1-11), (3-1-13), and (3-1-14) are preferable.

Re: Formula (3-2)

$R^1$ in the above formula (3-2) represents a hydrogen atom or a methyl group.

$R^{21}$ in the above formula (3-2) represents an alkylene group having a branched structure with a carbon-carbon bond. The branched structure with a carbon-carbon bond represents a structure in which the longest bonding chain and the side chains thereof are bonded by carbon-carbon bonds. The longest bonding chain is preferably formed of 2 to 6 carbon atoms. In addition, each of the side chains may be an alkyl group, a fluoroalkyl group, or the like. The alkyl group may be a methyl group, an ethyl group, a propyl group, or a butyl group.

Of those, the methyl group and the ethyl group are preferable. The fluoroalkyl group may be, for example, any of the groups represented by the above formulae (CF-1) to (CF-3). Of those, the group represented by the above formula (CF-1) is preferable. $Rf^{10}$ in the above formula (3-2) represents a monovalent group with at least a fluoroalkyl group. Examples of the fluoroalkyl group include the groups represented by the above formulae (CF-1) to (CF-3). In addition, $Rf^{10}$ is not limited to a linear structure but may be of a branched structure. Alternatively, $Rf^{10}$ may be a fluoroalkyl group interrupted with an oxygen atom.

Specific examples of $Rf^{10}$ in the above formula (3-2) include groups represented by the above formulae (Rf10-1) to (Rf10-36).

Specific examples of the compound represented by the above formula (3-2) are shown below.

(3-2-1)

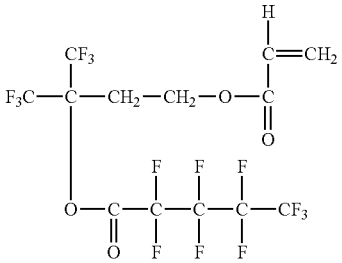

-continued (3-2-2)

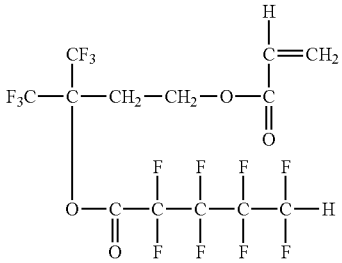

(3-2-3)

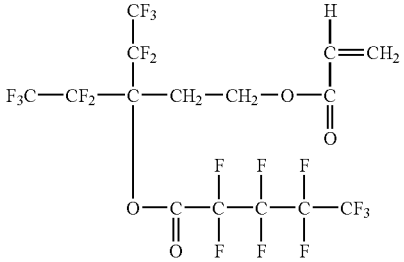

(3-2-4)

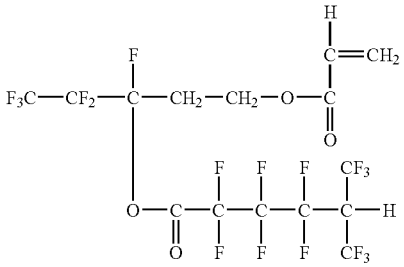

(3-2-5)

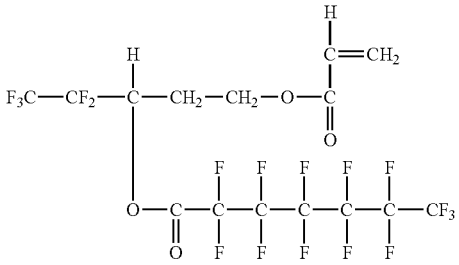

(3-2-6)

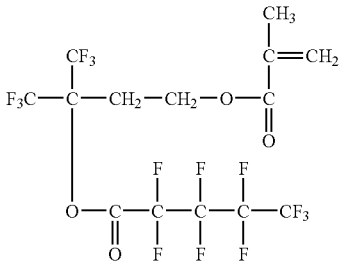

(3-2-7)

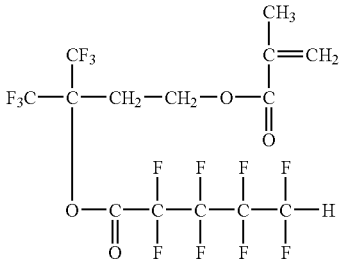

Of those, compounds represented by the above formulae (3-2-1) and (3-2-2) are preferable.

Re: Formula (3-3)

$R^1$ in the above formula (3-3) represents a hydrogen atom or a methyl group.

$R^{22}$ in the above formula (3-3) represents a —$R^{21}$— group or a —O—$R^{21}$— group. To be specific, the —$R^{21}$— group represents an alkylene group having a branched structure with a carbon-carbon bond. The branched structure with a carbon-carbon bond represents a structure in which the longest bonding chain and the side chains thereof are bonded by carbon-carbon bonds. The longest bonding chain is preferably formed of 2 to 6 carbon atoms. In addition, each of the side chains may be an alkyl group or a fluoroalkyl group. The alkyl group may be, for example, a methyl group, an ethyl group, a propyl group, or a butyl group. Of those, the methyl group and the ethyl group are preferable. The fluoroalkyl group may be, for example, a group represented by any of the above formulae (CF-1) to (CF-3).

Of those, the group represented by the above formula (CF-1) is preferable. Further, the —O—$R^{21}$— group represents a structure in which the alkylene group having a branched structure with a carbon-carbon bond is bonded to $Rf^{10}$ through an oxygen atom.

$Rf^{10}$ in the above formula (3-3) represents a monovalent group with at least a fluoroalkyl group. The fluoroalkyl group may be, for example, a group represented by any of the above formulae (CF-1) to (CF-3). Further, $Rf^{10}$ is not limited to a linear structure but may be of a branched structure. Alternatively, $Rf^{10}$ may be a fluoroalkyl group interrupted with an oxygen atom.

Specific examples of $Rf^{10}$ in the above formula (3-3) include groups represented by the above formulae (Rf10-1) to (Rf10-36).

Specific examples of the repeating structural unit represented by the above formula (3-3) include the following:

(3-3-1)

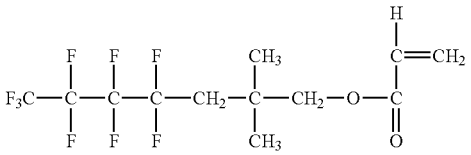

(3-3-2)

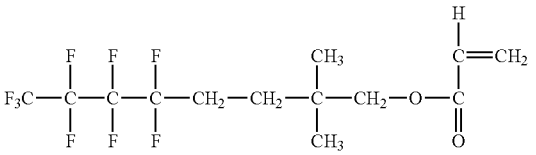

(3-3-3)

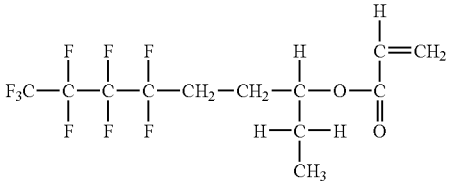

(3-3-4)

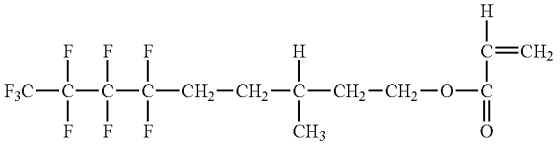

(3-3-5)

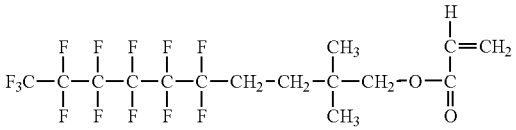

(3-3-6)

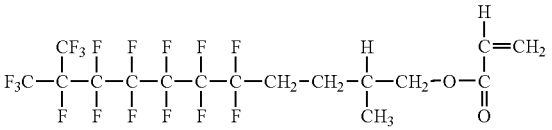

(3-3-7)

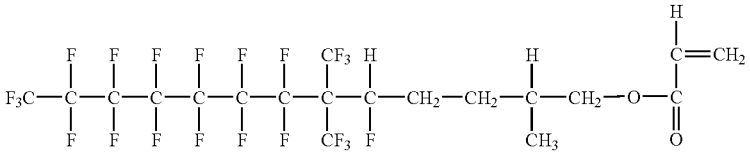

(3-3-8)

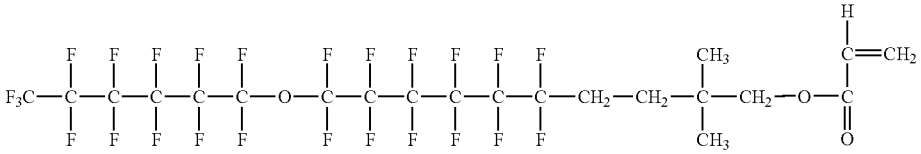

(3-3-9)

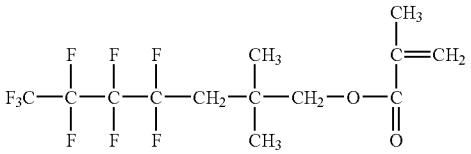

(3-3-10)

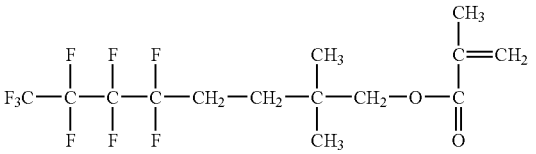

-continued (3-3-11)

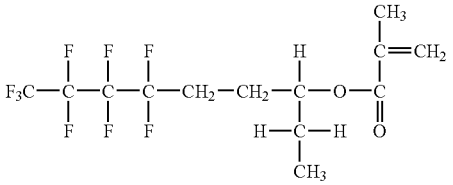

(3-3-12)

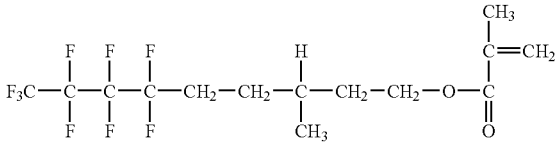

(3-3-13)

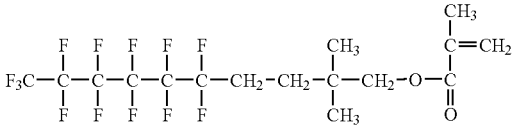

(3-3-14)

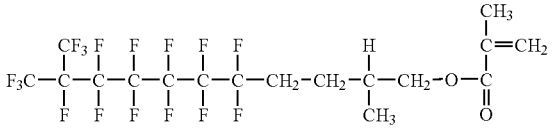

(3-3-15)

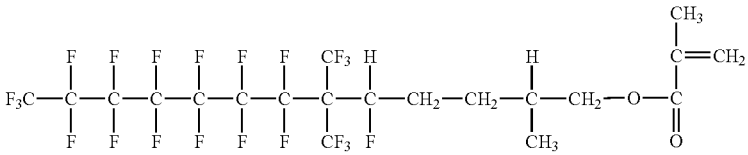

(3-3-16)

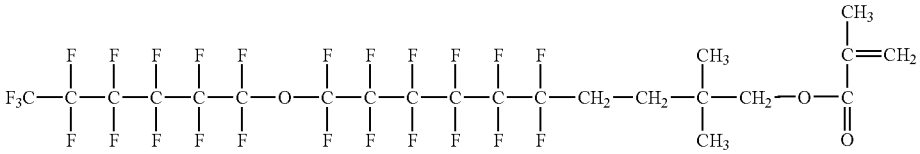

Of those, compounds represented by the above formulae (3-3-1), (3-3-2), (3-3-3), (3-3-4), (3-3-6), (3-3-9), (3-3-10), (3-3-11), (3-3-12), and (3-3-14) are preferable.

Re: Formula (3-4)

$R^1$ in the above formula (3-4) represents a hydrogen atom or a methyl group.

$R^{23}$ in the above formula (3-4) represent a —Ar— group, a —O—Ar— group, or a —O—Ar—R— group (Ar represents an arylene group and R represents an alkylene group). Examples of the arylene group of Ar include a phenylene group, a naphthylene group, and a biphenylene group. Of those, the phenylene group is preferable. Examples of the alkylene group of R include: linear alkylene groups such as a methylene group, an ethylene group, a propylene group, a butylene group, a pentylene group, and a hexylene group; and branched alkylene groups such as an isopropylene group and an isobutylene group. Of those, the methylene group, the ethylene group, the propylene group, and the butylene group are preferable. The —O—Ar— group or the —O—Ar—R— group represents a structure to be bonded to $Rf^{10}$ through an oxygen atom. $Rf^{10}$ in the above formula (3-4) represents a monovalent group with at least a fluoroalkyl group. The fluoroalkyl group may be, for example, a group represented by any of the above formulae (CF-1) to (CF-3). Further, $Rf^{10}$ is not limited to a linear structure but may be of a branched structure. Alternatively, $Rf^{10}$ may be a fluoroalkyl group interrupted with an oxygen atom.

Specific examples of $Rf^{10}$ in the above formula (3-4 include those represented by the above formulae (Rf10-1) to (Rf10-36).

Specific examples of the compound represented by the above formula (3-4) include the following:

(3-4-1)

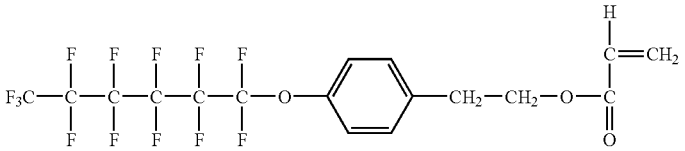

(3-4-2)

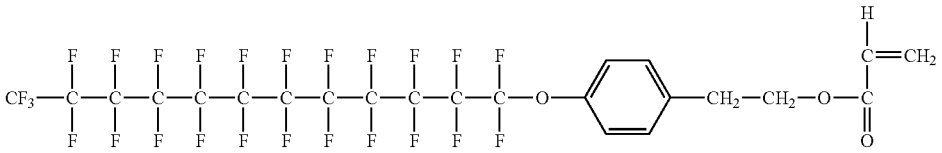

-continued
(3-4-3)
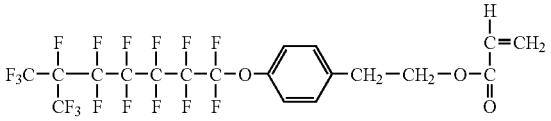
(3-4-4)
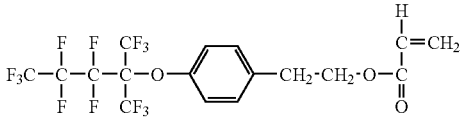
(3-4-5)
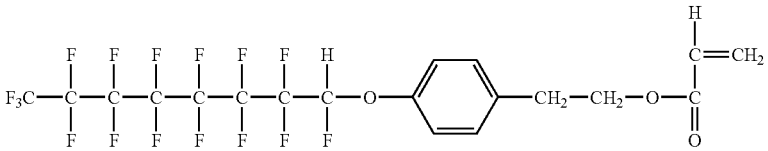
(3-4-6)
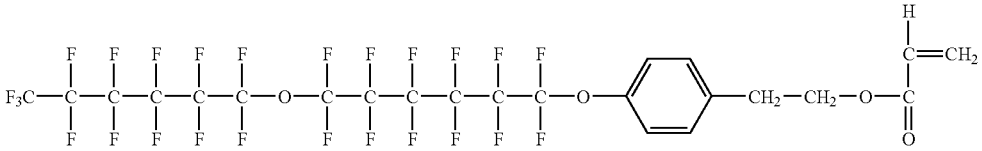
(3-4-7)
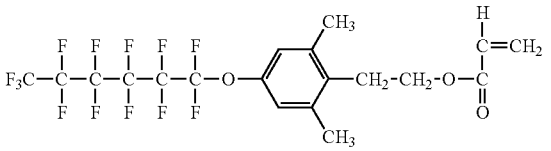
(3-4-8)
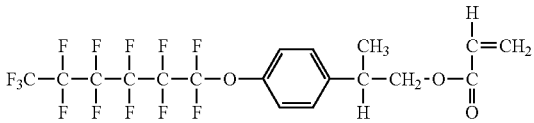
(3-4-9)
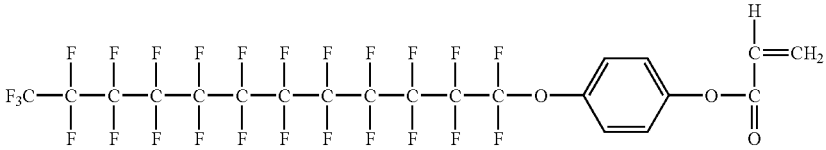
(3-4-10)
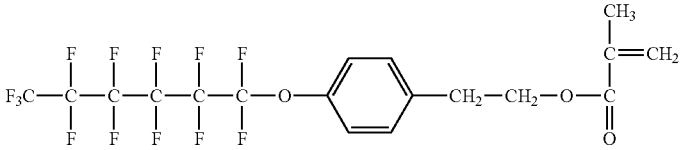
(3-4-11)
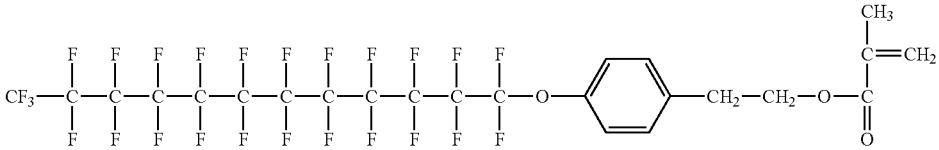
(3-4-12)
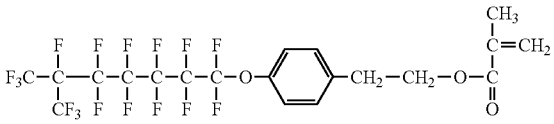
(3-4-13)
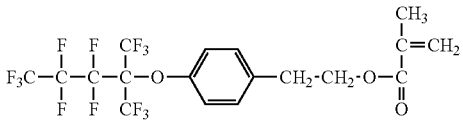
(3-4-14)
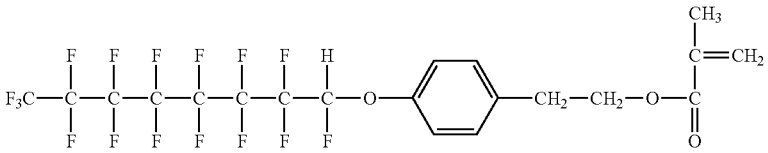
(3-4-15)
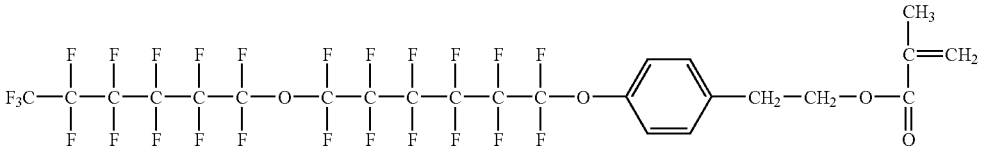

-continued (3-4-16)

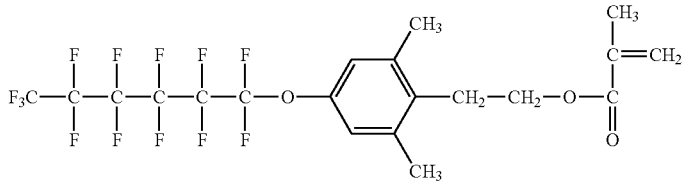

(3-4-17)

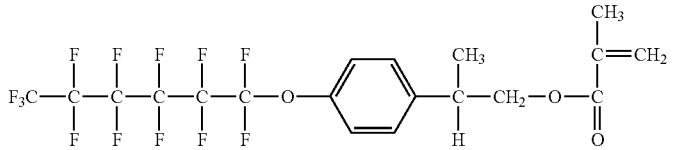

(3-4-18)

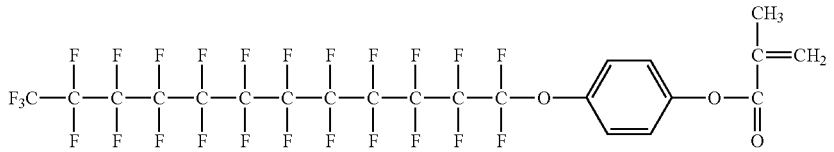

Of those, compounds represented by the above formulae (3-4-1), (3-4-6), (3-4-7), (3-4-8), (3-4-10), (3-4-15), (3-4-16), and (3-4-17) are preferable.

Re: Formula (3-5)

$R^1$ in the above formula (3-5) represents a hydrogen atom or a methyl group.

$R^{20}$ in the above formula (3-5) represents a single bond or an alkylene group. Examples of the alkylene group include linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{12}$ in the above formula (3-5) represents a fluoroalkyl group interrupted with oxygen. The fluoroalkyl group interrupted with oxygen represents that at least one oxygen atom is included in the longest bonding chain. Alternatively, a fluoroalkyl group or a fluoroalkylene group may be present on both sides or one side of the oxygen atom.

Specific examples of $Rf^{12}$ in the above formula (3-5) include groups represented by the above formulae (Rf12-1) to (Rf12-17).

Specific examples of the compound represented by the above formula (3-5) are shown below.

(3-5-1)

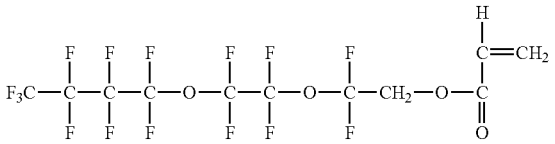

(3-5-2)

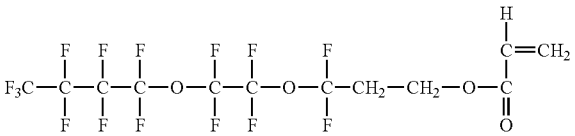

-continued (3-5-3)

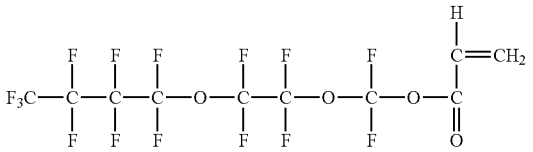

(3-5-4)

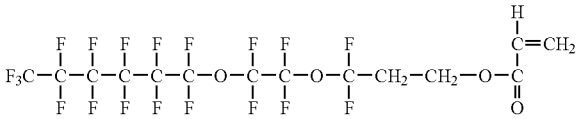

(3-5-5)

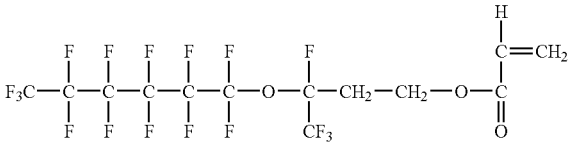

(3-5-6)

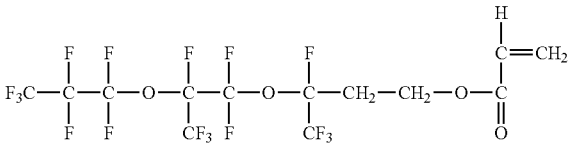

(3-5-7)

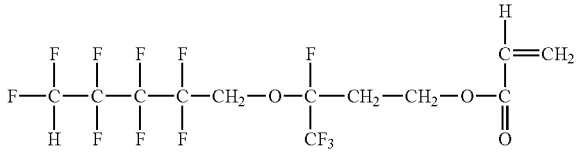

-continued (3-5-8)

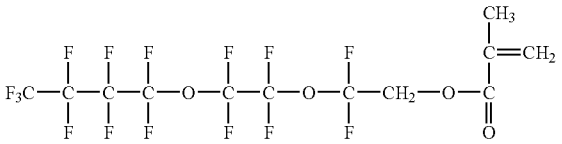

(3-5-9)

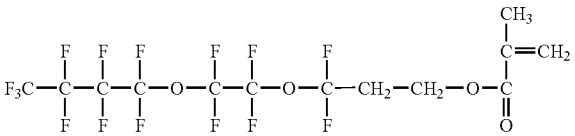

(3-5-10)

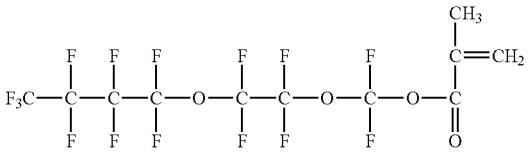

(3-5-11)

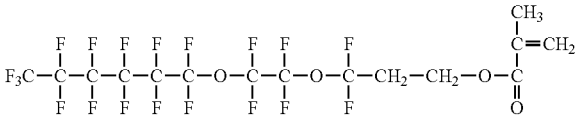

(3-5-12)

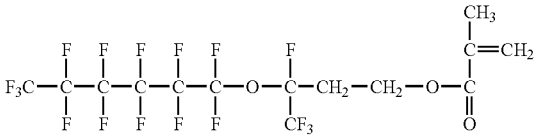

(3-5-13)

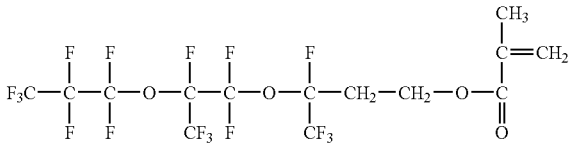

(3-5-14)

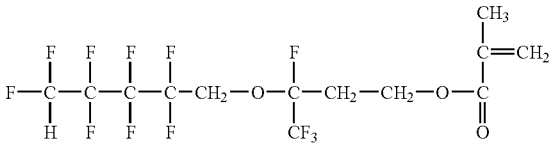

Of those, compounds represented by the above formulae (3-5-2), (3-5-4), (3-5-5), (3-5-6), (3-5-8), (3-5-11), (3-5-12), and (3-5-13) are preferable.

Re: Formula (3-6)

$R^1$ in the above formula (3-6) represents a hydrogen atom or a methyl group.

$R^{20}$ in the above formula (3-6) represents a single bond or an alkylene group. Examples of the alkylene group include: linear alkylene groups such as a methylene group, an ethylene group, a propylene group, a butylene group, a pentylene group, and a hexylene group. Of those, the methylene group, the ethylene group, the propylene group, and the butylene group are preferable.

$Rf^{13}$ in the above formula (3-6) represents a perfluoroalkyl group with 4 to 6 carbon atoms.

Specific examples of $Rf^{13}$ in the above formula (3-6) include groups represented by the above formulae (Rf13-1) to (Rf13-3).

Specific examples of the compound represented by the above formula (3-6) are shown below.

(3-6-1)

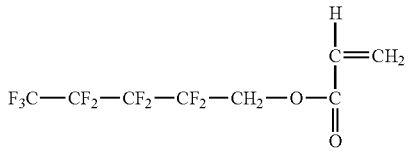

(3-6-2)

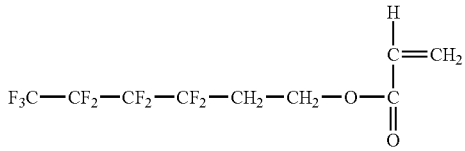

(3-6-3)

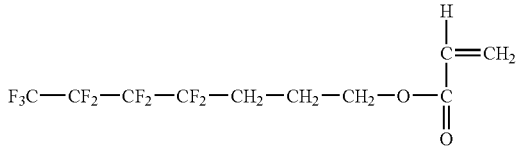

(3-6-4)

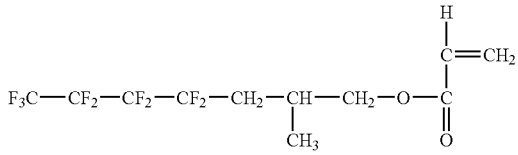

(3-6-5)

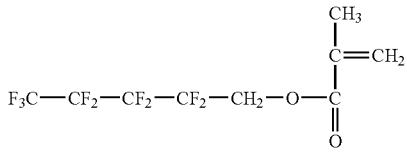

(3-6-6)

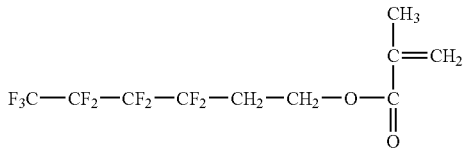

(3-6-7)

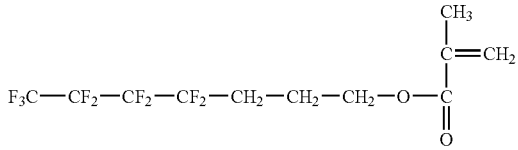

(3-6-8)

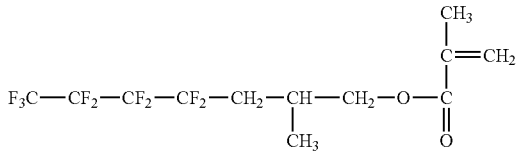

-continued (3-6-9)

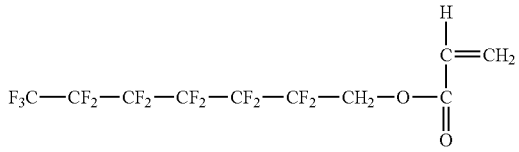

(3-6-10)

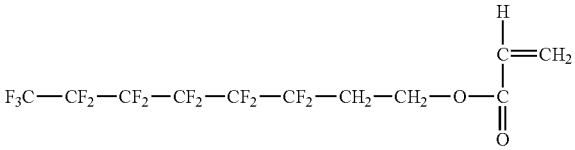

(3-6-11)

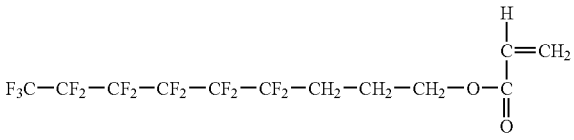

(3-6-12)

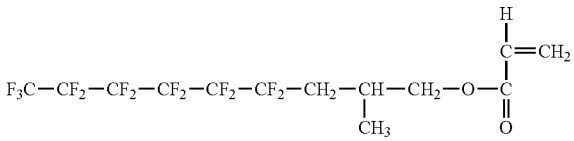

(3-6-13)

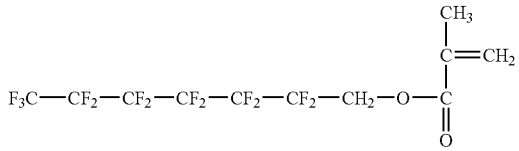

(3-6-14)

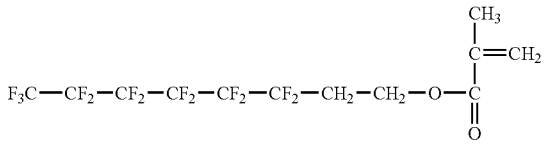

(3-6-15)

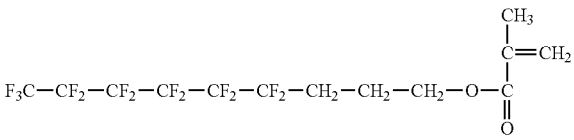

(3-6-16)

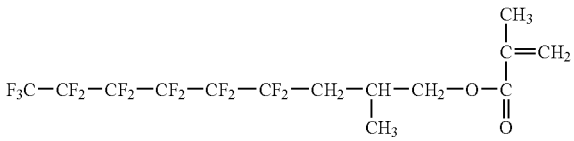

Of those, compounds represented by the above formulae (36-1), (3-6-2), (3-6-6), (3-6-7), (3-6-10), (3-6-11), (3-6-14), and (3-6-15) are preferable.

The compound represented by the above formula (3) can be produced by a combination of production methods well known in the art.

A method of producing a compound represented by the above formula (3) will be exemplified.

According to the method disclosed in Japanese Patent Application Laid-Open No. 2005-054020, an iodinated material of a fluoroalkyl group ($Rf^1$ group) is used as a starting material, whereby a compound represented by the above formula (3) where $R^1$ is H, and $R^2$ is $CH_2$—$CH_2$ is obtained.

Alternatively, any compound represented by the above formula (3) can be obtained with reference to any of the other production methods disclosed in, for example, Japanese Patent Application Laid-Open No. 2001-302571 and Japanese Patent Application Laid-Open No. 2001-199953.

(3)

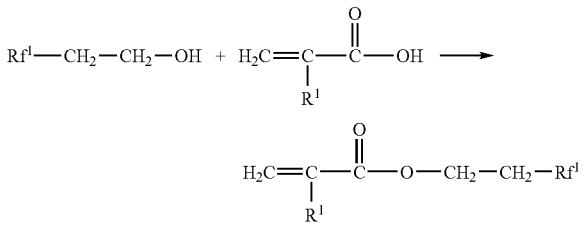

(In the above formula, $R^1$ represents $R^1$ in the formula (3) and $Rf^1$ represents $Rf^1$ in the formula (3)).

Further, the compound represented by the above formula (3-2) has a plurality of ester structures. Therefore, on this account, a by-product material or a residual compound remaining after the polymerization of compounds represented by the above formula (3-2) can be easily removed by washing the resulting polymer with water or alcohol. As a result, the compound having the repeating structural unit represented by the above formula (1-2) can be obtained at high purity. The acquisition of the compound at high purity may also contribute to the maintenance of electrophotographic properties in a favorable condition.

The compound having the repeating structural units each represented by the above formula (a) is synthesized by the polymerization of compounds each represented by the following formula (d):

(d)

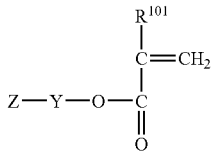

(where $R^{101}$ represents a hydrogen atom or a methyl group, Y represents a divalent organic group, and Z represents a polymer unit).

$R^{101}$ in the above formula (d) represents a hydrogen atom or a methyl group.

Y in the above formula (d), which is a divalent organic group and arbitrary as far as it is a divalent organic group, is preferably one represented by the following formula (c):

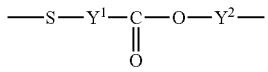

(c)

$Y^1$ and $Y^2$ in the above formula (c) each independently represent an alkylene group. Examples of the alkylene group include a methylene group, an ethylene group, a propylene group, a butylene group, a pentylene group, and a hexylene group. Of those, the methylene group, the ethylene group, and the propylene group are preferable. The substituents which those alkylene groups may have include alkyl groups, alkoxyl groups, hydroxyl groups, and aryl groups. The alkyl groups include a methyl group, an ethyl group, a propyl group, and a butyl group. Of those, the methyl group and the ethyl group are preferable. The alkoxyl groups include a methoxy group, an ethoxy group, and a propoxyl group. Of those, the methoxy group is preferable. The aryl groups include a phenyl group and a naphthyl group. Of those, the phenyl group is preferable. Further, of those, the methyl group and the hydroxyl group are more preferable.

Z in the above formula (d) is a polymer unit and its structure is not limited as far as Z is a polymer unit; Z is preferably a polymer unit having a repeating structural unit represented by the following formula (b-1) or the following formula (b-2):

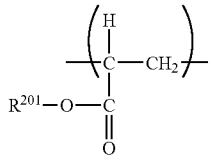

(b-1)

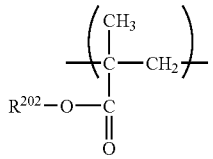

(b-2)

$R^{201}$ in the above formula (b-1) represents an alkyl group. Examples of the alkyl group include a methyl group, an ethyl group, a propyl group, a butyl group, a pentyl group, a hexyl group, a heptyl group, an octyl group, and a nonyl group. Of those, the methyl group, the ethyl group, the propyl group, the butyl group, the pentyl group, and the hexyl group are preferable.

$R^{202}$ in the above formula (b-2) represents an alkyl group. Examples of the alkyl group include a methyl group, an ethyl group, a propyl group, a butyl group, a pentyl group, a hexyl group, a heptyl group, an octyl group, and a nonyl group. Of those, the methyl group, the ethyl group, the propyl group, the butyl group, the pentyl group, and the hexyl group are preferable.

The terminal end of the polymer unit represented by Z in the above formula (d) may use a terminal-end terminating agent or may have a hydrogen atom.

The polymer having the repeating structural unit represented by the above formula (1) for the present invention can be produced by the polymerization of compounds represented by the above formula (3). Further, the polymer having both the repeating structural unit represented by the above formula (1) and the repeating structural unit represented by the above formula (a) can be produced by copolymerizing the compound represented by the above formula (3) with the compound represented by the above formula (d) according to the procedures disclosed in, for example, Japanese Patent Application Laid-Open No. S58-164656.

Hereinafter, an example of the method of producing the compound represented by the above formula (d) will be described. In the following formula, there is exemplified a compound with the structure represented by the above formula (d) where $R^{101}$ is a methyl group, Y is a divalent organic group having the structure represented by the above formula (c), and Z is a polymer unit represented by the above formula (b-2). Further, in the above formula (c), $Y^1$ is a methylene group and $Y^2$ is a propylene group having a hydroxyl group.

(Step 1)

To an alkyl acrylate monomer or an alkyl methacrylate monomer, which can be provided as a raw material for a polymer having a repeating structural unit represented by the above formula (b-1) or the above formula (b-2), is added a chain transfer agent in an amount of several mass % in monomer ratio, whereby the polymerization of the monomer is carried out. Consequently, an alkyl acrylate polymer or an alkyl methacrylate polymer having a terminal end coupled with the chain transfer agent is obtained. The chain transfer agent may be any of carboxylic acids with a mercapto group such as thioglycolic acid, 3-mercapto propionic acid, 2-mercapto propionic acid, and 4-mercapto-n-butanoic acid.

(Step 2)

The alkyl acrylate polymer or alkyl methacrylate polymer is reacted with a monomer (in the following formula, glycidyl methacrylate) that provides a functional group for bonding to the polymer and forms a main chain in the subsequent reaction with the functional group to the functional group being reacted with each other. Consequently, a compound represented by the above formula (d) is obtained. The above glycidyl methacrylate has a polymerizable functional group and a functional group (epoxy moiety) which can bind to a carboxyl group in the chain transfer agent. The monomer is not limited to glycidyl methacrylate as far as it is a monomer of similar functional-group configuration.

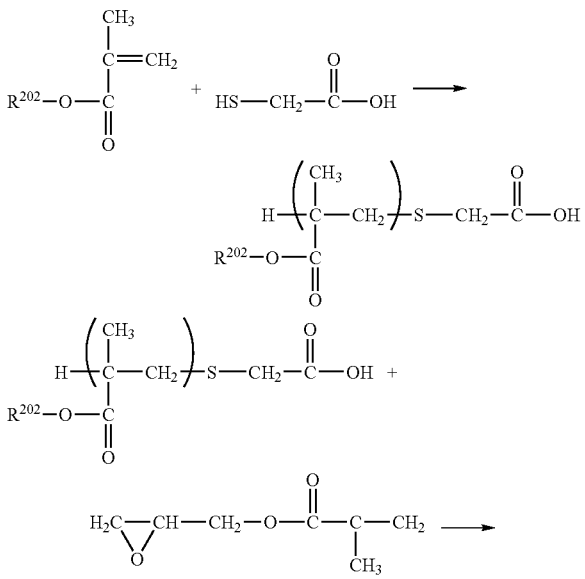

-continued

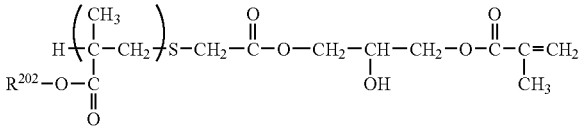

($R^{202}$ in the formula represents an alkyl group)

The copolymer of the repeating structural unit represented by the above formula (1) and the repeating structural unit represented by the above formula (a) can be produced according to the procedure disclosed in Japanese patent Application Laid-Open No. 58-164656 using the compound represented by the above formula (3) and the compound represented by the above formula (d). In this way, a compound having a portion with a fluoroalkyl group or a fluoroalkylene group contributing to an improvement in slidability between the surface of an electrophotographic photosensitive member and a cleaning blade and a portion with an affinity for a binder resin in the surface layer can be obtained.

The polymer having a repeating structural unit represented by the above formula (1) for the present invention has insufficient functions as a photoconductive substance and a binder resin of the surface layer. Thus, the polymer as a constituent component of the surface layer is preferably used in as small an amount as possible. In addition, the blade turn-up may occur at high frequency at an early stage immediately after the setting of an electrophotographic apparatus, or before the accumulation of transfer residual toner on the contact boundary surface between the cleaning blade and the electrophotographic photosensitive member. When the material of the cleaning blade is an elastic rubber material, there is a tendency of further increasing the occurrence frequency of blade turn-up under a high-temperature, high-humidity environment. Therefore, it is preferable to allow a sufficient amount of a compound having a repeating structural unit represented by the above formula (1) for the present invention to be located adjacent to the surface of the surface layer of the electrophotographic photosensitive member. From such a viewpoint, a polymer having a repeating structural unit represented by the above formula (1) for the present invention with a portion having a fluoroalkyl group or a fluoroalkylene group, which is movable to the surface of the surface layer of the electrophotographic photosensitive member, is preferably incorporated in the surface layer.

The structure of the fluoroalkyl group of the repeating structural unit represented by the above formula (1-1) is not a linear chain but a branched structure. In the case of the polymer having the repeating structural unit represented by the above formula (1) for the present invention, which includes the repeating structural unit represented by the above formula (1-1), micelles of the polymer having the repeating structural unit represented by the above formula (1) for the present invention are hardly formed in a solution or a dispersion liquid. Therefore, the liquid composition in the solution or the dispersion liquid can be uniformed. In addition, a small amount of ionic impurities is hardly mixed, so that this fact may contribute to improvements in characteristics and keep electrophotographic properties in a favorable condition.

The structure of the repeating structural unit represented by the above formula (1-2) is a branched structure. In the case of the polymer having the repeating structural unit represented by the above formula (1) for the present invention, which includes the repeating structural unit represented by the above formula (1-2), micelles of the compound having the repeating structural unit represented by the above formula (1) are hardly formed in a solution or a dispersion liquid. Therefore, the liquid composition in the solution or the dispersion liquid can be uniformed. In addition, a small amount of ionic impurities is hardly mixed, so that this fact may contribute to improvements in characteristics and keep electrophotographic properties in a favorable condition.

The structure of the repeating structural unit represented by the above formula (1-3) is a branched structure. In the case of the polymer having the repeating structural unit represented by the above formula (1) for the present invention, which includes the repeating structural unit represented by the above formula (1-3), micelles of the compound having the repeating structural unit represented by the above formula (1) are hardly formed in a solution or dispersion liquid. Therefore, the liquid composition in the solution or the dispersion liquid can be uniformed. In addition, a small amount of ionic impurities is hardly mixed, so that this fact may contribute to improvements in characteristics and keep electrophotographic properties in a favorable condition.

The structure of the repeating structural unit represented by the above formula (1-4) is a structure containing an arylene group. In the case of the polymer having the repeating structural unit represented by the above formula (1) for the present invention, which includes the repeating structural unit represented by the above formula (1-4), micelles of the compound having the repeating structural unit represented by the above formula (1) are hardly formed in a solution or dispersion liquid. Therefore, the liquid composition in the solution or the dispersion liquid can be uniformed. In addition, a small amount of ionic impurities is hardly mixed, so that this fact may contribute to improvements in characteristics and keep electrophotographic properties in a favorable condition.

The structure of the repeating structural unit represented by the above formula (1-5) is a structure containing a fluoroalkyl group interrupted with oxygen. In the case of the polymer having the repeating structural unit represented by the above formula (1) for the present invention, which includes the repeating structural unit represented by the above formula (1-5), micelles of the compound having the repeating structural unit represented by the above formula (1) are hardly formed in a solution or a dispersion liquid. Therefore, the liquid composition in the solution or the dispersion liquid can be uniformed. In addition, a small amount of ionic impurities is hardly mixed, so that this fact may contribute to improvements in characteristics and keep electrophotographic properties in a favorable condition.

The structure of the repeating structural unit represented by the above formula (1-6) is a structure containing a perfluoroalkyl group with 4 to 6 carbon atoms. In the case of the polymer having the repeating structural unit represented by the above formula (1) for the present invention, which includes the repeating structural unit represented by the above formula (1-6), micelles of the compound having the repeating structural unit represented by the above formula (1) are hardly formed in a solution or a dispersion liquid. Therefore, the liquid composition in the solution or the dispersion liquid can be uniformed. In addition, a small amount of ionic impurities is hardly mixed, so that this fact may contribute to improvements in characteristics and keep electrophotographic properties in a favorable condition.

Next, the configuration of the electrophotographic photosensitive member of the present invention will be described.

As an example of the electrophotographic photosensitive member of the present invention, as shown in FIG. 1A to FIG. 1E, an electrophotographic photosensitive member having an intermediate layer 103 and a photosensitive layer 104 on a support 101 in this order can be exemplified (see FIG. 1A).

In addition, for example, between the support 101 and the intermediate layer 103 may be provided a conductive layer 102 which is formed by dispersing conductive particles in a resin and whose volume resistance is made smaller and thickness is made greater. The layer 102 can be used as a layer for covering defects in the surface of the conductive support 101 or the non-conductive support 101 (for example, resin support) (see FIG. 1B).

A photosensitive layer 104 may be a monolayer type photosensitive layer 104 containing a charge-transporting substance and a charge-generating substance in the same layer (see FIG. 1A). Further, the photosensitive layer 104 may be a multilayer type (separate function type) photosensitive layer composed of a charge-generating layer 1041 containing a charge-generating substance and a charge-transporting layer 1042 containing a charge-transporting substance separately. The multilayer type photosensitive layer is preferred in view of electrophotographic properties. In the case of a monolayer type photosensitive layer, the surface layer of the present invention is the photosensitive layer 104. In addition, there are two kinds of the multilayer type photosensitive layer. One is a normal-layer type photosensitive layer in which the charge-generating layer 1041 and the charge-transporting layer 1042 are laminated on the support 101 in the named order from the support 101 (see FIG. 1C). The other is a reverse-layer type photosensitive layer in which the charge-transporting layer 1042 and the charge-generating layer 1041 are laminated on the support 101 in the order from the support 101 (see FIG. 1D). From a viewpoint of electrophotographic properties, the normal-type photosensitive layer is preferred. Of the multilayer type photosensitive layers, in the case of the normal-layer type photosensitive layer, the surface layer of the electrophotographic photosensitive member is a charge-transporting layer. In the case of the reverse-layer type photosensitive layer, the surface layer is a charge-generating layer (but when a protective layer is not provided).

Figure 1E:
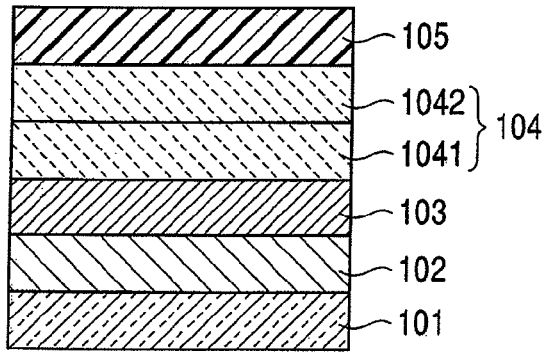
Figure 1C:
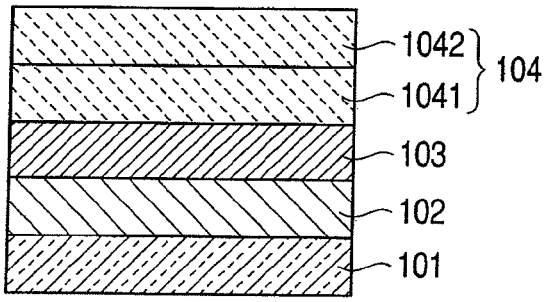

In addition, a protective layer 105 may be formed on the photosensitive layer 104 (charge-generating layer 1041 and charge-transporting layer 1042) (see FIG. 1E). In the case where the electrophotographic photosensitive member has the protective layer 105, the surface layer of the electrophotographic photosensitive member is the protective layer 105.

The support 101 is preferably conductive (conductive support) and may be one made of a metal such as aluminum, an aluminum alloy, or stainless steel. In the case of aluminum or an aluminum alloy, the support 101 used may be an ED tube or an EI tube or one obtained by subjecting the ED tube or the EI tube to cutting, electrolytic complex polish (electrolysis with an electrode having an electrolytic action and an electrolytic solution, and polishing with a whetstone having polishing actions), or a wet- or dry-honing process. Also, the above metal-made support having a layer formed by film-formation with vacuum deposition of aluminum, an aluminum alloy, or an indium oxide-tin oxide alloy may be used. In addition, a resin-made support (polyethylene terephthalate, polybutylene terephthalate, a phenol resin, polypropylene, or a polystyrene resin) having a layer formed by film-formation with vacuum deposition may be used. Alternatively, a support prepared by impregnating conductive particles such as carbon black, tin oxide particles, titanium oxide particles, and silver particles into a resin or paper may be used, or a plastic having a conductive binder resin may be used.

As to the volume resistivity of the support, when the surface of the support is a layer provided for imparting the conductivity to the support, the volume resistibility of the layer is preferably $1\times10^{10}\Omega\cdot$cm or less, more preferably $1\times10^{6}\Omega\cdot$cm or less.

A conductive layer may be formed on the support for the purpose of covering defects in the surface of the support. The conductive layer is a layer formed by applying a coating solution prepared by dispersing conductive particles in a suitable binder resin on the support.

Such conductive powders include: carbon black; acetylene black; metal powders made of, for example, aluminum, nickel, iron, nichrome, copper, zinc, and silver; and metal oxide powders made of, for example, conductive tin oxide and ITO.

In addition, a binder resin simultaneously used with the conductive powders may be any of the following thermoplastic resins, thermosetting resins, and photocurable resins.

Polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, a polyarylate resin, a phenoxy resin, polycarbonate, a cellulose acetate resin, an ethylcellulose resin, polyvinyl butyral, polyvinyl formal, polyvinyl toluene, poly-N-vinyl carbazole, an acryl resin, a silicone resin, an epoxy resin, a melamine resin, a urethane resin, a phenol resin, and an alkyd resin.

The conductive layer can be formed by dispersing or dissolving the above conductive powders and the binder resin into an organic solvent, followed by coating. Examples of the organic solvent include: ether-based solvents (e.g., tetrahydrofuran, ethylene glycol dimethyl ether); alcohol-based solvents (e.g., methanol); ketone-based solvents (e.g., methyl ethyl ketone); and aromatic hydrocarbon solvents (e.g., toluene).

The film thickness of the conductive layer is preferably 5 to 40 μm, more preferably 10 to 30 μm.

An intermediate layer having a barrier function may be provided on the support or the conductive layer.

The intermediate layer can be formed in such a manner that a hardening resin is applied and then hardened to form a resin layer. Alternatively, the intermediate layer can be formed in such a manner that an intermediate-layer coating solution containing a binder resin is applied on a conductive layer and then dried to form such a layer.

Examples of the binder resin in the intermediate layer include the following resins: Water-soluble resins including polyvinyl alcohol, polyvinyl methyl ether, polyacrylic acids, methylcellulose, ethylcellulose, polyglutamic acid, and casein; a polyamide resin, a polyimide resin, a polyamide imide resin, a polyamic acid resin, a melamine resin, an epoxy resin, a polyurethane resin, and a polyglutamate resin.

For effectively expressing the electric barrier property of the intermediate layer and from the viewpoint of coating characteristics, adhesiveness, solvent resistance, and electrical resistance, the binder resin in the intermediate layer is preferably a thermoplastic resin. To be specific, a thermoplastic polyamide resin is preferable. The polyamide resin is preferably copolymer nylon with low crystallity or non-crystalline copolymer nylon which can be applied in a solution state.

The film thickness of the intermediate layer is preferably 0.1 to 2.0 μm.

In addition, semiconductive particles may be dispersed in or an electron-transporting substance (electron-accepting substance such as an acceptor) may be added to the intermediate layer to prevent the flow of charges (carriers) from being disrupted in the intermediate layer.

A photosensitive layer is formed on the support, the conductive layer, or the intermediate layer.

Examples of the charge-generating substance used in the electrophotographic photosensitive member of the present invention include the following: Azo pigments such as monoazo, disazo, and tris azo; phthalocyanine pigments such as metallophthalocyanine and metalloid phthalocyanine; indigo pigments such as indigo and thioindigo; perylene pigments such as perylene acid anhydride and perylene acid imide; polycyclic quinone pigments such as anthraquinone and pyrene quinone; squalelium coloring matter, a pyrylium salt, and a thiapyrylium salt, and a triphenylmethane dye; inorganic substances such as selenium, selenium-tellurium, and amorphous silicon; and quinacridone pigments, azulenium salt pigments, a cyanine dye, a xanthene coloring matter, quinonimine coloring matter, and styryl coloring matter.

Any one of those charge-generating substances may be used alone, or two or more of them may be used in combination. Of those, in particular, the metallophthalocyanines, such as oxytitanium phthalocyanine, hydroxygallium phthalocyanine, and chlorogallium phthalocyanine are preferable because of their high sensitivities.

When the photosensitive layer is a multilayer type photosensitive layer, the binder resin used in the charge-generating layer may be, for example, any of the following: a polycarbonate resin, a polyester resin, a polyarylate resin, a butyral resin, a polystyrene resin, a polyvinyl acetal resin, a diallylphthalate resin, an acryl resin, a methacryl resin, a vinyl acetate resin, a phenol resin, a silicone resin, a polysulfone resin, a styrene-butadiene copolymer resin, an alkyd resin, an epoxy resin, a urea resin, and a vinyl chloride-vinyl acetate copolymer resin.

Of those, the butyral resin is preferable. They may be independently used. Alternatively, two or more kinds of them may be used as a mixture or a copolymer.

The charge-generating layer can be formed by applying a charge-generating layer coating solution, which is prepared by dispersing a charge-generating substance into a solvent together with a binder resin, and then drying the coating solution. For example, a dispersion method may be one using a homogenizer, an ultrasonic wave, a ball mill, a sand mill, an attritor, or a roll mill. A ratio between the charge-generating substance and the binder resin is preferably in the range of 10:1 to 1:10 (mass ratio), more preferably in the range of 3:1 to 1:1 (mass ratio).

The solvent used in the charge-generating layer coating solution is selected on the basis of a binder resin to be used, and the solubility and dispersion stability of the charge-generating substance. The organic solvent may be an alcohol-based solvent, a sulfoxide-based solvent, a ketone-based solvent, an ether-based solvent, an ester-based solvent, or an aromatic hydrocarbon solvent.

The film thickness of the charge-generating layer is preferably 5 μm or less, more preferably 0.1 to 2 μm.

Further, the charge-generating layer may be added with any of various sensitizers, antioxidants, UV absorbents, plasticizers, and so on if required. An electron-transporting substance (electron-accepting substance such as an acceptor) may be added to the charge-generating layer to prevent the flow of charge (carriers) from being disrupted in the charge-generating layer.

Examples of the charge-transporting substance to be used in the electrophotographic photosensitive member of the present invention include a triarylamine compound, a hydrazone compound, a styryl compound, a stilbene compound, a pyrazoline compound, an oxazole compound, a thiazole compound, and a triarllylmethane compound. One kind of those charge-transporting substances may be used alone, or two or more kinds of them may be used in combination.

When the photosensitive layer is a multilayer type photosensitive layer, the following may be given as examples of the binder resin to be used in the charge-transporting layer: an acryl resin, a styrene resin, a polyester resin, a polycarbonate resin, a polyarylate resin, a polysulfone resin, a polyphenylene oxide resin, an epoxy resin, a polyurethane resin, an alkyd resin, and an unsaturated resin.

Of those, in particular, a polymethyl methacrylate resin, a polystyrene resin, a styrene-acrylonitrile copolymer resin, a polycarbonate resin, a polyarylate resin, or a diallyl phthalate resin is preferable. One kind of those resins can be used alone, or two or more kinds of them can be used as a mixture or a copolymer.

The charge-transporting layer can be formed by applying a charge-transporting layer coating solution obtained by dissolving a charge-transporting substance and a binder resin into a solvent and then drying. A ratio between the charge-transporting substance and the binder resin is preferably in the range of 2:1 to 1:2 (mass ratio).

When the charge-transporting layer is a surface layer, a polymer having a repeating structural unit represented by the above formula (1) for the present invention is included in a charge-transporting layer coating solution (surface-layer coating solution). The content of the polymer is preferably 0.01 to 20.0 mass %, more preferably 0.1 to 5.0 mass % with respect to the total amount of the charge-transporting substance and the binder resin.

Examples of the solvent used for the charge-transporting layer coating solution include: ketone-based solvents such as acetone and methyl ethyl ketone; ester-based solvents such as methyl acetate and ethyl acetate; ether-based solvents such as tetrahydrofuran, dioxolane, dimethoxymethane, and dimethoxyethane; and aromatic hydrocarbon solvents such as toluene and xylene.

Any of those solvents may be used alone, or two or more of them may be used as a mixture. Of those solvents, it is preferable to use any of the ether-based solvents and the aromatic hydrocarbon solvents from the viewpoint of resin solubility.

The charge-transporting layer has a film thickness of preferably 5 to 40 μm, or more preferably 10 to 30 μm.

In addition, the charge-transporting layer may be added with, for example, an antioxidant, a UV absorber, or a plasticizer if required.

When the photosensitive layer is a monolayer type photosensitive layer and provided as the surface layer of an electrophotographic photosensitive member, in the monolayer type photosensitive layer, a polymer having the repeating structural unit represented by the above formula (1) for the present invention is added to the above charge-generating substance, the above charge-transporting substance, the above binder resin, and the above solvent. A coating solution for the monolayer type photosensitive layer thus obtained may be applied and dried to form the photosensitive layer of the electrophotographic photosensitive member (monolayer type photosensitive layer).

Further, a protective layer intended to protect the photosensitive layer may be formed on the photosensitive layer. The protective layer can be formed by applying a coating solution for protective layer, which is prepared by dissolving various kinds of the binder resins in a solvent as described above, and then drying.

When the surface layer of the electrophotographic photosensitive member is a protective layer, a polymer having the repeating structural unit represented by the above formula (1) for the present invention is contained in the protective layer just as in the case where the above charge-transporting layer is the surface layer. Consequently, the surface layer of the electrophotographic photosensitive member of the present invention can be formed.

The film thickness of the protective layer is preferably 0.5 to 10 μm, more preferably 1 to 5 μm.

For the application of each of the coating solutions corresponding to the respective layers, any of the application methods can be employed. Such methods include dip coating, spraying coating, spinner coating, roller coating, Mayer bar coating, blade coating, and ring coating.

Figure 2:
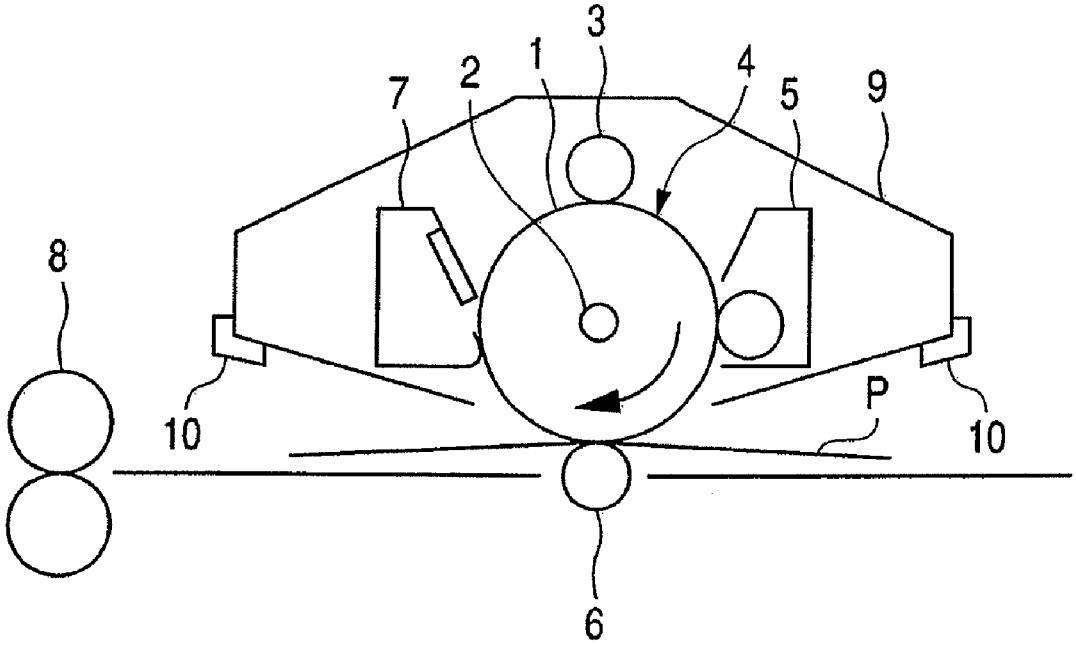
FIG. 2 is a diagram that schematically illustrates the configuration of an electrophotographic apparatus provided with a process cartridge of the present invention.

FIG. 2 illustrates an exemplified schematic configuration of an electrophotographic apparatus equipped with a process cartridge of the present invention.

In FIG. 2, a cylindrical electrophotographic photosensitive member 1 can be driven to rotate around an axis 2 in the direction indicated by the arrow at a predetermined peripheral speed.

The surface of the electrophotographic photosensitive member 1 to rotate is uniformly charged in positive or negative at predetermined potential by a charging unit (primary charging unit: for example, a charging roller) 3. Subsequently, the surface of the electrophotographic photosensitive member 1 receives exposure light (image exposure light) 4 emitted from an exposure unit (not shown) such as a slit exposure or a laser-beam scanning exposure. In this way, electrostatic latent images corresponding to the respective images of interest are sequentially formed on the surface of the electrophotographic photosensitive member 1.

The electrostatic latent images formed on the surface of the electrophotographic photosensitive member 1 are converted into toner images by development with toner contained in a developer of a developing unit 5. Subsequently, the toner images being formed and held on the surface of the electrophotographic photosensitive member 1 are sequentially transferred to a transfer material (such as paper) P by a transfer bias from a transfer unit (e.g., transfer roller) 6. The transfer material P is fed to a portion (contact part) between the electrophotographic photosensitive member 1 and the transfer unit 6 in synchronization with the rotation of the electrophotographic photosensitive member 1.

The transfer material P which has received the transfer of the toner images is separated from the surface of the electrophotographic photosensitive member 1 and then introduced to a fixing unit 8. The transfer material P is subjected to an image fixation and then printed as an image-formed product (print or copy) out of the apparatus.

The surface of the electrophotographic photosensitive member 1 after the transfer of the toner images is cleaned by removal of the remaining developer (toner) after the transfer by a cleaning unit (e.g., cleaning blade) 7. Further, the surface of the electrophotographic photosensitive member 1 is subjected to a neutralization process with pre-exposure light (not shown) from a pre-exposure unit (not shown) and then repeatedly used in image formation. As shown in FIG. 2, furthermore, when the charging unit 3 is a contact-charging unit using a charging roller, the pre-exposure is not always required.

Of the structural components including the electrophotographic photosensitive member 1, the charging unit 3, the developing unit 5, and the cleaning unit 7 as described above, two or more of them may be housed in a container and then integrally combined as a process cartridge. In addition, the process cartridge may be designed so as to be detachably mounted on the main body of an electrophotographic apparatus such as a copying machine or a laser beam printer. In FIG. 2, the electrophotographic photosensitive member 1, the charging unit 3, the developing unit 5, and the cleaning unit 7 are integrally supported and placed in a cartridge, thereby forming a process cartridge 9. The process cartridge 9 is detachably mounted on the main body of the electrophotographic apparatus using a guide unit 10 such as a rail of the main body of the electrophotographic apparatus.

EXAMPLES

Hereinafter, the present invention will be described in detail with reference to specific examples. However, the present invention is not limited to these examples. In addition, part(s) means mass part(s) and % means mass % in the examples.

Synthesis Example (A-1)

Synthesis of Compound Represented by the Above Formula (3-1-3)

An iodinated material (0.5 part) represented by the following formula (A-e-1):

(A-e-1)

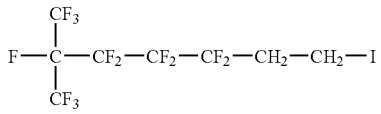

and ion-exchanged water (20 parts) were charged to a deaerated autoclave, followed by heating up to 300° C. to carry out a conversion reaction of iodine to a hydroxyl group at a gauge pressure of 9.2 MPa for 4 hours. After the end of the reaction, diethyl ether (20 parts) was added to the reaction mixture. After the mixture had been separated into two phases, magnesium sulfate (0.2 part) was placed in an ether phase and magnesium sulfate was then removed by filtration, thereby obtaining a hydroxyl compound. The hydroxyl compound was subjected to column chromatography to separate and remove components other than principal components. Subsequently, 100 parts of the previously obtained hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. Next, the flask was heated up to 110° C. and the reaction was then continued until the raw material, the hydroxyl compound, disappeared. After the completion of the reaction, the mixture was diluted with 200 parts of toluene, washed with an aqueous sodium hydroxide solution twice, and then washed with ion-exchanged water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-1-3) was a principal component.

Synthesis Example (A-2)

Synthesis of Compound Represented by the Above Formula (3-1-4)

A product containing the compound represented by the above formula (3-1-4) as a principal component was obtained by carrying out the same reaction as that of Synthesis Example (A-1) except that an iodinated material represented by the following formula (A-e-2) was used instead of the iodinated material represented by the above formula (A-e-1) described in Synthesis Example (A-1).

(A-e-2)

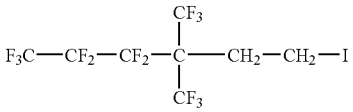

Synthesis Example (A-3)

Synthesis of Compound Represented by the Above Formula (3-1-6)

A product containing the compound represented by the above formula (3-1-6) as a principal component was obtained by carrying out the same reaction as that of Synthesis Example (A-1) except that an iodinated material represented by the following formula (A-e-3) was used instead of the iodinated material represented by the above formula (A-e-1) described in Synthesis Example (A-1).

(A-e-3)

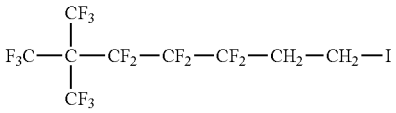

Synthesis Example (A-4)

Synthesis of Compound Represented by the Above Formula (3-1-7)

A product containing the compound represented by the above formula (3-1-7) as a principal component was obtained by carrying out the same reaction as that of Synthesis Example (A-1) except that an iodinated material represented by the following formula (A-e-4) was used instead of the iodinated material represented by the above formula (A-e-1) described in Synthesis Example (A-1).

(A-e-4)

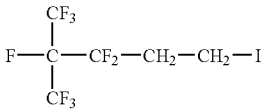

Synthesis Example (A-5)

Synthesis of Compound Represented by the Above Formula (3-2-2)

In a glass flask equipped with an agitator, a condenser, and a thermometer, 100 parts of a hydroxyl compound represented by the following formula (A-e-5):

(A-e-5)

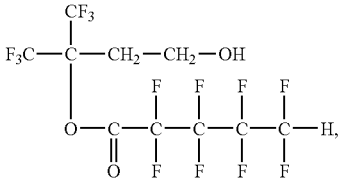

50 parts of acrylic acid, 5 parts of hydroquinone, 5 parts of p-toluenesulfonic acid, and 200 parts of toluene were placed. Subsequently, the mixture was heated up to 110° C. and the reaction was then continued until the raw material, the hydroxyl compound, disappeared. After the completion of the reaction, the mixture was diluted with 200 parts of toluene, washed with an aqueous sodium hydroxide solution twice, and then washed with ion-exchanged water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-2-2) was a principal component.

Synthesis Example (A-6)

Synthesis of Compound Represented by the Above Formula (3-2-1)

A product containing the compound represented by the above formula (3-2-1) as a principal component was obtained by carrying out the same reaction as that of Synthesis Example (A-5) except that a hydroxyl compound represented by the following formula (A-e-6) was used instead of the hydroxyl compound represented by the above formula (A-e-5) described in Synthesis Example (A-5).

(A-e-6)

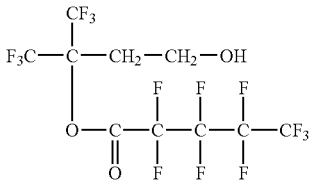

Synthesis Example (A-7)

A reaction was carried out in a manner similar to that of Synthesis Example (A-1) except that an iodinated material represented by the following formula (A-f-1):

(A-f-1)

(in the above formula, 7 represents the number of repetitions of the repeating unit) was used instead of the iodinated material represented by the above formula (A-e-1) described in Synthesis Example (A-1). Consequently, a product, in which a compound represented by the following formula (A-f):

(A-f)

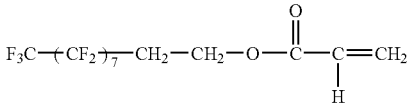

(in the above formula, 7 represents the number of repetitions of the repeating unit) was a principal component, was obtained.

Production Example (A-1)

Production of Polymer (A-A)

In a glass flask equipped with an agitator, a reflux condenser, a dropping funnel, a thermometer, and a gas-blowing opening, 10 parts of methyl methacrylate (hereinafter, abbreviated as MMA) and 0.3 part of an acetone (17.5%)-toluene mixture solvent were placed. Subsequently, a nitrogen gas was introduced into the flask and then 0.5 part of azobisisobutyronitrile (hereinafter, abbreviated as AIBN) as a polymerization initiator and 0.32 part of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and then added every 30 minutes in nine times. Likewise, AIBN (1.5 parts) was added every 1.5 hours in three times to carry out the polymerization. Subsequently, the mixture was refluxed for an additional two hours, thereby terminating the polymerization. A polymer solution of the following formula (g) was obtained:

(g)

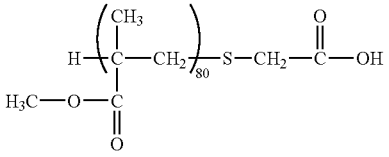

(in the above formula, 80 represents the average number of repetitions of the repeating unit).

The reaction temperature was 77 to 87° C. Part of the reaction solution was re-precipitated with n-hexane and then dried, followed by obtaining an acid value of 0.34 mg equivalent/g as a result of the measurement of acid value. An average number of repetitions of the repeating unit was about 80.

Next, part of acetone was distilled off from the above reaction solution, followed by the addition of 0.5% of triethyl amine as a catalyst and 200 ppm of hydroquinone monomethyl ether as a polymerization-prohibiting agent. In addition, 1.2-fold molar excess of glycidyl methacrylate was added with respect to the acid value of the polymer. Subsequently, the reaction solution was reacted for 11 hours under reflux (about 110° C.). The reaction solution was added to 10 volumes of n-hexane and then precipitated, followed by drying at 80° C. under reduced pressure. As a result, 90 parts of a compound represented by the following formula (d-1) was obtained:

(in the above formula, 80 represents the average number of repetitions of the repeating unit).

Next, the following materials were placed in a glass flask equipped with an agitator, a reflux condenser, a dropping funnel, a thermometer, and a gas-blowing opening and then subjected to the introduction of a nitrogen gas, followed by reacting for 5 hours under reflux (heated to about 100° C.). 70 parts of a compound represented by the above formula (d-1). 30 parts of a product in which the compound represented by the above formula (3-1-3) obtained by Synthesis Example (A-1) was a principal component. 270 parts of trifluorotoluene. AIBN (0.35 part). The reaction solution was introduced into 10 volumes of methanol and precipitated, followed by drying at 80° C. under reduced pressure. Consequently, a polymer (A-A: weight average molecular weight (Mw): 22,000) having a repeating structural unit represented by the above formula (1-1-3) was obtained.

In the present invention, the weight average molecular weights of the polymer and the resin were measured as described below according to the conventional method.

In other words, the polymer or the resin as a measurement target was placed in tetrahydrofuran and then left standing for several hours. After that, the measuring-target resin and tetrahydrofuran were mixed well while being shaken (mixed until no aggregate of the measuring-target polymer or resin was observed) followed by further allowing to stand for 12 hours or more.

After that, a product which had been passed through a sample-treating filter, MAISHORIDISK H-25-5 manufactured by Tosoh Corporation, was provided as a sample for gel permeation chromatography (GPC).

Subsequently, the column was stabilized in a heat chamber at 40° C. and a solvent, tetrahydrofuran, was then fed at a flow rate of 1 ml/min to the column at the temperature. Subsequently, 10 μl of the GPC sample was injected into the column, thereby determining the weight average molecular weight of the measuring-target polymer or resin. The column used was a column TSKgel SuperHM-M manufactured by Tosoh Corporation.

For determining the weight average molecular weight of the measuring-target polymer or resin, a molecular weight distribution possessed by the measuring-target polymer or resin was calculated from a relationship between the logarithmic values of the standard curve prepared by several monodispersed polystryrene standard samples and the counted values. The standard polystyrene samples used for preparing the standard curve were monodispersed polystyrene manufactured by Sigma-Aldrich Corporation of ten different molecular weights: 3,500; 12,000; 40,000; 75,000; 98,000; 120,000; 240,000; 500,000; 800,000; and 1,800,000. The detector used was an RI (an index of refraction) detector.

(d-1)

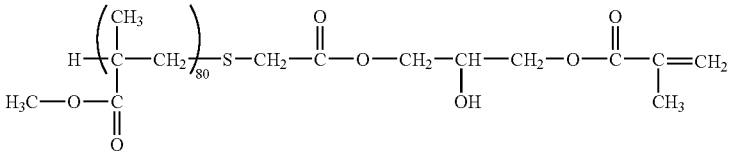

Production Example (A-2)

Production of Polymer (A-B)

The reaction and the process were carried out by the same procedures as those of Production Example (A-1) except that the compound represented by the above formula (3-1-3) was replaced with a product in which the compound represented by the above formula (3-1-4) obtained in Synthesis Example (A-2) was a principal component. Consequently, a polymer (A-B: weight average molecular weight (Mw): 21,000) having the repeating structural unit represented by the above formula (1-1-4) was obtained.

Production Example (A-3)

Production of Polymer (A-C)

The reaction and the process were carried out by the same procedures as those of Production Example (A-1) except that the compound represented by the above formula (3-1-3) was replaced with a product in which the compound represented by the above formula (3-1-6) obtained in Synthesis Example (A-3) was a principal component. Consequently, a polymer (A-C: weight average molecular weight (Mw): 19,500) having the repeating structural unit represented by the above formula (1-1-6) was obtained.

Production Example (A-4)

Production of Polymer (A-D)

The reaction and the process were carried out by the same procedures as those of Production Example (A-1) except that the compound represented by the above formula (3-1-3) was replaced with a produce in which the compound represented by the above formula (3-1-7) obtained in Synthesis Example (A-4) was a principal component. Consequently, a polymer (A-D: weight average molecular weight (Mw): 23,400) having the repeating structural unit represented by the above formula (1-1-7) was obtained.

Production Example (A-5)

Production of Polymer (A-E)

The reaction and the process were carried out by the same procedures as those of Production Example (A-1) except that the compound represented by the above formula (3-1-3) was replaced with a product in which the compound represented by the above formula (3-2-2) obtained in Synthesis Example (A-5) was a principal component. Consequently, a polymer (A-E: weight average molecular weight (Mw): 22,100) having the repeating structural unit represented by the above formula (1-2-2) was obtained.

Production Example (A-6)

Production of Polymer (A-F)

The reaction and the process were carried out by the same procedures as those of Production Example (A-1) except that the compound represented by the above formula (3-1-3) was replaced with a product in which the compound represented by the above formula (3-2-1) obtained in Synthesis Example (A-6) was a principal component. Consequently, a polymer (A-F: weight average molecular weight (Mw): 22,500) having the repeating structural unit represented by the above formula (1-2-1) was obtained.

Production Example (A-7)

Production of Polymer (A-G) (Comparative Example)

The reaction and the process were carried out by the same procedures as those of Production Example (A-1) except that the compound represented by the above formula (3-1-3) was replaced with a product in which the compound represented by the above formula (A-f) obtained in Synthesis Example (A-7) was a principal component. Consequently, a polymer (A-G: weight average molecular weight (Mw): 21,000) having the repeating structural unit represented by the following formula (A-f-2) was obtained:

(A-f-2)

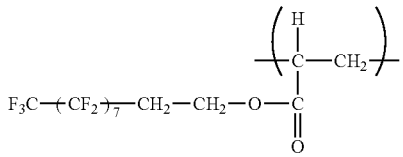

(in the above formula, 7 represents the number of repetitions of the repeating unit).

Example (A-1)

A conductive support used was an aluminum cylinder (JIS-A3003, aluminum alloy ED tube, manufactured by Showa Aluminum Corporation) with 260.5 mm in length and 30 mm in diameter obtained by heat extrusion under the environment with a temperature of 23° C. and a humidity of 60% RH.

The following materials were dispersed with a sand mill with 1-mm-diameter glass beads for 3 hours, thereby preparing a dispersion solution. $TiO_2$ particles covered with oxygen-deficient $SnO_2$ as conductive particles (power resistivity: 80Ω·cm, $SnO_2$ coverage rate (mass ratio): 50%), 6.6 parts. A phenol resin (trade name: Plyophen J-325, manufactured by Dainippon Ink & Chemicals, Incorporated. 60% resin solid) as a resin binder, 5.5 parts. Methoxy propanol as a solvent, 5.9 parts.

The following materials were added to the dispersion solution, and the whole was stirred, thereby preparing a conductive-layer coating solution. Silicone resin particles (trade name: Tospal 120, GE Toshiba Silicones, average particle size: 2 μm) as a surface-roughness imparting agent, 0.5 part. Silicone oil (trade name: SH28PA, manufactured by Dow Corning Toray Silicone Co., Ltd.) as a leveling agent, 0.001 part.

The support was dip-coated with the conductive-layer coating solution and the whole was dried at a temperature of 140° C. for 30 minutes to heat-curing, thereby forming a conductive layer of 15 μm in average film thickness at a position of 130 mm from the upper side of the support.

The conductive layer was dip-coated with the following intermediate-layer coating solution and then the whole was dried at a temperature of 100° C. for 10 minutes, thereby forming an intermediate layer of 0.5 μm in average film thickness at a position of 130 mm from the upper end of the support. An intermediate-layer coating solution prepared by dissolving N-methoxy methylated nylon (trade name: Toresin EF-30T, manufactured by Teikoku Chemical Industry Co., Ltd.), 4 parts, and a copolymer nylon resin (Amilan CM8000, manufactured by Toray Co., Ltd.), 2 parts, in a mixture solvent of 65 parts of methanol and 30 parts of n-butanol.

Subsequently, the following materials were dispersed with a sand-milling device with glass beads of 1 mm in diameter for 1 hour. Next, 250 parts of ethyl acetate was added to the mixture, thereby preparing a charge-generating layer coating solution. Hydroxy gallium phthalocyanine in crystal form with strong peaks at Bragg angles (2θ±0.2) in CuKα-characteristic X-ray diffraction of 7.5°, 9.9°, 16.3°, 18.6°, 25.1°, and 28.3°, 10 parts. Polyvinyl butyral (trade name: S-LEX BX-1, manufactured by Sekisui Chemical, Co., Ltd.), 5 parts. Cyclohexanone, 250 parts.

The intermediate layer was dip-coated with the charge-generating layer coating solution and then the whole was dried at a temperature of 100° C. for 10 minutes, thereby forming a charge-generating layer of 0.16 μm in average film thickness at a position of 130 mm from the upper end of the support.

Next, the following materials were dissolved in a mixture solvent of 30 parts of dimethoxy methane and 70 parts of chlorobenzene, thereby preparing a coating solution containing a charge-transporting substance. A charge-transporting substance having a structure represented by the following formula (CTM-1), 10 parts:

(CTM-1)

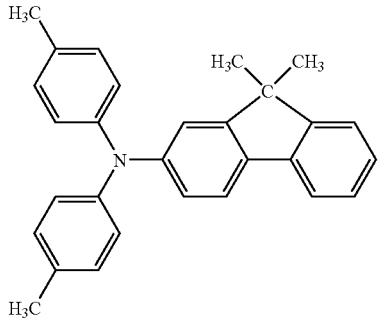

A polycarbonate resin (Iupilon Z-400 manufactured by Mitsubishi Engineering-Plastics Corporation) [viscosity average molecular weight (Mv): 39,000] formed of a repeating structural unit represented by the following formula (P-1) as a binder resin, 10 parts:

(P-1)

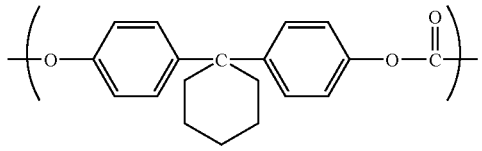

The polymer (A-A) produced in Production Example (A-1), 0.2 part.

The charge-generating layer was dip-coated with the charge-transporting layer coating solution thus prepared and then the whole was dried at a temperature of 120° C. for 30 minutes. Consequently, a charge-transporting layer with an average film thickness of 17 μm at a position of 130 mm from the upper end of the support was formed.

Further, a method of measuring a viscosity average molecular weight (Mv) is as described below.

First, 0.5 g of a sample was dissolved in 100 ml of methylene chloride and a specific viscosity of the solution at a temperature of 25° C. was then determined using an improved Ubbelohde-type viscometer. Subsequently, the limiting viscosity was calculated from the specific viscosity and the viscosity average molecular weight (Mv) was then calculated by the Mark-Houwink viscosity formula. The viscosity average molecular weight (Mv) was represented by the corresponding value of polystyrene determined by gel permeation chromatography (GPC).

In this way, an electrophotographic photosensitive member having a charge-transporting layer provided as a surface layer was prepared.

The electrophotographic photosensitive member thus prepared was evaluated for initial blade turn-up*1 and electrophotographic properties*2. The results are shown in Table 1.

*1: Evaluation Method for Initial Blade Turn-Up

The electrophotographic photosensitive member thus prepared, the main body of a laser beam printer LBP-2510 manufactured by Canon Co. Ltd., and a process cartridge of the main body were placed under the environment with a temperature of 35° C. and a humidity of 80% RH for 15 hours. After that, under the environment, the electrophotographic photosensitive member thus prepared was mounted on the process cartridge, followed by continuous output of 20 sheets of a solid white image. During the printing, whether a turn-up trouble of a cleaning blade occurred was observed (the evaluation was performed on four stations (four new electrophotographic photosensitive members and four new process cartridges were prepared for the respective colors), and "F" was written in Table 1 when the turn-up trouble occurred even only once or "A" was written when no trouble occurred).

*2: Evaluation Method for Electrophotographic Properties

The prepared electrophotographic photosensitive member, the main body of the laser beam printer LBP-2510 manufactured by Canon Co., Ltd., and tools for measuring a surface potential were placed under the environment with a temperature of 25° C. and a humidity of 50% RH (normal temperature and normal humidity) for 15 hours. Further, the tools for measuring the surface potential were those (the toner, the developing rollers, and the cleaning blade were removed) used for placing a probe for surface-potential measurement of an electrophotographic photosensitive member on the developing roller position of the process cartridge of the LBP-2510. After that, under the same environment, the tools for measuring the surface potential of the electrophotographic photosensitive member were attached to the member, and the surface potential of the electrophotographic photosensitive member was then measured without sheet-feeding under the condition in which a belt unit for electrostatic image transfer was removed. By the way, the tools for measuring the surface potential were mounted on the station of a cyan process cartridge in the main body and the measurement was then carried out.

A potential measurement method was carried out as described below. First, an exposure part potential (VI: a potential at first round after exposure of the electrophotographic photosensitive member in the presence of whole surface exposure after electrification) was measured. Next, a pre-exposure after-potential (Vr: a potential at first cycle (second round after electrification) after the pre-exposure without image exposure in the presence of electrification at only first round of the electrophotographic photosensitive member)

was then measured. Subsequently, a cycle of electrification/whole-surface image exposure/pre-exposure was repeated 1,000 times (1K cycles). After that, the pre-exposure after-potential (in the table, represented by Vr (1K)) was measured again.

Those results were shown in Table 1.

Examples (A-2) to (A-6)

An electrophotographic photosensitive member was prepared and evaluated in a manner similar to that of Example (A-1) except that the polymer (A-A) used in the charge-transporting layer coating solution in Example (A-1) was replaced with a polymer represented in Table 1. The results are shown in Table 1.

Example (A-7)

An electrophotographic photosensitive member was prepared and evaluated in a manner similar to that of Example (A-2) except for the following change in Example (A-2). The results are shown in Table 1.

The polycarbonate resin formed of a repeating structural unit represented by the above formula (P-1), the binder resin of the charge-transporting layer, was replaced with a polyarylate resin having a repeating structural unit represented by the following formula (P-2)(weight average molecular weight (Mw): 120,000):

(P-2)

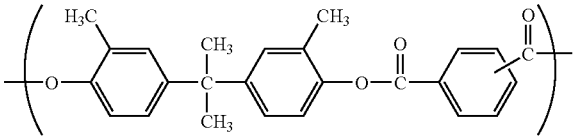

By the way, a molar ratio between a terephthalic acid structure and an isophthalic acid structure in the above polyarylate resin (tetraphthalic acid structure: isophthalic acid structure) was 50:50.

Example (A-8)

An electrophotographic photosensitive member was prepared and evaluated in a manner similar to that of Example (A-8) except that hydroxy gallium phthalocyanine as the charge-generating substance of the charge-generating layer in Example (A-7) was replaced with oxytitamium phthalocyanine (TiOPc) below. The results are shown in Table 1. TiOPc with strong peaks at Bragg angles 2θ±0.2° in CuKα-characteristic X-ray diffraction of 9.0°, 14.2°, 23.9°, and Examples (A-9) and (A-10)

An electrophotographic photosensitive member was prepared and evaluated in a manner similar to that of Example (A-7) except that the polymer (A-B) used in the charge-transporting layer coating solution in Example (A-7) was replaced with a polymer represented in Table 1. The results are shown in Table 1.

Example (A-11)

An electrophotographic photosensitive member was prepared and evaluated in a manner similar to that of Example (A-10) except that the charge-transporting substance represented by the above formula (CTM-1) used in the charge-transporting layer coating solution in Example (A-9) was replaced with a charge-transporting substance represented by the following formula (CTM-2):

(CTM-2)

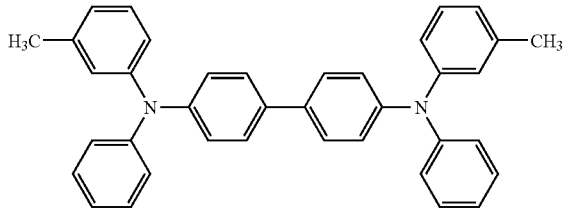

and a charge-transporting substance represented by the following formula (CTM-3):

(CTM-3)

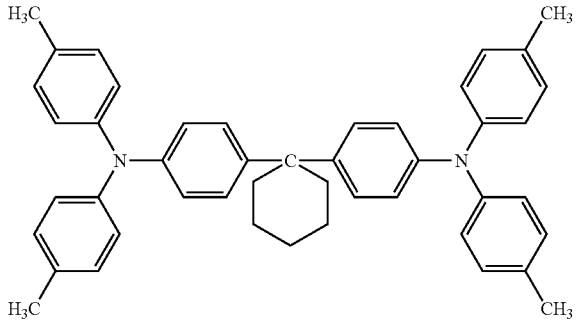

where 5 parts of each charge-transporting substance was used. The results are shown in Table 1.

Comparative Example (A-1)

An electrophotographic photosensitive member was prepared and evaluated in a manner similar to that of Example (A-2) except that the polymer (A-B) was not contained in the charge-transporting layer coating solution in Example (A-2). The results are shown in Table 1.

Comparative Example (A-2)

An electrophotographic photosensitive member was prepared and evaluated in a manner similar to that of Example (A-2) except that the polymer (A-B) used in the charge-transporting layer coating solution in Example (A-2) was replaced with 2,6-di-tert-butyl-p-cresol (BHT). The results are shown in Table 1.

Comparative Example (A-3)

An electrophotographic photosensitive member was prepared and evaluated in a manner similar to that of Example (A-2) except that the polymer (A-B) used in the charge-transporting layer coating solution in Example (A-2) was replaced with the polymer (A-G) produced in Production Example (A-7). The results are shown in Table 1.

An electrophotographic photosensitive member was prepared and evaluated in a manner similar to that of Example (A-2) except that the polymer (A-B) used in the charge-transporting layer coating solution in Example (A-2) was replaced with a compound (trade name Alon GF300, manufactured by Toagosei Co., Ltd.). The results are shown in Table 1.

TABLE 1

| | | Initial blade turn-up | Initial electro-photographic properties Vl (−V) | Vr (−V) | After endurance Vr (1K) (−V) |
|---|---|---|---|---|---|
| Example A-1 | Polymer A-A | A | 125 | 35 | 45 |
| Example A-2 | Polymer A-B | A | 125 | 35 | 45 |
| Example A-3 | Polymer A-C | A | 120 | 35 | 45 |
| Example A-4 | Polymer A-D | A | 120 | 30 | 40 |
| Example A-5 | Polymer A-E | A | 120 | 25 | 30 |
| Example A-6 | Polymer A-F | A | 120 | 25 | 30 |
| Example A-7 | Polymer A-B | A | 120 | 35 | 45 |
| Example A-8 | Polymer A-B | A | 125 | 40 | 50 |
| Example A-9 | Polymer A-E | A | 120 | 25 | 30 |
| Example A-10 | Polymer A-F | A | 120 | 25 | 30 |
| Example A-11 | Polymer A-E | A | 120 | 25 | 30 |
| Comparative Example A-1 | — | F | 120 | 25 | 30 |
| Comparative Example A-2 | BHT | F | 135 | 45 | 75 |
| Comparative Example A-3 | Polymer A-G | A | 120 | 40 | 60 |
| Comparative Example A-4 | Alon GF300 | A | 125 | 35 | 55 |

As is evident from the above results, Examples A-1 to A-11 and Comparative Examples A-1 and A-2 of the present invention are compared with each other, whereby the following fact is found. Blade turn-up at an initial stage can be prevented by producing an electrophotographic photosensitive member using a compound having a repeating unit of the present invention as a structural component of a coating solution for the formation of a surface layer. As a result, an electrophotographic photosensitive member avoiding such a trouble can be provided.

In addition, by comparing Examples A-1 to A-11 and Comparative Example A-3 of the present invention with each other, the branched structure in the compound having the repeating structural unit of the present invention is shown to be excellent in repetitive property out of the electrophotographic properties.

Further, Examples A-1 to A-11 and Comparative Example A-4 of the present invention are compared with each other, whereby the following a fact is found. An electrophotographic photosensitive member is produced by using a compound having a repeating structural unit of the present invention as a structural component of a coating solution for the formation of a surface layer. As a result, the member is more excellent in the repetitive property out of the electrophotographic properties than that in the case where the compound of Comparative Example 4 is used.

Synthesis Example (B-1)

Synthesis of Compound Represented by the Above Formula (3-2-2)

An iodinated material (0.5 part) represented by the following formula (B-e-1):

(B-e-1)

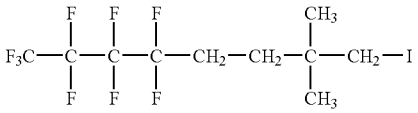

and ion-exchanged water (20 parts) were charged into a deaerated autoclave, followed by heating up to 300° C. to carry out a conversion reaction of iodine to a hydroxyl group at a gauge pressure of 9.2 MPa for 4 hours. After the end of the reaction, diethyl ether (20 parts) was added to the reaction mixture. After the mixture had been separated into two phases, magnesium sulfate (0.2 part) was placed in an ether phase and magnesium sulfate was then removed by filtration, thereby obtaining a hydroxyl compound. The hydroxyl compound was subjected to column chromatography to separate and remove components other than principal components. Subsequently, 100 parts of the previously obtained hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. Next, the flask was heated up to 110° C. and the reaction was then continued until the raw material, the hydroxyl compound, disappeared. After the completion of the reaction, the mixture was diluted with 200 parts of toluene, washed with an aqueous sodium hydroxide solution twice, and then washed with ion-exchanged water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-3-2) was a principal component.

Synthesis Example (B-2)

Synthesis of Compound Represented by the Above Formula (3-3-6)

A product containing the compound represented by the above formula (3-3-6) as a principal component was obtained by carrying out the same reaction as that of Synthesis Example (B-1) except that an iodinated material represented by the following formula (B-e-2) was used instead of the iodinated material represented by the above formula (B-e-1) described in Synthesis Example (B-1).

(B-e-2)

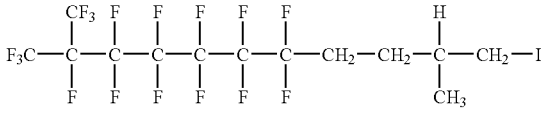

Synthesis Example (B-3)

A reaction was carried out in a manner similar to that of Synthesis Example (B-1) except that an iodinated material represented by the following formula (B-f-1):

(B-f-1)

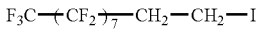

(in the above formula, 7 represents the number of repetitions of the repeating unit) was used instead of the iodinated material represented by the above formula (B-e-1) described in Synthesis Example (B-1). Consequently, a product, in which a compound represented by the following formula (B-f):

(B-f)

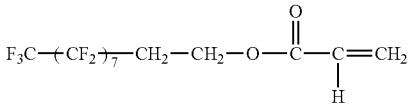

(in the above formula, 7 represents the number of repetitions of the repeating unit) was a principal component, was obtained.

Production Example (B-1)

Production of Polymer (B-A)

In a glass flask equipped with an agitator, a reflux condenser, a dropping funnel, a thermometer, and a gas-blowing opening, 10 parts of methyl methacrylate (hereinafter, abbreviated as MMA) and 0.3 part of an acetone (17.5%)-toluene mixture solvent were placed. Subsequently, a nitrogen gas was introduced into the flask and then 0.5 part of azobisisobutyronitrile (hereinafter, abbreviated as AIBN) as a polymerization initiator and 0.32 part of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and then added every 30 minutes in nine times. Likewise, AIBN (1.5 parts) was added every 1.5 hours in three times to carry out the polymerization. Subsequently, the mixture was refluxed for an additional two hours, thereby terminating the polymerization. A polymer solution of the above formula (g) was obtained. The reaction temperature was 77 to 87° C. Part of the reaction solution was re-precipitated with n-hexane and then dried, followed by obtaining an acid value of 0.34 mg equivalent/g as a result of the measurement of acid value. An average number of repetitions of the repeating unit was about 80.

Next, part of acetone was distilled off from the above reaction solution, followed by the addition of 0.5% of triethyl amine as a catalyst and 200 ppm of hydroquinone monomethyl ether as a polymerization-prohibiting agent. In addition, 1.2-fold molar excess of glycidyl methacrylate was added with respect to the acid value of the polymer. Subsequently, the reaction solution was reacted for 11 hours under reflux (about 110° C.). The reaction solution was added to 10 volumes of n-hexane and then precipitated, followed by drying at 80° C. under reduced pressure. As a result, 90 parts of a compound represented by the above formula (d-1) was obtained.

Next, the following materials were placed in a glass flask equipped with an agitator, a reflux condenser, a dropping funnel, a thermometer, and a gas-blowing opening and then subjected to the introduction of a nitrogen gas, followed by reacting for 5 hours under reflux (heated to about 100° C.). 70 parts of a compound represented by the above formula (d-1). 30 parts of a product in which a compound represented by the above formula (3-2-2) obtained in Synthesis Example (B-1) was a principal component. 270 parts of trifluorotoluene. AIBN (0.35 part). The reaction solution was introduced into 10 volumes of methanol and precipitated, followed by drying at 80° C. under reduced pressure. Consequently, a polymer (B-A: weight average molecular weight (Mw): 24,000) having a repeating structural unit represented by the above formula (1-3-2) was obtained.

Production Example (B-2)

Production of Polymer (B-B)

The reaction and the process were carried out by the same procedures as those of Production Example (B-1) except that the compound represented by the above formula (3-3-2) was replaced with a product in which the compound represented by the above formula (3-3-6) obtained in Synthesis Example (B-2) was a principal component. Consequently, a polymer (B-B: weight average molecular weight 23,000) having the repeating structural unit represented by the above formula (1-3-6) was obtained.

Production Example (B-3)

Production of Polymer (B-C)

Comparative Example

The reaction and the process were carried out by the same procedures as those of Production Example (B-1) except that the compound represented by the above formula (3-3-2) was replaced with a product in which the compound represented by the above formula (B-f) obtained in Synthesis Example (B-3) was a principal component. Consequently, a polymer (B-C: weight average molecular weight 21,000) having the repeating structural unit represented by the following formula (B-f-2) was obtained:

(B-f-2)

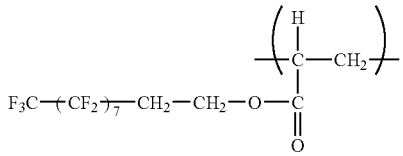

(in the above formula, 7 represents the number of repetitions of the repeating unit).

Example (B-1)

A conductive support used was an aluminum cylinder (JIS-A3003, aluminum alloy ED tube, manufactured by Showa Aluminum Corporation) with 260.5 mm in length and 30 mm in diameter obtained by heat extrusion under the environment with a temperature of 23° C. and a humidity of 60% RH.

The following materials were dispersed with a sand mill with 1-mm-diameter glass beads for 3 hours, thereby preparing a dispersion solution. $TiO_2$ particles covered with oxygen-deficient $SnO_2$ as conductive particles (power resistivity: 80Ω·cm, $SnO_2$ coverage rate (mass ratio): 50%), 6.6 parts. A phenol resin (trade name: Plyophen J-325, manufactured by Dainippon Ink & Chemicals, Incorporated. 60% resin solid) as a resin binder, 5.5 parts. Methoxy propanol as a solvent, 5.9 parts.

The following materials were added to the dispersion solution, and the whole was stirred, thereby preparing a conductive-layer coating solution. Silicone resin particles (trade name: Tospal 120, GE Toshiba Silicones, average particle size: 2 μm) as a surface-roughness imparting agent, 0.5 part. Silicone oil (trade name: SH28PA, manufactured by Dow Corning Toray Silicone Co., Ltd.) as a leveling agent, 0.001 part.

The support was dip-coated with the conductive-layer coating solution and the whole was dried at a temperature of 140° C. for 30 minutes to heat-curing, thereby forming a conductive layer of 15 μm in average film thickness at a position of 130 mm from the upper side of the support.

The conductive layer was dip-coated with the following intermediate-layer coating solution and then the whole was dried at a temperature of 100° C. for 10 minutes, thereby forming an intermediate layer of 0.5 μm in average film thickness at a position of 130 mm from the upper end of the support. An intermediate-layer coating solution prepared by dissolving N-methoxy methylated nylon (trade name: Toresin EP-30T, manufactured by Teikoku Chemical Industry Co., Ltd.), 4 parts, and a copolymer nylon resin (Amilan CM8000, manufactured by Toray Co., Ltd.), 2 parts, in a mixture solvent of 65 parts of methanol and 30 parts of n-butanol.

Subsequently, the following materials were dispersed with a sand-milling device with glass beads of 1 mm in diameter for 1 hour. Next, 250 parts of ethyl acetate was added to the mixture, thereby preparing a charge-generating layer coating solution. Hydroxy gallium phthalocyanine in crystal form with strong peaks at Bragg angles (2θ±0.20) in CuKα-characteristic X-ray diffraction of 7.5°, 9.9°, 16.3°, 18.6°, 25.1°, and 28.3°, 10 parts. Polyvinyl butyral (trade name: S-LEX BX-1, manufactured by Sekisui Chemical, Co., Ltd.), 5 parts. Cyclohexanone, 250 parts.

The intermediate layer was dip-coated with the charge-generating layer coating solution and then the whole was dried at a temperature of 100° C. for 10 minutes, thereby forming a charge-generating layer of 0.16 μm in average film thickness at a position of 130 mm from the upper end of the support.

Next, the following materials were dissolved in a mixture solvent of 30 parts of dimethoxy methane and 70 parts of chlorobenzene, thereby preparing a coating solution containing a charge-transporting substance. A charge-transporting substance having a structure represented by the above formula (CTM-1), 10 parts. A polycarbonate resin (Iupilon Z-400 manufactured by Mitsubishi Engineering-Plastics Corporation) [viscosity average molecular weight (Mv): 39,000] formed of a repeating structural unit represented by the above formula (P-1) as a binder resin, 10 parts. A polymer produced in Production Example (B-1) (B-A: 0.2 part).

The charge-generating layer was dip-coated with the charge-transporting layer coating solution thus prepared and then the whole was dried at a temperature of 120° C. for 30 minutes. Consequently, a charge-transporting layer with an average film thickness of 17 μm at a position of 130 mm from the upper end of the support was formed.

In this way, an electrophotographic photosensitive member having a charge-transporting layer provided as a surface layer was prepared.

The electrophotographic photosensitive member thus prepared was evaluated for initial blade turn-up*1 and electrophotographic properties*2. The results are shown in Table 1.

*1: Evaluation Method for Initial Blade Turn-Up

The electrophotographic photosensitive member thus prepared, the main body of a laser beam printer LBP-2510 manufactured by Canon Co. Ltd., and a process cartridge of the main body were placed under the environment with a temperature of 35° C. and a humidity of 80% RH for 15 hours. After that, under the environment, the electrophotographic photosensitive member thus prepared was mounted on the process cartridge, followed by continuous output of 20 sheets of a solid white image. During the printing, whether a turn-up trouble of a cleaning blade occurred was observed (the evaluation was performed on four stations (four new electrophotographic photosensitive members and four new process cartridges were prepared for the respective colors), and "F" was written in Table 1 when the turn-up trouble occurred even only once or "A" was written when no trouble occurred).

*2: Evaluation Method for Electrophotographic Properties

The prepared electrophotographic photosensitive member, the main body of the laser beam printer LBP-2510 manufactured by Canon Co., Ltd., and tools for measuring a surface potential were placed under the environment with a temperature of 25° C. and a humidity of 50% RH (normal temperature and normal humidity) for 15 hours. Further, the tools for measuring the surface potential were those (the toner, the developing rollers, and the cleaning blade were removed) used for placing a probe for surface-potential measurement of an electrophotographic photosensitive member on the developing roller position of the process cartridge of the LBP-2510. After that, under the same environment, the tools for measuring the surface potential of the electrophotographic photosensitive member were attached to the member, and the surface potential of the electrophotographic photosensitive member was then measured without sheet-feeding under the condition in which a belt unit for electrostatic image transfer was removed. By the way, the tools for measuring the surface potential were mounted on the station of a cyan process cartridge in the main body and the measurement was then carried out.

A potential measurement method was carried out as described below. First, an exposure part potential (VI: a potential at first round after exposure of the electrophotographic photosensitive member with whole surface exposure after electrification) was measured. Next, a pre-exposure after-potential (Vr: a potential at first cycle (second round after electrification) after the pre-exposure without image exposure with electrification at only first round of the electrophotographic photosensitive member) was then measured. Subsequently, a cycle of electrification/whole-surface image exposure/pre-exposure was repeated 1,000 times (1K cycles). After that, the pre-exposure after-potential (in the table, represented by Vr (1K)) was measured again. Those results were shown in Table 2.

Example (B-2)

An electrophotographic photosensitive member was prepared and evaluated in a manner similar to that of Example (B-1) except that the polymer (B-A) used in the charge-transporting layer coating solution in Example (B-1) was replaced with the polymer (B-B) produced in Production Example (B-2). The results are shown in Table 2.

Example (B-3)

An electrophotographic photosensitive member was prepared and evaluated in a manner similar to that of Example (B-1) except for the following change in Example (B-1). The results are shown in Table 2.

The polycarbonate resin formed of a repeating structural unit represented by the above formula (P-1), the binder resin of the charge-transporting layer, was replaced with a polyarylate resin having a repeating structural unit represented by the above formula (P-2)(weight average molecular weight (Mw): 120,000).

By the way, a molar ratio between a terephthalic acid structure and an isophthalic acid structure in the above polyarylate resin (tetraphthalic acid structure: isophthalic acid structure) was 50:50.

Example (B-4)

An electrophotographic photosensitive member was prepared and evaluated in a manner similar to that of Example (B-3) except that hydroxy gallium phthalocyanine as the charge-generating substance of the charge-generating layer in Example (B-3) was replaced with oxytitanium phthalocyanine (TiOPc) below. The results are shown in Table 2. TiOPc with strong peaks at Bragg angles 2θ±0.2 in CuKα-characteristic X-ray diffraction of 9.0°, 14.2°, 23.9°, and 27.1°.

Example (B-5)

An electrophotographic photosensitive member was prepared and evaluated in a manner similar to that of Example (B-4) except that the charge-transporting substance represented by the above formula (CTM-1) used in the charge-transporting layer coating solution in Example (B-4) was replaced with a charge-transporting substance represented by the above formula (CTM-2) and a charge-transporting substance represented by the above formula (CTM-3). 5 parts of each charge-transporting substance was used. The results are shown in Table 2.

Comparative Example (B-1)

An electrophotographic photosensitive member was prepared and evaluated in a manner similar to that of Example (B-1) except that the polymer (B-A) was not included in the charge-transporting layer coating solution in Example (B-1). The results are shown in Table 2.

Comparative Example (B-2)

An electrophotographic photosensitive member was prepared and evaluated in a manner similar to that of Example (B-1) except that the polymer (B-A) used in the charge-transporting layer coating solution in Example (B-1) was replaced with 2,6-di-tert-butyl-p-cresol (BET). The results are shown in Table 2.

Comparative Example (B-3)

An electrophotographic photosensitive member was prepared and evaluated in a manner similar to that of Example (B-1) except that the polymer (B-A) used in the charge-transporting layer coating solution in Example (B-1) was replaced with the polymer (B-E) produced in Production Example (B-3). The results are shown in Table 2.

Comparative Example (B-4)

An electrophotographic photosensitive member was prepared and evaluated in a manner similar to that of Example (B-1) except that the polymer (B-A) used in the charge-transporting layer coating solution in Example (B-1) was replaced with a compound (trade name Alon CF300, manufactured by Toagosei Co., Ltd.). The results are shown in Table 2.

TABLE 2

| | | Initial blade | Initial electro-photographic properties | | After endurance |
|---|---|---|---|---|---|
| | | turn-up | Vl (−V) | Vr (−V) | Vr (1K) (−V) |
| Example B-1 | Polymer B-A | A | 125 | 30 | 40 |
| Example B-2 | Polymer B-B | A | 120 | 30 | 40 |
| Example B-3 | Polymer B-A | A | 120 | 35 | 40 |
| Example B-4 | Polymer B-A | A | 120 | 25 | 30 |
| Example B-5 | Polymer B-A | A | 125 | 30 | 35 |
| Comparative Example B-1 | — | F | 120 | 25 | 30 |

TABLE 2-continued

| | | Initial blade | Initial electro-photographic properties | | After endurance |
|---|---|---|---|---|---|
| | | turn-up | Vl (−V) | Vr (−V) | Vr (1K) (−V) |
| Comparative Example B-2 | BHT | F | 135 | 45 | 75 |
| Comparative Example B-3 | Polymer B-E | A | 120 | 40 | 360 |
| Comparative Example B-4 | Alon GF300 | A | 125 | 35 | 55 |

As is evident from the above results, Examples (B-1) to (B-5) of the present invention and Comparative Examples (B-1) and (B-2) are compared with each other, whereby the following fact is found. Blade turn-up at an initial stage can be prevented by producing an electrophotographic photosensitive member using a compound having a repeating structural unit of the present invention as a constitutional component of a coating solution for the formation of a surface layer. As a result, an electrophotographic photosensitive member avoiding such a trouble can be provided.

In addition, by comparing Examples (B-1) to (B-5) of the present invention and Comparative Example (B-3) with each other, the compound having the repeating structural unit of the present invention is shown to be excellent in repetitive property out of the electrophotographic properties.

Further, Examples (B-1) to (B-5) of the present invention and Comparative Example (B-4) are compared with each other, whereby the following fact is found. An electrophotographic photosensitive member is produced by using a compound having a repeating structural unit of the present invention as a constitutional component of a coating solution for the formation of a surface layer. As a result, the member is more excellent in the repetitive property out of the electrophotographic properties than that in the case where the compound of Comparative Example 4 is used.

Synthesis Example (C-1)

Synthesis of Compound Represented by the Above Formula (3-4-1)

An iodinated material (0.5 part) represented by the following formula (C-e-1):

(C-e-1)

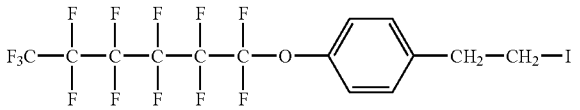

and ion-exchanged water (20 parts) were charged into a deaerated autoclave, followed by heating up to 300° C. to carry out a conversion reaction of iodine to a hydroxyl group at a gauge pressure of 9.2 MPa for 4 hours. After the end of the reaction, diethyl ether (20 parts) was added to the reaction mixture. After the mixture had been separated into two phases, magnesium sulfate (0.2 part) was placed in an ether phase and magnesium sulfate was then removed by filtration, thereby obtaining a hydroxyl compound. The hydroxyl compound was subjected to column chromatography to separate and remove components other than principal components. Subsequently, 100 parts of the previously obtained hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. Next, the flask was heated up to 110° C. and the reaction was then continued until the raw material, the hydroxyl compound, disappeared. After the completion of the reaction, the mixture was diluted with 200 parts of toluene, washed with an aqueous sodium hydroxide solution twice, and then washed with ion-exchanged water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-4-1) was a principal component.

Synthesis Example (C-2)

Synthesis of Compound Represented by the Above Formula (3-4-3)

A product containing the compound represented by the above formula (3-4-3) as a principal component was obtained by carrying out the same reaction as that of Synthesis Example (C-1) except that an iodinate material represented by the following formula (C-e-2) was used instead of the iodinated material represented by the above formula (C-e-1) described in Synthesis Example (C-1).

(C-e-2)

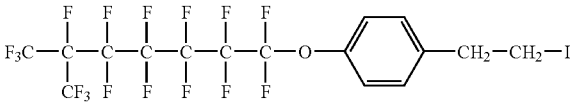

Synthesis Example (C-3)

Synthesis of Compound Represented by the Above Formula (3-4-6)

A product containing the compound represented by the above formula (3-4-6) as a principal component was obtained by carrying out the same reaction as that of Synthesis Example (C-1) except that an iodinated material represented by the following formula (C-e-3) was used instead of the iodinated material represented by the above formula (C-e-3) described in Synthesis Example (C-1).

(C-e-3)

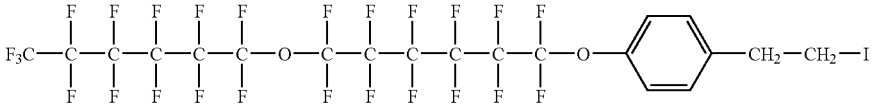

Synthesis Example (C-4)

A reaction was carried out in a manner similar to that of Synthesis Example (C-1) except that an iodinated material represented by the following formula (C-f-1):

(C-f-1)

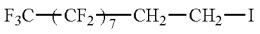

(in the above formula, 7 represents the number of repetitions of the repeating unit) was used instead of the iodinated material represented by the above formula (C-e-1) described in Synthesis Example (C-1). Consequently, a product, in which a compound represented by the following formula (C-f):

(C-f)

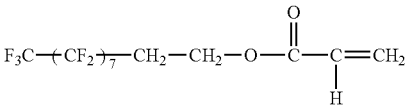

(in the above formula, 7 represents the number of repetitions of the repeating unit)

was a principal component, was obtained.

Production Example (C-1)

Production of Polymer (C-A)

In a glass flask equipped with an agitator, a reflux condenser, a dropping funnel, a thermometer, and a gas-blowing opening, 10 parts of methyl methacrylate (hereinafter, abbreviated as MMA) and 0.3 part of an acetone (17.5%)-toluene mixture solvent were placed. Subsequently, a nitrogen gas was introduced into the flask and then 0.5 part of azobisisobutyronitrile (hereinafter, abbreviated as AIBN) as a polymerization initiator and 0.32 part of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and then added every 30 minutes in nine times. Likewise, AIBN (1.5 parts) was added every 1.5 hours in three times to carry out the polymerization. Subsequently, the mixture was refluxed for an additional two hours, thereby terminating the polymerization. A polymer solution of the above formula (g) was obtained. The reaction temperature was 77 to 87° C. Part of the reaction solution was re-precipitated with n-hexane and then dried, followed by obtaining an acid value of 0.34 mg equivalent/g as a result of the measurement of acid value. An average number of repetitions of the repeating unit was about 80.

Next, part of acetone was distilled off from the above reaction solution, followed by the addition of 0.5% of triethyl amine as a catalyst and 200 ppm of hydroquinone monomethyl ether as a polymerization-prohibiting agent. In addition, 1.2-fold molar excess of glycidyl methacrylate was added with respect to the acid value of the polymer. Subsequently, the reaction solution was reacted for 11 hours under reflux (about 110° C.). The reaction solution was added to 10 volumes of n-hexane and then precipitated, followed by drying at 80° C. under reduced pressure. As a result, 90 parts of a compound represented by the above formula (d-1) was obtained.

Next, the following materials were placed in a glass flask equipped with an agitator, a reflux condenser, a dropping funnel, a thermometer, and a gas-blowing opening and then subjected to the introduction of a nitrogen gas, followed by reacting for 5 hours under reflux (heated to about 100° C.). 70 parts of a compound represented by the above formula (d-1). 30 parts of a product in which compound represented by the above formula (3-4-1) obtained in Synthesis Example (C-1) was a principal component. 270 parts of trifluorotoluene. AIBN (0.35 part). The reaction solution was introduced into 10 volumes of methanol and precipitated, followed by drying at 80° C. under reduced pressure. Consequently, a polymer (C-A: weight average molecular weight (Mw): 21,000) having a repeating structural unit represented by the above formula (1-4-1) was obtained.

The weight average molecular weight of the polymer was determined in a manner similar to the measurement method as described above.

Production Example (C-2)

Production of Polymer (C-B)

The reaction and the process were carried out by the same procedures as those of Production Example (C-1) except that the compound represented by the above formula (3-4-1) was replaced with a product in which the compound represented by the above formula (3-4-3) obtained in Synthesis Example (C-2) was a principal component. Consequently, a polymer (C-B: weight average molecular weight (Mw) 20,000) having the repeating structural unit represented by the above formula (1-4-3) was obtained.

Production Example (C-3)

Production of Polymer (C-C))

The reaction and the process were carried out by the same procedures as those of Production Example (C-1) except that the compound represented by the above formula (3-4-1) was replaced with a product in which the compound represented by the above formula (3-4-6) obtained in Synthesis Example (C-3) was a principal component. Consequently, a polymer (C-C: weight average molecular weight (Mw)=23,000) having the repeating structural unit represented by the above formula (1-4-6) was obtained.

Production Example (C-4)

Production of Polymer (C-D) (Comparative Example)

The reaction and the process were carried out by the same procedures as those of Production Example (C-1) except that the compound represented by the above formula (3-4-1) was replaced with a product in which the compound represented by the above formula (C-f) obtained in Synthesis Example (C-4) was a principal component. Consequently, a polymer (C-D: weight average molecular weight (Mw) 21,000) having the repeating structural unit represented by the following formula (C-f-2) was obtained:

(C-f-2)

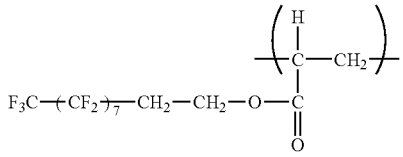

(in the above formula, 7 represents the number of repetitions of the repeating unit)

Example (C-1)

A conductive support used was an aluminum cylinder (JIS-A3003 aluminum alloy ED tube, manufactured by Showa Aluminum Corporation) with 260.5 mm in length and 30 mm in diameter obtained by heat extrusion under the environment with a temperature of 23° C. and a humidity of 60% RH.

The following materials were dispersed with a sand mill with 1-mm-diameter glass beads for 3 hours, thereby preparing a dispersion solution. $TiO_2$ particles covered with oxygen-deficient $SnO_2$ as conductive particles (power resistivity: 80Ω·cm, $SnO_2$ coverage rate (mass ratio): 50%), 6.6 parts. A phenol resin (trade name: Plyophen J-325, manufactured by Dainippon Ink & Chemicals, Incorporated. 60% resin solid) as a resin binder, 5.5 parts. Methoxy propanol as a solvent, 5.9 parts.

The following materials were added to the dispersion solution, and the whole was stirred, thereby preparing a conductive-layer coating solution. Silicone resin particles (trade name: Tospal 120, GE Toshiba Silicones, average particle size: 2 μm) as a surface-roughness imparting agent, 0.5 part. Silicone oil (trade name: SH28PA, manufactured by Dow Corning Toray Silicone Co., Ltd.) as a leveling agent, 0.001 part.

The support was dip-coated with the conductive-layer coating solution and the whole was dried at a temperature of 140° C. for 30 minutes to heat-curing, thereby forming a conductive layer of 15 μm in average film thickness at a position of 130 mm from the upper side of the support.

The conductive layer was dip-coated with the following intermediate-layer coating solution and then the whole was dried at a temperature of 100° C. for 10 minutes, thereby forming an intermediate layer of 0.5 μm in average film thickness at a position of 130 mm from the upper end of the support. An intermediate-layer coating solution prepared by dissolving N-methoxy methylated nylon (trade name: Toresin EF-30T, manufactured by Teikoku Chemical Industry Co., Ltd.), 4 parts, and a copolymer nylon resin (Amilan CM8000, manufactured by Toray Co., Ltd.), 2 parts, in a mixture solvent of 65 parts of methanol and 30 parts of n-butanol.

Subsequently, the following materials were dispersed with a sand-milling device with glass beads of 1 mm in diameter for 1 hour. Next, 250 parts of ethyl acetate was added to the mixture, thereby preparing a charge-generating layer coating solution. Hydroxy gallium phthalocyanine in crystal form with strong peaks at Bragg angles (2θ±0.2°) in CuKα-characteristic X-ray diffraction of 7.5°, 9.9°, 16.3°, 18.6°, 25.1°, and 28.3°, 10 parts. Polyvinyl butyral (trade name: S-LEX BX-1, manufactured by Sekisui Chemical, Co., Ltd.), 5 parts. Cyclohexanone, 250 parts.

The intermediate layer was dip-coated with the charge-generating layer coating solution and then the whole was dried at a temperature of 100° C. for 10 minutes, thereby forming a charge-generating layer of 0.16 μm in average film thickness at a position of 130 mm from the upper end of the support.

Next, the following materials were dissolved in a mixture solvent of 30 parts of dimethoxy methane and 70 parts of chlorobenzene, thereby preparing a coating solution containing a charge-transporting substance. A charge-transporting substance having a structure represented by the above formula (CTM-1), 10 parts. A polycarbonate resin (Iupilon Z-400, manufactured by Mitsubishi Engineering-Plastics Corporation) [viscosity average molecular weight (Mv) 39,000] formed of a repeating structural unit represented by the above formula (P-1) as a binder resin, 10 parts. A polymer produced in Production Example (C-1) (C-A: 0.2 part).

The charge-generating layer was dip-coated with the charge-transporting layer coating solution thus prepared and then the whole was dried at a temperature of 120° C. for 30 minutes. Consequently, a charge-transporting layer with an average film thickness of 17 μm at a position of 130 mm from the upper end of the support was formed.

Consequently, the electrophotographic photosensitive member in which the charge-transporting layer was provided as a surface layer was prepared.

The electrophotographic photosensitive member thus prepared was evaluated for initial blade turn-up*1 and electrophotographic properties*2. The results are shown in Table 3.

*1: Evaluation Method for Initial Blade Turn-Up

The electrophotographic photosensitive member thus prepared, the main body of a laser beam printer LBP-2510 manufactured by Canon Co. Ltd., and a process cartridge of the main body were placed under the environment with a temperature of 35° C. and a humidity of 80% RH for 15 hours. After that, under the environment, the electrophotographic photosensitive member thus prepared was mounted on the process cartridge, followed by continuous output of 20 sheets of a solid white image. During the printing, whether a turn-up trouble of a cleaning blade occurred was observed (the evaluation was performed on four stations (four new electrophotographic photosensitive members and four new process cartridges were prepared for the respective colors), and "F" was written in Table 1 when the turn-up trouble occurred even only once or "A" was written when no trouble occurred).

*2: Evaluation Method for Electrophotographic Properties

The prepared electrophotographic photosensitive member, the main body of the laser beam printer LBP-2510 manufactured by Canon Co., Ltd., and tools for measuring a surface potential were placed under the environment with a temperature of 25° C. and a humidity of 50% RH (normal temperature and normal humidity) for 15 hours. Further, the tools for measuring the surface potential were those (the toner, the developing rollers, and the cleaning blade were removed) used for placing a probe for surface-potential measurement of an electrophotographic photosensitive member on the developing roller position of the process cartridge of the LBP-2510. After that, under the same environment, the tools for measuring the surface potential of the electrophotographic photosensitive member were attached to the member, and the surface potential of the electrophotographic photosensitive member was then measured without sheet-feeding under the condition in which a belt unit for electrostatic image transfer was removed. By the way, the tools for measuring the surface potential were mounted on the station of a cyan process cartridge in the main body and the measurement was then carried out.

A potential measurement method was carried out as described below. First, an exposure part potential (VI: a potential at first round after exposure of the electrophotographic photosensitive member with whole surface exposure after electrification) was measured. Next, a pre-exposure after-potential (Vr: a potential at first cycle (second round after electrification) after the pre-exposure without image exposure with electrification at only first round of the electrophotographic photosensitive member) was then measured. Subsequently, a cycle of electrification/whole-surface image exposure/pre-exposure was repeated 1,000 times (1K cycles). After that, the pre-exposure after-potential (in the table, represented by Vr (1K)) was measured again. Those results were shown in Table 3.

Example (C-2)

An electrophotographic photosensitive member was prepared and evaluated in a manner similar to that of Example (C-1) except that the polymer (C-A) used in the charge-transporting layer coating solution in Example (C-1) was replaced with the polymer (C-B) produced in Production Example (C-2). The results are shown in Table 3.

Example (C-3)

An electrophotographic photosensitive member was prepared and evaluated in a manner similar to that of Example (C-1) except that the polymer (C-A) used in the charge-transporting layer coating solution in Example (C-1) was replaced with the polymer (C-C) produced in Production Example (C-3). The results are shown in Table 3.

Example (C-4)

An electrophotographic photosensitive member was prepared and evaluated in a manner similar to that of Example (C-1) except for the following change in Example (C-1). The results are shown in Table 3.

The polycarbonate resin formed of a repeating structural unit represented by the above formula (P-1), the binder resin of the charge-transporting layer, was replaced with a polyarylate resin having a repeating structural unit represented by the above formula (P-2) (weight average molecular weight (Mw): 120,000).

By the way, a molar ratio between a terephthalic acid structure and an isophthalic acid structure in the above polyarylate resin (tetraphthalic acid structure: isophthalic acid structure) was 50:50.

Example (C-5)

An electrophotographic photosensitive member was prepared and evaluated in a manner similar to that of Example (C-4) except that hydroxy gallium phthalocyanine as the charge-generating substance of the charge-generating layer in Example (C-4) was replaced with oxytitanium phthalocyanine (TiOPc) below. The results are shown in Table 3. TiOPc with strong peaks at Bragg angles 2θ±0.2° in CuKα-characteristic X-ray diffraction of 9.0°, 14.20°, 23.9°, and 27.1°.

Example (C-6)

An electrophotographic photosensitive member was prepared and evaluated in a manner similar to that of Example (C-5) except that the charge-transporting substance represented by the above formula (CTM-1) used in the charge-transporting layer coating solution in Example (C-5) was replaced with a charge-transporting substance represented by the above formula (CTM-2) and a charge-transporting substance represented by the above formula (CTM-3). 5 parts of each charge-transporting substance was used. The results are shown in Table 3.

Comparative Example (C-1)

An electrophotographic photosensitive member was prepared and evaluated in a manner similar to that of Example (C-1) except that the polymer (C-A) was not included in the charge-transporting layer coating solution in Example (C-1). The results are shown in Table 3.

Comparative Example (C-2)

An electrophotographic photosensitive member was prepared and evaluated in a manner similar to that of Example (C-1) except that the polymer (C-A) used in the charge-transporting layer coating solution in Example (C-1) was replaced with 2,6-di-tert-butyl-p-cresol (BHT). The results are shown in Table 3.

Comparative Example (C-3)

An electrophotographic photosensitive member was prepared and evaluated in a manner similar to that of Example (C-1) except that the polymer (C-A) used in the charge-transporting layer coating solution in Example (C-1) was replaced with the polymer (C-D) produced in Production Example (C-4). The results are shown in Table 3.

Comparative Example (C-4)

An electrophotographic photosensitive member was prepared and evaluated in a manner similar to that of Example (C-1) except that the polymer (C-A) used in the charge-transporting layer coating solution in Example (C-1) was replaced with a compound (trade name Alon GF300, manufactured by Toagosei Co., Ltd.). The results are shown in Table 3.

TABLE 3

| | | Initial blade | Initial electro-photographic properties | | After endurance |
|---|---|---|---|---|---|
| | | turn-up | Vl (−V) | Vr (−V) | Vr (1K) (−V) |
| Example C-1 | Polymer C-A | A | 120 | 35 | 45 |
| Example C-2 | Polymer C-B | A | 120 | 25 | 30 |
| Example C-3 | Polymer C-C | A | 125 | 30 | 35 |
| Example C-4 | Polymer C-A | A | 125 | 35 | 45 |
| Example C-5 | Polymer C-A | A | 125 | 30 | 35 |
| Example C-6 | Polymer C-A | A | 120 | 25 | 30 |
| Comparative Example C-1 | — | F | 120 | 25 | 30 |
| Comparative Example C-2 | BHT | F | 135 | 45 | 75 |
| Comparative Example C-3 | Polymer C-D | A | 120 | 40 | 60 |
| Comparative Example C-4 | Alon GF300 | A | 125 | 35 | 55 |

As is evident from the above results, Examples (C-1) to (C-6) of the present invention and Comparative Examples (C-1) and (C-2) are compared with each other, whereby the following fact is found. Blade turn-up at an initial stage can be prevented by producing an electrophotographic photosensitive member using a compound having a repeating structural unit of the present invention as a constitutional component of a coating solution for the formation of a surface layer. As a result, an electrophotographic photosensitive member avoiding such a trouble can be provided.

In addition, by comparing Examples (C-1) to (C-6) and Comparative Example (C-3) of the present invention with each other, the compound having the repeating structural unit of the present invention is shown to be excellent in repetitive property out of the electrophotographic properties.

Further, Examples (C-1) to (C-6) of the present invention and Comparative Example (C-4) are compared with each other, whereby the following fact is found. An electrophotographic photosensitive member is produced by using a compound having a repeating structural unit of the present invention as a constitutional component of a coating solution for the formation of a surface layer. As a result, the member is more excellent in the repetitive property out of the electrophotographic properties than that in the case where the compound of Comparative Example 4 is used.

Synthesis Example (D-1)

Synthesis of Compound Represented by the Above Formula (3-5-2)

An iodinated material (0.5 part) represented by the following formula (D-e-1):

(D-e-1)

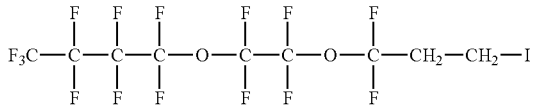

and ion-exchanged water (20 parts) were charged into a deaerated autoclave, followed by heating up to 300° C. to carry out a conversion reaction of iodine to a hydroxyl group at a gauge pressure of 9.2 MPa for 4 hours. After the end of the reaction, diethyl ether (20 parts) was added to the reaction mixture. After the mixture had been separated into two phases, magnesium sulfate (0.2 part) was placed in an ether phase and magnesium sulfate was then removed by filtration, thereby obtaining a hydroxyl compound. The hydroxyl compound was subjected to column chromatography to separate and remove components other than principal components. Subsequently, 100 parts of the previously obtained hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. Next, the flask was heated up to 110° C. and the reaction was then continued until the raw material, the hydroxyl compound, disappeared. After the completion of the reaction, the mixture was diluted with 200 parts of toluene, washed with an aqueous sodium hydroxide solution twice, and then washed with ion-exchanged water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the compound represented by the above formula (3-5-2) was a principal component.

Synthesis Example (D-2)

Synthesis of Compound Represented by the Above Formula (3-5-4)

A product containing the compound represented by the above formula (3-5-4) as a principal component was obtained by carrying out the same reaction as that of Synthesis Example (D-1) except that an iodinated material represented by the following formula (D-e-2) was used instead of the iodinated material represented by the above formula (D-e-1) described in Synthesis Example (D-1).

(D-e-2)

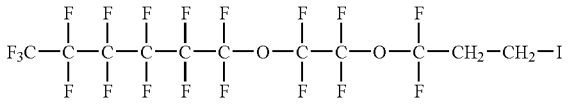

Synthesis Example (D-3)

Synthesis of Compound Represented by the Above Formula (3-5-5)

A product containing the formula represented by the above formula (3-5-5) as a principal component was obtained by carrying out the same reaction as that of Synthesis Example (D-1) except that an iodinated material represented by the following formula (D-e-3) was used instead of the iodinated material represented by the above formula (D-e-1) described in Synthesis Example (D-1).

(D-e-3)

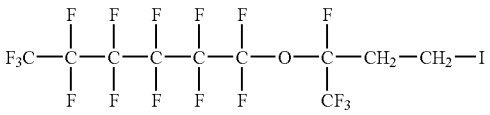

Synthesis Example (D-4)

Synthesis of Compound Represented by the Above Formula (3-5-6)

A product containing the compound represented by the above formula (3-5-6) as a principal component was obtained by carrying out the same reaction as that of Synthesis Example (D-1) except that an iodinated material represented by the following formula (D-e-4) was used instead of the iodinated material represented by the above formula (D-e-1) described in Synthesis Example (D-1).

(D-e-4)

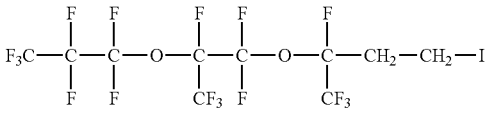

Synthesis Example (D-5)

A reaction was carried out in a manner similar to that of Synthesis Example (D-1) except that an iodinated material represented by the following formula (D-f-1):

(D-f-1)

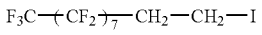

(in the above formula, 7 represents the number of repetitions of the repeating unit) was used instead of the iodinated material represented by the above formula (D-e-1) described in Synthesis Example (D-1). Consequently, a product, in which a compound represented by the following formula (D-f):

(D-f)

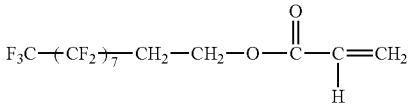

(in the above formula, 7 represents the number of repetitions of the repeating unit)

was a principal component, was obtained.

Production Example (D-1)

Production of Polymer (D-A)

In a glass flask equipped with an agitator, a reflux condenser, a dropping funnel, a thermometer, and a gas-blowing opening, 10 parts of methyl methacrylate (hereinafter, abbreviated as MMA) and 0.3 part of an acetone (17.5%)-toluene mixture solvent were placed. Subsequently, a nitrogen gas was introduced into the flask and then 0.5 part of azobisisobutyronitrile (hereinafter, abbreviated as AIBN) as a polymerization initiator and 0.32 part of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and then added every 30 minutes in nine times. Likewise, AIBN (1.5 parts) was added every 1.5 hours in three times to carry out the polymerization. Subsequently, the mixture was refluxed for an additional two hours, thereby terminating the polymerization. A polymer solution of the above formula (g) was obtained. The reaction temperature was 77 to 87° C. Part of the reaction solution was re-precipitated with n-hexane and then dried, followed by obtaining an acid value of 0.34 mg equivalent/g as a result of the measurement of acid value. An average number of repetitions of the repeating unit was about 80.

Next, part of acetone was distilled off from the above reaction solution, followed by the addition of 0.5% of triethylamine as a catalyst and 200 ppm of hydroquinone monomethyl ether as a polymerization-prohibiting agent. In addition, 1.2-fold molar excess of glycidyl methacrylate was added with respect to the acid value of the polymer. Subsequently, the reaction solution was reacted for 11 hours under reflux (about 110° C.). The reaction solution was added to 10 volumes of n-hexane and then precipitated, followed by drying at 80° C. under reduced pressure. As a result, 90 parts of a compound represented by the above formula (d-1) was obtained.

Next, the following materials were placed in a glass flask equipped with an agitator, a reflux condenser, a dropping funnel, a thermometer, and a gas-blowing opening and then subjected to the introduction of a nitrogen gas, followed by reacting for 5 hours under reflux (heated to about 100° C.). 70 parts of a compound represented by the above formula (d-1). 30 parts of a product in which a compound represented by the above formula (3-5-3) obtained in Synthesis Example (D-1) was a principal component. 270 parts of trifluorotoluene. AIBN (0.35 part). The reaction solution was introduced into 10 volumes of methanol and precipitated, followed by drying at 80° C. under reduced pressure. Consequently, a polymer (D-A: weight average molecular weight (Mw): 22,000) having a repeating structural unit represented by the above formula (1-5-3) was obtained.

The weight average molecular weight of the polymer was determined in a manner similar to the measurement method as described above.

Production Example (D-2)

Production of Polymer (D-B)

The reaction and the process were carried out by the same procedures as those of Production Example (D-1) except that the compound represented by the above formula (3-5-3) was replaced with a product in which the compound represented by the above formula (3-5-4) obtained in Synthesis Example (D-2) was a principal component. Consequently, a polymer (D-B: weight average molecular weight 23,000) having the repeating structural unit represented by the above formula (1-5-4) was obtained.

Production Example (D-3)

Production of Polymer (D-C)

The reaction and the process were carried out by the same procedures as those of Production Example (D-1) except that the compound represented by the above formula (3-5-3) was replaced with a product in which the compound represented by the above formula (3-5-5) obtained in Synthesis Example (D-3) was a principal component. Consequently, a polymer (D-C: weight average molecular weight 20,000) having the repeating structural unit represented by the above formula (1-5-5) was obtained.

Production Example (D-4)

Production of Polymer (D-D)

The reaction and the process were carried out by the same procedures as those of Production Example (D-1) except that the compound represented by the above formula (3-5-3) was replaced with a product in which the compound represented by the above formula (3-5-6) obtained in Synthesis Example (D-4) was a principal component. Consequently, a polymer (D-9: weight average molecular weight 24,500) having the repeating structural unit represented by the above formula (1-5-6) was obtained.

Production Example (D-5)

Production of Polymer (D-E)) (Comparative Example)

The reaction and the process were carried out by the same procedures as those of Production Example (D-1) except that the compound represented by the above formula (3-3-2) was replaced with a product in which the compound represented by the above formula (D-f) obtained in Synthesis Example (D-5) was a principal component. Consequently, a polymer (D-E: weight average molecular weight 21,000) having the repeating structural unit represented by the following formula (D-f-2) was obtained:

(D-f-2)

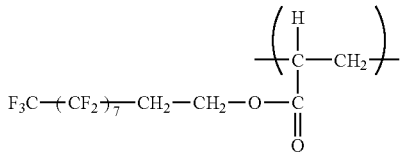

(in the above formula, 7 represents the number of repetitions of the repeating unit).

Example (D-1)

A conductive support used was an aluminum cylinder (JIS-A3003, aluminum alloy ED tube, manufactured by Showa Aluminum Corporation) with 260.5 mm in length and 30 mm in diameter obtained by heat extrusion under the environment with a temperature of 23° C. and a humidity of 60% RH.

The following materials were dispersed with a sand mill with 1-mm-diameter glass beads for 3 hours, thereby preparing a dispersion solution. $TiO_2$ particles covered with oxygen-deficient $SnO_2$ as conductive particles (power resistivity: 80Ω·cm, $SnO_2$ coverage rate (mass ratio): 50%), 6.6 parts. A phenol resin (trade name: Plyophen J-325, manufactured by Dainippon Ink & Chemicals, Incorporated. 60% resin solid) as a resin binder, 5.5 parts. Methoxy propanol as a solvent, 5.9 parts.

The following materials were added to the dispersion solution, and the whole was stirred, thereby preparing a conductive-layer coating solution. Silicone resin particles (trade name: Tospal 120, GE Toshiba Silicones, average particle size: 2 μm) as a surface-roughness imparting agent, 0.5 part. Silicone oil (trade name: SH28PA, manufactured by Dow Corning Toray Silicone Co., Ltd.) as a leveling agent, 0.001 part.

The support was dip-coated with the conductive-layer coating solution and the whole was dried at a temperature of 140° C. for 30 minutes to heat-curing, thereby forming a conductive layer of 15 μm in average film thickness at a position of 130 mm from the upper side of the support.

The conductive layer was dip-coated with the following intermediate-layer coating solution and then the whole was dried at a temperature of 100° C. for 10 minutes, thereby forming an intermediate layer of 0.5 μm in average film thickness at a position of 130 mm from the upper end of the support. An intermediate-layer coating solution prepared by dissolving N-methoxy methylated nylon (trade name: Toresin EF-30T, manufactured by Teikoku Chemical Industry Co., Ltd.), 4 parts, and a copolymer nylon resin (Amilan CM8000, manufactured by Toray Co., Ltd.), 2 parts, in a mixture solvent of 65 parts of methanol and 30 parts of n-butanol.

Subsequently, the following materials were dispersed with a sand-milling device with glass beads of 1 mm in diameter for 1 hour. Next, 250 parts of ethyl acetate was added to the mixture, thereby preparing a charge-generating layer coating solution. Hydroxy gallium phthalocyanine in crystal form with strong peaks at Bragg angles (2θ±0.2°) in CuKα-characteristic X-ray diffraction of 7.5°, 9.9°, 16.3°, 18.6°, 25.1°, and 28.3°, 10 parts. Polyvinyl butyral (trade name: S-LEX BX-1, manufactured by Sekisui Chemical, Co., Ltd.), 5 parts. Cyclohexanone, 250 parts.

The intermediate layer was dip-coated with the charge-generating layer coating solution and then the whole was dried at a temperature of 100° C. for 10 minutes, thereby forming a charge-generating layer of 0.16 μm in average film thickness at a position of 130 mm from the upper end of the support.

Next, the following materials were dissolved in a mixture solvent of 30 parts of dimethoxy methane and 70 parts of chlorobenzene, thereby preparing a coating solution containing a charge-transporting substance. A charge-transporting substance having a structure represented by the above formula (CTM-1), 10 parts. A polycarbonate resin (Iupilon Z-400, manufactured by Mitsubishi Engineering-Plastics Corporation) [viscosity average molecular weight (Mv): 39,000] formed of a repeating structural unit represented by the above formula (P-1) as a binder resin, 10 parts. A polymer produced in Production Example (D-1) (D-A: 0.2 part).

The charge-generating layer was dip-coated with the charge-transporting layer coating solution thus prepared and then the whole was dried at a temperature of 120° C. for 30 minutes. Consequently, a charge-transporting layer with an average film thickness of 17 μm at a position of 130 mm from the upper end of the support was formed.

Consequently, the electrophotographic photosensitive member in which the charge-transporting layer was provided as a surface layer was prepared.

The electrophotographic photosensitive member thus prepared was evaluated for initial blade turn-up*1 and electrophotographic properties*2. The results are shown in Table 1.

*1: Evaluation Method for Initial Blade Turns-Up

The electrophotographic photosensitive member thus prepared, the main body of a laser beam printer LBP-2510 manufactured by Canon Co. Ltd., and a process cartridge of the main body were placed under the environment with a temperature of 35° C. and a humidity of 80% RH for 15 hours. After that, under the environment, the electrophotographic photosensitive member thus prepared was mounted on the process cartridge, followed by continuous output of 20 sheets of a solid white image. During the printing, whether a turn-up trouble of a cleaning blade occurred was observed (the evaluation was performed on four stations (four new electrophotographic photosensitive members and four new process cartridges were prepared for the respective colors), and "F" was written in Table 1 when the turn-up trouble occurred even only once or "A" was written when no trouble occurred at all).

*2: Evaluation Method for Electrophotographic Properties

The prepared electrophotographic photosensitive member, the main body of the laser beam printer LBP-2510 manufactured by Canon Co., Ltd., and tools for measuring a surface potential were placed under the environment with a temperature of 25° C. and a humidity of 50% RH (normal temperature and normal humidity) for 15 hours. Further, the tools for measuring the surface potential were those (the toner, the developing rollers, and the cleaning blade were removed) used for placing a probe for surface-potential measurement of an electrophotographic photosensitive member on the developing roller position of the process cartridge of the LBP-2510. After that, under the same environment, the tools for measuring the surface potential of the electrophotographic photosensitive member were attached to the member, and the surface potential of the electrophotographic photosensitive member was then measured without sheet-feeding under the condition in which a belt unit for electrostatic image transfer was removed. By the way, the tools for measuring the surface potential were mounted on the station of a cyan process cartridge in the main body and the measurement was then carried out.

A potential measurement method was carried out as described below. First, an exposure part potential (VI: a potential at first round after exposure of the electrophotographic photosensitive member with whole surface exposure after electrification) was measured. Next, a pre-exposure after-potential (Vr: a potential at first cycle (second round after electrification) after the pre-exposure without image exposure with electrification at only first round of the electrophotographic photosensitive member) was then measured. Subsequently, a cycle of electrification/whole-surface image exposure/pre exposure was repeated 1,000 times (1K cycles). After that, the pre-exposure after-potential (in the table, represented by Vr (1K)) was measured again. Those results were shown in Table 4.

Example (D-2)

An electrophotographic photosensitive member was prepared and evaluated in a manner similar to that of Example (D-1) except that the polymer (D-A) used in the charge-transporting layer coating solution in Example (D-1) was replaced with the polymer (D-B) produced in Production Example (D-2). The results are shown in Table 4.

Example (D-3)

An electrophotographic photosensitive member was prepared and evaluated in a manner similar to that of Example (D-1) except that the polymer (D-A) used in the charge-transporting layer coating solution in Example (D-1) was replaced with the polymer (D-C) produced in Production Example (D-3). The results are shown in Table 4.

Example (D-4)

An electrophotographic photosensitive member was prepared and evaluated in a manner similar to that of Example (D-1) except that the polymer (D-A) used in the charge-transporting layer coating solution in Example (D-1) was replaced with the polymer (D-D) produced in Production Example (D-4). The results are shown in Table 4.

Example (D-5)

An electrophotographic photosensitive member was prepared and evaluated in a manner similar to that of Example (D-1) except for the following change in Example (D-1). The results are shown in Table 4.

The polycarbonate resin formed of a repeating structural unit represented by the above formula (P-1), the binder resin of the charge-transporting layer, was replaced with a polyarylate resin having a repeating structural unit represented by the above formula (P-2) (weight average molecular weight (Mw): 120,000).

By the way, a molar ratio between a terephthalic acid structure and an isophthalic acid structure in the above polyarylate resin (tetraphthalic acid structure: isophthalic acid structure) was 50:50.

Example (D-6)

An electrophotographic photosensitive member was prepared and evaluated in a manner similar to that of Example (D-6) except that hydroxy gallium phthalocyanine as the charge-generating substance of the charge-generating layer in Example (D-5) was replaced with oxytitanium phthalocyanine (TiOPc) below. The results are shown in Table 4. TiOPc with strong peaks at Bragg angles 2θ±0.2° in CuKα-characteristic X-ray diffraction of 9.0°, 14.2°, 23.9°, and 27.1°.

Example (D-7)

An electrophotographic photosensitive member was prepared and evaluated in a manner similar to that of Example (D-7) except that the charge-transporting substance represented by the above formula (CTM-1) used in the charge-transporting layer coating solution in Example (D-6) was replaced with a charge-transporting substance represented by the above formula (CTM-2) and a charge-transporting substance represented by the following formula (CTM-3). 5 parts of each charge-transporting substance was used. The results are shown in Table 4.

Comparative Example (D-1)

An electrophotographic photosensitive member was prepared and evaluated in a manner similar to that of Example (D-1) except that the polymer (D-A) was not contained in the charge-transporting layer coating solution in Example (D-1). The results are shown in Table 4.

Comparative Example (D-2)

An electrophotographic photosensitive member was prepared and evaluated in a manner similar to that of Example (D-1) except that the polymer (D-A) used in the charge-transporting layer coating solution in Example (D-1) was replaced with 2,6-di-tert-butyl-p-cresol (BHT). The results are shown in Table 4.

Comparative Example (D-3)

An electrophotographic photosensitive member was prepared and evaluated in a manner similar to that of Example (D-1) except that the polymer (D-A) used in the charge-transporting layer coating solution in Example (D-1) was replaced with the polymer (D-E) produced in Production Example (D-5). The results are shown in Table 4.

Comparative Example (D-4)

An electrophotographic photosensitive member was prepared and evaluated in a manner similar to that of Example (D-1) except that the polymer (D-A) used in the charge-transporting layer coating solution in Example (D-1) was replaced with a compound (trade name Alon GF300, manufactured by Toagosei Co., Ltd.). The results are shown in Table 4.

TABLE 4

| | | Initial blade | Initial electro-photographic properties | | After endurance Vr |
|---|---|---|---|---|---|
| | | turn-up | Vl (−V) | Vr (−V) | (1K) (−V) |
| Example D-1 | Polymer D-A | A | 125 | 35 | 45 |
| Example D-2 | Polymer D-B | A | 125 | 35 | 45 |
| Example D-3 | Polymer D-C | A | 120 | 35 | 45 |
| Example D-4 | Polymer D-D | A | 120 | 30 | 40 |
| Example D-5 | Polymer D-A | A | 125 | 35 | 45 |
| Example D-6 | Polymer D-A | A | 125 | 35 | 45 |
| Example D-7 | Polymer D-A | A | 125 | 35 | 45 |
| Comparative Example D-1 | — | F | 120 | 25 | 30 |
| Comparative Example D-2 | BHT | F | 135 | 45 | 75 |
| Comparative Example D-3 | Polymer D-E | A | 120 | 40 | 60 |
| Comparative Example D-4 | Alon GF300 | A | 125 | 35 | 55 |

As is evident from the above results, Examples (D-1) to (D-7) of the present invention and Comparative Examples (D-1) and (D-2) are compared with each other, whereby the following fact is found. Blade turn-up at an initial stage can be prevented by producing an electrophotographic photosensitive member using a compound having a repeating structural unit according to the present invention as a constitutional component of a coating solution for the formation of a surface layer. As a result, an electrophotographic photosensitive member avoiding such a trouble can be provided.

In addition, by comparing Examples (D-1) to (D-7) of the present invention and Comparative Example (D-3) with each other, a structure in which an alkyl group having a fluorine atom and an alkylene group having a fluorine atom are coupled with each other through oxygen or a structure in which an alkylene group having a fluorine atom and an alkylene group having a fluorine atom are coupled with each other through oxygen in a compound having a repeating structural unit according to the present invention is shown to be excellent in repetitive property out of the electrophotographic properties.

Further, Examples (D-1) to (D-7) of the present invention and Comparative Example (D-4) are compared with each other, whereby the following fact is found. An electrophotographic photosensitive member is produced by using a compound having a repeating structural unit according to the present invention as a structural component of a coating solution for the formation of a surface layer. As a result, the member is more excellent in the repetitive property out of the electrophotographic properties than that in the case where the compound of Comparative Example 4 is used.

Synthesis Example (E-1)

Synthesis of Compound Represented by the Above Formula (3-6-2)

0.5 part of an iodinated material represented by the following formula (E-e-1):

$$F_3C—CF_2—CF_2—CF_2—CH_2—CH_2—I \quad \text{(E-e-1)}$$

and 20 parts of ion-exchanged water were incorporated into a deaerated autoclave, followed by heating the inside of the autoclave up to 300° C. to carry out a conversion reaction of iodine to a hydroxyl group at a gauge pressure of 9.2 MPa for 4 hours.

After the end of the reaction, 20 parts of diethyl ether were added to the reaction mixture. After the mixture had been separated into two phases, 0.2 part of magnesium sulfate was placed in an ether phase and the magnesium sulfate was then removed by filtration, thereby obtaining a hydroxyl compound of the above formula (E-e-1). The hydroxyl compound was subjected to column chromatography to separate and remove components other than principal components, whereby the hydroxyl compound was obtained. Subsequently, 100 parts of the hydroxyl compound, 50 parts of acrylic acid, 5 parts of hydroquinone, 5 parts of p-toluenesulfonic acid, and 200 parts of toluene were introduced into a glass flask equipped with an agitator, a condenser, and a thermometer. After that, the glass flask was heated up to 110° C. and the reaction was then continued until the raw material, the hydroxyl compound, disappeared. After the completion of the reaction, the mixture was diluted with 200 parts of toluene, washed with an aqueous sodium hydroxide solution twice, and then washed with ion-exchanged water three times. Subsequently, toluene was distilled off under reduced pressure, thereby obtaining a product. The resulting product was identified by $^{1}$H-NMR and $^{19}$F-NMR. As a result of the quantitative analysis of the product by gas chromatography, it was found that the principal component of the product was the compound represented by the above formula (3-6-2).

Synthesis Example (E-2)

Synthesis of Compound Represented by the Above Formula (3-6-3)

A product containing the compound represented by the above formula (3-6-3) as a principal component was obtained by carrying out the same reaction as that of Synthesis Example (E-1) except that an iodinated material represented by the following formula (E-e-2) was used instead of the iodine compound represented by the above formula (E-e-1) described in Synthesis Example (E-1).

$$F_3C—CF_2—CF_2—CF_2—CH_2—CH_2—CH_2—I \quad \text{(E-e-2)}$$

Synthesis Example (E-3)

Synthesis of Compound Represented by the Above Formula (3-6-10)

A product containing the compound represented by the above formula (3-6-10) as a principal component was obtained by carrying out the same reaction as that of Synthesis Example (E-1) except that an iodinated material represented by the following formula (E-e-3) was used instead of the iodinated material represented by the above formula (E-e-1) described in Synthesis Example (E-1).

$$F_3C—CF_2—CF_2—CF_2—CF_2—CF_2—CH_2—CH_2—I \quad \text{(E-e-3)}$$

Synthesis Example (E-4)

Synthesis of Compound Represented by the Above Formula (3-6-11)

A product containing the compound represented by the above formula (3-6-11) as a principal component was obtained by carrying out the same reaction as that of Synthesis Example (E-1) except that an iodinated material represented by the following formula (E-e-4) was used instead of the iodinated material represented by the above formula (E-e-1) described in Synthesis Example (E-1).

$$F_3C—CF_2—CF_2—CF_2—CF_2—CF_2—CF_2—CH_2—CH_2—CH_2—I \quad \text{(E-e-4)}$$

Synthesis Example (E-5)

Instead of the iodinated material represented by the above formula (E-e-1) described in Synthesis Example (E-1), an iodinated material represented by the following formula (E-f-1-a):

$$F_3C—(CF_2)_7—CH_2—CH_2—I \quad \text{(E-f-1-a)}$$

(in the above formula, 7 represents the number of repetitions of the repeating unit of the substituent —$CF_2$—) was used and reacted in a manner similar to Synthesis Example (E-1). As a result, a product having a compound represented by the following formula (E-f-1):

$$F_3C—(CF_2)_7—CH_2—CH_2—O—\overset{\overset{\displaystyle O}{\|}}{C}—\underset{\underset{\displaystyle H}{|}}{C}=CH_2 \quad \text{(E-f-1)}$$

(in the above formula, 7 represents the number of repetitions of the repeating unit of the substituent —$CF_2$—) as a principal component was obtained.

Synthesis Example (E-6)

Instead of the Iodinated material represented by the above formula (E-e-1) described in Synthesis Example (E-1), an iodinated material represented by the following formula (E-f-2-a):

$$F_3C—(CF_2)_9—CH_2—CH_2—I \quad \text{(E-f-2-a)}$$

(in the formula, 9 represents the number of repetitions of the repeating unit of the substituent —$CF_2$—) was used and reacted in a manner similar to Synthesis Example (E-1). As a result, a product having a compound represented by the following formula (E-f-2):

$$F_3C—(CF_2)_9—CH_2—CH_2—O—\overset{\overset{\displaystyle O}{\|}}{C}—\underset{\underset{\displaystyle H}{|}}{C}=CH_2 \quad \text{(E-f-2)}$$

(in the formula, 9 represents the number of repetitions of the repeating unit of the substituent —$CF_2$—) as a principal component was obtained.

Synthesis Example (E-7)

Instead of the iodinated material represented by the above formula (E-e-1) described in Synthesis Example (E-1), an iodinated material represented by the following formula (E-f-3-a):

$$F_3C—CF_2—CH_2—CH_2—I \quad \text{(E-f-3-a)}$$

was used and reacted in a manner similar to Synthesis Example (E-1) As a result, a product having a compound represented by the following formula (E-f-3):

(E-f-3)

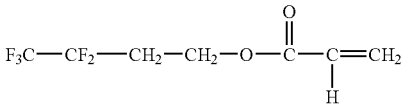

as a principal component was obtained.

Production Example (E-1)

Production of Polymer (E-A)

In a glass flask equipped with an agitator, a reflux condenser, a dropping funnel, a thermometer, and a gas-blowing opening, 10 parts of methyl methacrylate (hereinafter, abbreviated as MMA) and 0.3 part of an acetone (17.5%)-toluene mixture solvent were introduced. Subsequently, a nitrogen gas was introduced into the flask and then 0.5 part of 2,2'-azobisisobutyronitrile (hereinafter, abbreviated as AIBN) as a polymerization initiator and 0.32 part of thioglycolic acid as a chain transfer agent were added to initiate polymerization under reflux. During a time period of 4.5 hours after the initiation, 90 parts of MMA was continuously dropped. In addition, 2.08 parts of thioglycolic acid was dissolved in 7 parts of toluene and then added every 30 minutes in nine times. Likewise, 1.5 parts of AIBN was added every 1.5 hours in three times to carry out the polymerization. Subsequently, the mixture was refluxed for an additional two hours, thereby terminating the polymerization. A polymer solution of the above formula (g) was obtained. The reaction temperature was 77 to 87° C.

Part of the reaction solution was re-precipitated with n-hexane and then dried, followed by obtaining an acid value of 0.34 mg equivalent/g as a result of the measurement of acid value. An average number of repeating the repetitions of unit was about 80.

Next, part of acetone was distilled off from the above reaction solution, followed by the addition of 0.5% of triethyl amine as a catalyst and 200 ppm of hydroquinone monomethyl ether as a polymerization-prohibiting agent. In addition, 1.2-fold molar excess of glycidyl methacrylate was added with respect to the acid value of the polymer. Subsequently, the reaction solution was reacted for 11 hours under reflux (about 110° C.). The reaction solution was added to 10 volumes of n-hexane and then precipitated, followed by drying at 80° C. under reduced pressure. As a result, 90 parts of a compound represented by the above formula (d-1) was obtained.

Next, in a glass flask equipped with an agitator, a reflux condenser, a dropping funnel, a thermometer, and a gas-blowing opening, the following components were introduced: A compound represented by the above formula (d-1), 70 parts.

A product containing a compound obtained in Synthesis Example (E-1) and represented by the above formula (3-6-2) as a principal component, 30 parts.

Trifluorotoluene, 270 parts.

AIBN, 0.35 part.

A nitrogen gas was introduced into the flask and then the mixture was reacted for 5 hours under reflux (heated to about 100° C.). The reaction solution was placed in 10 volumes of methanol and precipitated, followed by drying at 80° C. under reduced pressure. Consequently, a polymer (E-A) having a repeating structural unit represented by the above formula (1-6-2) was obtained. By the way, the weight average molecular weight of the polymer (E-A) was 22,000.

The weight average molecular weight of the polymer was determined in a manner similar to the above measurement method.

Production Example (E-2)

Production of Polymer (E-B)

A polymer (E-B) having a repeating structural unit represented by the above formula (1-6-3) was obtained by a reaction and a process carried out by the same procedures as those of Production Example (E-1) except that the compound represented by the above formula (3-6-2) was replaced with a product in which the compound represented by the above formula (3-6-3) obtained in Synthesis Example (E-2) was a principal component. By the way, the weight average molecular weight of the polymer (E-B) was 20,000.

Production Example (E-3)

Production of Polymer (E-C)

A polymer (E-C) having a repeating structural unit represented by the above formula (1-6-10) was obtained by a reaction and a process carried out by the same procedures as those of Production Example (E-1) except that the compound represented by the above formula (3-6-2) was replaced with a product in which the compound represented by the above formula (3-6-10) obtained in Synthesis Example (E-3) was a principal component. By the way, the weight average molecular weight of the polymer (E-C) was 23,000.

Production Example (E-4)

Production of Polymer (E-D)

A polymer (E-D) having a repeating structural unit represented by the above formula (1-6-11) was obtained by a reaction and a process carried out by the same procedures as those of Production Example (E-1) except that the compound represented by the above formula (3-6-2) was replaced with a product in which the compound represented by the above formula (3-6-11) obtained in Synthesis Example (E-4) was a principal component. By the way, the weight average molecular weight of the polymer (E-D) was 22,600.

Production Example (E-5)

Production of Polymer (E-E)

A polymer (E-E) was obtained by a reaction and a process carried out by the same procedures as those of Production Example (E-1) except that each of the following components was used instead of 30 parts of the compound represented by the above formula (3-6-2). The polymer (E-E) included a repeating structural unit represented by the above formula (1-6-2) and a repeating structural unit represented by the above formula (1-6-10) in a molar ratio of 70:30. By the way, the weight average molecular weight of the polymer (E-E) was 22,900.

A product containing a compound obtained in Synthesis Example (E-1) and represented by the above formula (3-6-2) as a principal component, 21 parts.

A product containing a compound obtained in Synthesis Example (E-3) and represented by the above formula (3-6-10) as a principal components 9 parts.

Production Example (E-6)

Production of Polymer (E-F)

A polymer (E-F) was obtained by a reaction and a process carried out by the same procedures as those of Production Example (E-1) except that each of the following components was used instead of 30 parts of the compound represented by the above formula (3-6-2). The polymer (E-F) included a repeating structural unit represented by the above formula (1-6-2) and a repeating structural unit represented by the above formula (1-6-10) in a molar ratio of 50:50. By the way, the weight average molecular weight of the polymer (E-F) was 24,000.

A product containing a compound obtained in Synthesis Example (E-1) and represented by the above formula (3-6-2) as a principal component, 15 parts.

A product containing a compound obtained in Synthesis Example (E-3) and represented by the above formula (3-6-10) as a principal component, 15 parts.

Production Example (E-7)

Production of Polymer (E-G)

A polymer (E-G) was obtained by a reaction and a process carried out by the same procedures as those of Production Example (E-1) except that each of the following components was used instead of 30 parts of the compound represented by the above formula (3-6-2). The polymer (E-G) included a repeating structural unit represented by the above formula (1-6-2) and a repeating structural unit represented by the above formula (1-6-10) in a molar ratio of 30:70. By the way, the weight average molecular weight of the polymer (E-G) was 25,000.

A product containing a compound obtained in Synthesis Example (E-1) and represented by the above formula (3-6-2) as a principal component, 9 parts.

A product containing a compound obtained in Synthesis Example (E-3) and represented by the above formula (3-6-10) as a principal component, 21 parts.

Production Example (E-8)

Production of Polymer (E-H)

A polymer (E-H) was obtained by a reaction and a process carried out by the same procedures as those of Production Example (E-1) except that each of the following components was used instead of 30 parts of the compound represented by the above formula (3-6-2). As a result, the polymer (E-H) included a repeating structural unit represented by the following formula (E-f-3-b):

(E-f-3-b)

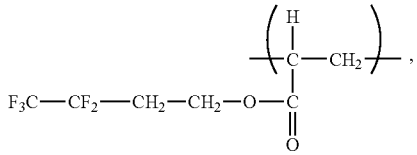

a repeating structural unit represented by the above formula (1-6-2), and a repeating structural unit represented by the above formula (1-6-10) in a molar ratio of 3:67:30. By the way, the weight average molecular weight of the polymer (E-H) was 22,000.

A product containing a compound obtained in Synthesis Example (E-7) and represented by the above formula (E-f-3) as a principal component, 1 part.

A product containing a compound obtained in Synthesis Example (E-1) and represented by the above formula (3-6-2) as a principal component, 20 parts.

A product containing a compound obtained in Synthesis Example (E-3) and represented by the above formula (3-6-10) as a principal component, 9 parts.

Production Example (E-9)

Production of Polymer (E-I)

A polymer (E-I) was obtained by a reaction and a process carried out by the same procedures as those of Production Example (E-1) except that each of the following components was used instead of 30 parts of the compound represented by the above formula (3-6-2). As a result, the polymer (E-I) included a repeating structural unit represented by the above formula (1-6-2), a repeating structural unit represented by the above formula (1-6-10), and a repeating structural unit represented by the following formula (E-f-1-b):

(E-f-1-b)

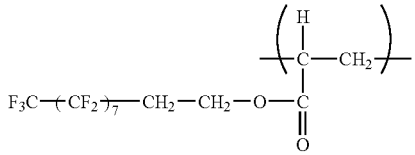

(in the above formula, 7 represents the number of repetitions of the repeating unit of the substituent —$CF_2$—) in a molar ratio of 30:67:3. By the way, the weight average molecular weight of the polymer (E-I) was 18,600.

A product containing a compound obtained in Synthesis Example (E-1) and represented by the above formula (3-6-2) as a principal component, 9 parts.

A product containing a compound obtained in Synthesis Example (E-3) and represented by the above formula (3-6-10) as a principal component, 20 parts.

A product containing a compound obtained in Synthesis Example (E-5) and represented by the above formula (E-f-1) as a principal component, 1 part.

Production Example (E-10)

Production of Polymer (E-J) (Comparative Example)

A polymer (E-J) having a repeating structural unit represented by the above formula (E-f-1-b) was obtained by a reaction and a process carried out by the same procedures as those of Production Example (E-1) except that the compound represented by the above formula (3-6-2) was replaced with a product in which the compound represented by the above formula (E-f-1) obtained in Synthesis Example (E-5) was a principal component. By the way, the weight average molecular weight of the polymer (E-J) was 24,000.

Production Example (E-11)

Production of Polymer (E-K) (Comparative Example)

A polymer (E-K) was obtained by a reaction and a process carried out by the same procedures as those of Production Example (E-1) except that the compound represented by the above formula (3-6-2) was replaced with a product in which the compound represented by the above formula (E-f-2) obtained in Synthesis Example (E-6) was a principal component. As a result, the polymer (E-K) had a repeating structural unit represented by the following formula (E-f-2-b):

(E-f-2-b)

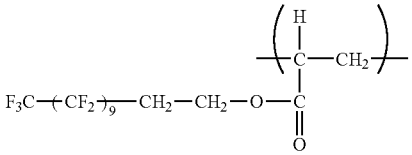

(in the above formula, 9 represents the number of repetitions of the repeating unit of the substituent —$CF_2$—). By the way, the weight average molecular weight of the polymer (E-K) was 25,000.

Production Example (E-12)

Production of Polymer (E-L) (Comparative Example)

A polymer (E-L) having a repeating structural unit represented by the above formula (E-f-3-b) was obtained by a reaction and a process carried out by the same procedures as those of Production Example (E-1) except that the compound represented by the above formula (3-6-2) was replaced with a product in which the compound represented by the above formula (E-f-3) obtained in Synthesis Example (E-7) was a principal component. By the way, the weight average molecular weight of the polymer (E-L) was 21,700.

Example (E-1)

A conductive support used was an aluminum cylinder (JIS-A3003, aluminum alloy ED tube, manufactured by Showa Aluminum Corporation) with 260.5 mm in length and 30 mm in diameter obtained by heat extrusion under the environment with a temperature of 23° C. and a humidity of 60% RH.

The following materials were dispersed with a sand mill with 1-mm-diameter glass beads for 3 hours, thereby preparing a dispersion solution. $TiO_2$ particles covered with oxygen-deficient $SnO_2$ as conductive particles (power resistivity: 80Ω·cm, $SnO_2$ coverage rate (mass ratio): 50%), 6.6 parts. A phenol resin (trade name: Plyophen J-325, manufactured by Dainippon Ink & Chemicals, Incorporated. 60% resin solid) as a resin binder, 5.5 parts. Methoxy propanol as a solvent, 5.9 parts.

The following materials were added to the dispersion solution, and the whole was stirred, thereby preparing a conductive-layer coating solution. Silicone resin particles (trade name: Tospal 120, GE Toshiba Silicones, average particle size: 2 μm) as a surface-roughness imparting agent, 0.5 part. Silicone oil (trade name: SH28PA, manufactured by Dow Corning Toray Silicone Co., Ltd.) as a leveling agent, 0.001 part.

The support was dip-coated with the conductive-layer coating solution and the whole was dried at a temperature of 140° C. for 30 minutes to heat-curing, thereby forming a conductive layer of 15 μm in average film thickness at a position of 130 mm from the upper side of the support.

The conductive layer was dip-coated with the following intermediate-layer coating solution and then the whole was dried at a temperature of 100° C. for 10 minutes, thereby forming an intermediate layer of 0.5 μm in average film thickness at a position of 130 mm from the upper end of the support. An intermediate-layer coating solution prepared by dissolving N-methoxy methylated nylon (trade name: Toresin EF-30T, manufactured by Teikoku Chemical Industry Co., Ltd.), 4 parts, and a copolymer nylon resin (Amilan CM8000, manufactured by Toray Co., Ltd.), 2 parts, in a mixture solvent of 65 parts of methanol and 30 parts of n-butanol.

Subsequently, the following materials were dispersed with a sand-milling device with glass beads of 1 mm in diameter for 1 hour. Next, 250 parts of ethyl acetate was added to the mixture, thereby preparing a charge-generating layer coating solution. Hydroxy gallium phthalocyanine in crystal form with strong peaks at Bragg angles (2θ±0.2°) in CuKα-characteristic X-ray diffraction of 7.5°, 9.9°, 16.3°, 18.6°, 25.1°, and 28.3°, 10 parts. Polyvinyl butyral (trade name: S-LEX BX-1, manufactured by Sekisui Chemical, Co., Ltd.), 5 parts. Cyclohexanone, 250 parts.

The intermediate layer was dip-coated with the charge-generating layer coating solution and then the whole was dried at a temperature of 100° C. for 10 minutes, thereby forming a charge-generating layer of 0.16 μm in average film thickness at a position of 130 mm from the upper end of the support. The polymer (E-A) produced in Production Example (E-1), 0.2 part.

The charge-generating layer was dip-coated with the charge-transporting layer coating solution thus prepared and then the whole was dried at a temperature of 120° C. for 30 minutes. Consequently, a charge-transporting layer with an average film thickness of 17 μm at a position of 130 mm from the upper end of the support was formed.

Consequently, the electrophotographic photosensitive member in which the charge-transporting layer was provided as a surface layer was prepared.

The electrophotographic photosensitive member thus prepared was evaluated for initial blade turn-up*1 and electrophotographic properties*2. The results are shown in Table 1.

*1: Evaluation Method for Initial Blade Turn-Up

The electrophotographic photosensitive member thus prepared, the main body of a laser beam printer LBP-2510 manufactured by Canon Co. Ltd., and a process cartridge of the main body were placed under the environment with a temperature of 35° C. and a humidity of 80% RH for 15 hours. After that, under the environment, the electrophotographic photosensitive member thus prepared was mounted on the process cartridge, followed by continuous output of 20 sheets of a solid white image. During the printing, whether a turn-up trouble of a cleaning blade occurred was observed (the evaluation was performed on four stations (four new electrophotographic photosensitive members and four new process cartridges were prepared for the respective colors), and "F" was written in Table 1 when the turn-up trouble occurred even only once or "A" was written when no trouble occurred).

*2: Evaluation Method for Electrophotographic Properties

The prepared electrophotographic photosensitive member, the main body of the laser beam printer LBP-2510 manufactured by Canon Co., Ltd., and tools for measuring a surface potential were placed under the environment with a temperature of 25° C. and a humidity of 50% RH (normal temperature and normal humidity) for 15 hours. Further, the tools for measuring the surface potential were those (the toner, the developing rollers, and the cleaning blade were removed) used for placing a probe for surface-potential measurement of an electrophotographic photosensitive member on the developing roller position of the process cartridge of the LBP-2510. After that, under the same environment, the tools for measuring the surface potential of the electrophotographic photosensitive member was attached to the member, and the surface potential of the electrophotographic photosensitive member was then measured without sheet-feeding under the condition in which a belt unit for electrostatic image transfer was removed. By the way, the tools for measuring the surface potential were mounted on the station of a cyan process cartridge in the main body and the measurement was then carried out.

A potential measurement method was carried out as described below. First, an exposure part potential (VI: a potential at first round after exposure of the electrophotographic photosensitive member with whole surface exposure after electrification) was measured. Next, a pre-exposure after-potential (Vr: a potential at first cycle (second round after electrification) after the pre-exposure without image exposure with electrification at only first round of the electrophotographic photosensitive member) was then measured. Subsequently, a cycle of electrification/whole-surface image exposure/pre-exposure was repeated 1,000 times (1K cycles). After that, the pre-exposure after-potential (in the table, represented by Vr (1K)) was measured again. Those results were shown in Table 5.

Example (E-2) to (E-9)

An electrophotographic photosensitive member was prepared and evaluated in a manner similar to that of Example (E-1) except that the polymer (E-A) used in the charge-transporting layer coating solution in Example (E-1) was replaced with a polymer represented in Table 5. The results are shown in Table 5.

Example (E-10)

An electrophotographic photosensitive member was prepared and evaluated in a manner similar to that of Example (E-1) except for the following change in Example (E-1). The results are shown in Table 5.

The polycarbonate resin formed of a repeating structural unit represented by the above formula (P-1), the binder resin of the charge-transporting layer, was replaced with a polyarylate resin having a repeating structural unit represented by the above formula (P 2)(weight average molecular weight (Mw): 120,000).

By the way, a molar ratio between a terephthalic acid structure and an isophthalic acid structure in the above polyarylate resin (tetraphthalic acid structure: isophthalic acid structure) was 50:50.

Example (E-11)

An electrophotographic photosensitive member was prepared and evaluated in a manner similar to that of Example (E-10) except that the polymer (E-A) used in the charge-transporting layer coating solution in Example (E-10) was replaced with the polymer (E-B). The results are shown in Table 5.

Example (E-12)

An electrophotographic photosensitive member was prepared and evaluated in a manner similar to that of Example (E-10) except that the charge-transporting substance represented by the above formula (CTM-1) used in the charge-transporting layer coating solution in Example (E-10) was replaced with a charge-transporting substance represented by the above formula (CTM-2) and a charge-transporting substance represented by the above general formula (CTM-3) where 5 parts of each charge-transporting substance was used. The results are shown in Table 5.

Example (E-13)

An electrophotographic photosensitive member was prepared and evaluated in a manner similar to that of Example (E-12) except that the polymer (E-A) used in the charge-transporting layer coating solution in Example (E-12) was replaced with the polymer (EBB) The results are shown in Table 5.

Comparative Example (E-1)

An electrophotographic photosensitive member was prepared and evaluated in a manner similar to that of Example (E-1) except that the polymer (E-A) was not included in the charge-transporting layer coating solution in Example (E-1). The results are shown in Table 5.

Comparative Example (E-2)

An electrophotographic photosensitive member was prepared and evaluated in a manner similar to that of Example (E-1) except that the polymer (E-A) used in the charge-transporting layer coating solution in Example (E-1) was replaced with 2,6-di-tert-butyl-p-cresol (BHT). The results are shown in Table 5.

Comparative Examples (E-3) to (E-5)

An electrophotographic photosensitive member was prepared and evaluated in a manner similar to that of Example (E-1) except that the polymer (E-A) used in the charge-transporting layer coating solution in Example (E-1) was replaced with a polymer represented in Table 5. The results are shown in Table 5.

Comparative Example (E-6)

An electrophotographic photosensitive member was prepared and evaluated in a manner similar to that of Example (E-1) except that the polymer (E-A) used in the charge-transporting layer coating solution in Example (E-1) was replaced with a compound (trade name Alon CF300, manufactured by Toagosei Co., Ltd.) The results are shown in Table 5.

TABLE 5

| | | Repeating structural unit with fluorine atom (molar ratio) | Initial blade turn-up | Initial electrophotographic properties Vl (−V) | Vr (−V) | After endurance Vr (1K) (−V) |
|---|---|---|---|---|---|---|
| Example E-1 | Polymer E-A | (1-6-2) (100) | A | 120 | 30 | 40 |
| Example E-2 | Polymer E-B | (1-6-3) (100) | A | 120 | 30 | 40 |
| Example E-3 | Polymer E-C | (1-6-10) (100) | A | 120 | 35 | 45 |
| Example E-4 | Polymer E-D | (1-6-11) (100) | A | 120 | 35 | 45 |
| Example E-5 | Polymer E-E | (1-6-2) (70)<br>(1-6-10) (30) | A | 125 | 35 | 45 |
| Example E-6 | Polymer E-F | (1-6-2) (50)<br>(1-6-10) (50) | A | 125 | 35 | 45 |
| Example E-7 | Polymer E-G | (1-6-2) (30)<br>(1-6-10) (70) | A | 125 | 35 | 45 |
| Example E-8 | Polymer E-H | (E-f-3-b) (3)<br>(1-6-2) (67)<br>(1-6-10) (30) | A | 120 | 35 | 45 |
| Example E-9 | Polymer E-I | (E-f-1-b) (3)<br>(1-6-2) (30)<br>(1-6-10) (67) | A | 120 | 35 | 45 |
| Example E-10 | Polymer E-A | (1-6-2) (100) | A | 120 | 25 | 30 |
| Example E-11 | Polymer E-B | (1-6-3) (100) | A | 120 | 25 | 30 |
| Example E-12 | Polymer E-A | (1-6-2) (100) | A | 120 | 25 | 30 |
| Example E-13 | Polymer E-B | (1-6-3) (100) | A | 120 | 25 | 30 |
| Comparative Example E-1 | — | | F | 120 | 25 | 30 |
| Comparative Example E-2 | BHT | | F | 135 | 45 | 75 |
| Comparative Example E-3 | Polymer E-J | (E-f-1-b) (100) | A | 120 | 40 | 60 |
| Comparative Example E-4 | Polymer E-K | (E-f-2-b) (100) | A | 140 | 45 | 70 |
| Comparative Example E-5 | Polymer E-L | (E-f-3-b) (100) | F | 125 | 40 | 65 |
| Comparative Example E-6 | Alon GF300 | | A | 125 | 35 | 55 |

As is evident from the above results, Examples (E-1) to (E-13) of the present invention and Comparative Examples (E-1) and (E-2) are compared with each other, whereby the following fact is found. Blade turn-up at an initial stage can be prevented by producing an electrophotographic photosensitive member using a compound having a repeating structural unit of the present invention as a constitutional component of a coating solution for the formation of a surface layer. As a result, an electrophotographic photosensitive member avoiding such a trouble can be provided.

In addition, by comparing Examples (E-1) to (E-13) of the present invention and Comparative Examples (E-3) to (E-5) with each other, the use of a compound containing the structure in the compound having the repeating structural unit of the present invention in the range in the present invention is shown to provide excellent repetitive property out of the electrophotographic properties.

Further, Examples (E-1) to (E-13) of the present invention and Comparative Example (E-6) are compared with each other, whereby the following fact is found. An electrophotographic photosensitive member is produced by using a compound having a repeating structural unit of the present invention as a constitutional component of a coating solution for the formation of a surface layer. As a result, the member is more excellent in the repetitive property out of the electrophotographic properties than that in the case where the compound of Comparative Example (E-6) is used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The present application claims the priority of each of Japanese Patent Application No. 2006-295889 filed Oct. 31, 2006, Japanese Patent Application Nos. 2006-295885 filed Oct. 31, 2006, 2006-295890 filed Oct. 31, 2006, 2006-295882 filed Oct. 31, 2006, 2006-295886 filed Oct. 31, 2006, and 2007-257077 filed Oct. 1, 2007, the contents of which are incorporated herein by their reference.

What is claimed is:

1. An electrophotographic photosensitive member, comprising:

a support; and a photosensitive layer formed on the support, wherein:

the electrophotographic photosensitive member has a surface layer of the electrophotographic photosensitive member containing a polymer having repeating structural units each represented by the following formula (1):

(1)

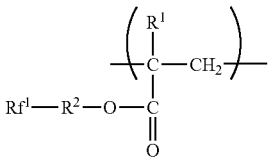

where $R^1$ represents a hydrogen atom or a methyl group, $R^2$ represents a single bond or a divalent group, and $Rf^1$ represents a monovalent group having at least one of a fluoroalkyl group and a fluoroalkylene group; and wherein 70 to 100% by number of the repeating structural units each represented by the formula (1) in the polymer represented by at least one of the following formulae (1-2) to (1-5):

(1-2)

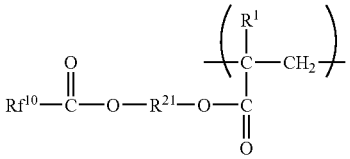

(1-3)

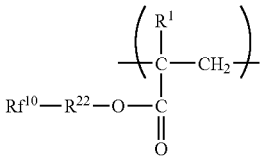

(1-4)

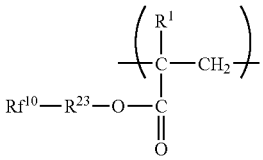

(1-5)

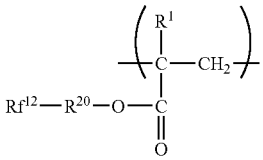

where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group, or a —O—Ar—R— group where Ar represents an arylene group and R represents an alkylene group, $Rf^{10}$ represents a monovalent group having at least a fluoroalkyl group, and $Rf^{12}$ represents a fluoroalkyl group interrupted with oxygen.

2. An electrophotographic photosensitive member according to claim 1, wherein the polymer having the repeating structural units each represented by the formula (1) further has repeating structural units each represented by the following formula (a):

(a)

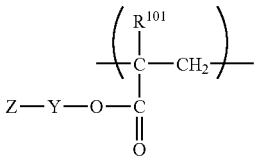

where $R^{101}$ represents a hydrogen atom or a methyl group, Y represents a divalent organic group, and Z represents a polymer unit.

3. An electrophotographic photosensitive member according to claim 2, wherein Z in the formula (a) is a polymer unit having a repeating structural unit represented by the following formula (b-1) or (b-2):

(b-1)

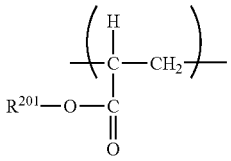

where $R^{201}$ represents an alkyl group;

(b-2)

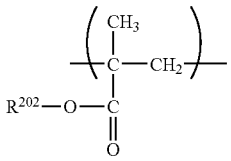

here $R^{202}$ represents an alkyl group.

4. An electrophotographic photosensitive member according to claim 2, wherein Y in the formula (a) is a divalent organic group having at least a structure represented by the following formula (c):

(c)

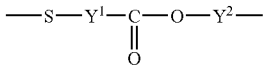

where $Y^1$ and $Y^2$ each independently represent an alkylene group.

5. An electrophotographic photosensitive member according to claim 1, wherein:

the polymer having the repeating structural units each represented by the formula (1) is synthesized by polymerization of compounds each represented by the following formula (3):

(3)

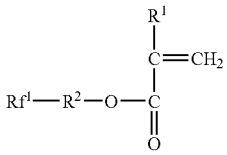

where $R^1$ represents a hydrogen atom or a methyl group, $R^2$ represents a single bond or a divalent group, and $Rf^1$ represents a monovalent group having at least one of a fluoroalkyl group and a fluoroalkylene group, wherein 70 to 100% by number of the compounds each represented by the formula (3) are represented by at least one of the following formulae (3-2) to (3-5):

(3-2)

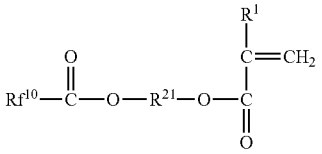

(3-3)

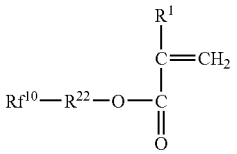

(3-4)

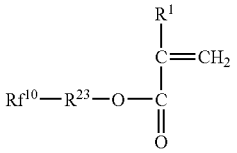

(3-5)

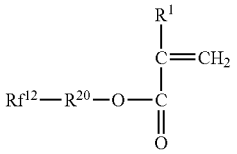

where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group, or a —O—Ar—R— group where Ar represents an arylene group and R represents an alkylene group, $Rf^{10}$ represents a monovalent group having at least a fluoroalkyl group, and $Rf^{12}$ represents a fluoroalkyl group interrupted with oxygen.

6. An electrophotographic photosensitive member according to claim 2, wherein the polymer having the repeating structural units each represented by the formula (1) and the repeating structural units each represented by the formula (a) is synthesized by polymerization of compounds each represented by the following formula (3) and compounds each represented by the following formula (d):

(3)

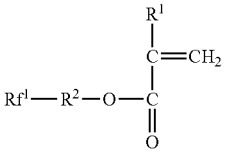

where $R^1$ represents a hydrogen atom or a methyl group, $R^2$ represents a single bond or a divalent group, and $Rf^1$ represents a monovalent group having at least one of a fluoroalkyl group and a fluoroalkylene group, (d)

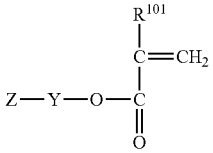

where $R^{101}$ represents a hydrogen atom or a methyl group, Y represents a divalent organic group, and Z represents a polymer unit, wherein 70 to 100% by number of the compounds each represented by the formula (3) are represented by at least one of the following formulae (3-2) to (3-5):

(3-2)

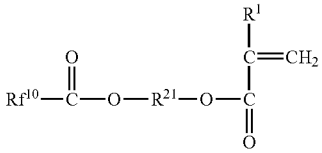

(3-3)

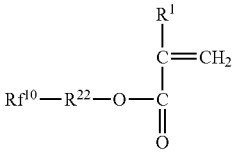

(3-4)

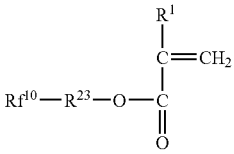

(3-5)

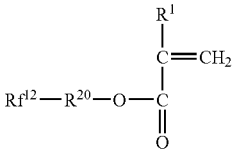

where $R^1$ represents a hydrogen atom or a methyl group, $R^{20}$ represents a single bond or an alkylene group, $R^{21}$ represents an alkylene group having a branched structure with a carbon-carbon bond, $R^{22}$ represents a —$R^{21}$— group or a —O—$R^{21}$— group, $R^{23}$ represents a —Ar— group, a —O—Ar— group, or a —O—Ar—R— group where Ar represents an arylene group and R represents an alkylene group, $Rf^{10}$ represents a monovalent group having at least a fluoroalkyl group, and $Rf^{12}$ represents a fluoroalkyl group interrupted with oxygen.

7. A method of manufacturing the electrophotographic photosensitive member according to claim 1, which comprises a step of forming the surface layer of the electrophotographic photosensitive member by using a surface-layer coating solution containing the polymer having the repeating structural unit represented by the formula (1).

8. A process cartridge, comprising:

the electrophotographic photosensitive member according to claim 1; and at least one unit selected from the group consisting of a charging unit, a developing unit, and a cleaning unit, wherein the member and the at least one unit are integrally supported and detachably attached to a main body of an electrophotographic apparatus.

9. A process cartridge according to claim 8, wherein the cleaning unit includes a cleaning blade.

10. An electrophotographic apparatus, comprising:

the electrophotographic photosensitive member according to claim 1;

a charging unit;

an exposing unit;

a developing unit;

a transfer unit; and a cleaning unit.

11. An electrophotographic apparatus according to claim 10, wherein the cleaning unit includes a cleaning blade.

* * * * *